US006667081B1

(12) United States Patent
Aoki et al.

(10) Patent No.: US 6,667,081 B1
(45) Date of Patent: Dec. 23, 2003

(54) POUCH AND METHOD OF PRODUCING FILM FOR POUCH

(75) Inventors: Yukitaka Aoki, Tokyo-to (JP); Takashi Nakagome, Tokyo-to (JP); Izumi Kojima, Tokyo-to (JP); Seiichiro Komoda, Tokyo-to (JP); Koji Otsuka, Tokyo-to (JP); Koji Shimizu, Tokyo-to (JP); Taeko Kanamori, Tokyo-to (JP); Nana Sugimoto, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/334,912

(22) Filed: Jun. 17, 1999

(30) Foreign Application Priority Data

Jun. 19, 1998 (JP) ..... P10-172355
Jul. 17, 1998 (JP) ..... P10-203039
Dec. 24, 1998 (JP) ..... P10-368226

(51) Int. Cl.[7] ..... B65D 35/08

(52) U.S. Cl. ..... 428/34.1; 383/33; 383/34; 383/104; 383/200; 383/205; 383/207; 383/906; 206/218; 222/92

(58) Field of Search ..... 428/34.1; 383/200, 383/205, 207, 104, 906, 33, 34, 203, 208, 209; 206/217, 218; 222/92, 107, 105

(56) References Cited

U.S. PATENT DOCUMENTS 3,074,612 A * 1/1963 Schneider ..... 229/17
3,144,976 A * 8/1964 Freshour ..... 229/7
4,498,591 A * 2/1985 Smith, II ..... 383/209
4,717,046 A * 1/1988 Brogli ..... 206/484
4,998,646 A * 3/1991 Sherman ..... 222/107
5,312,189 A * 5/1994 Aeschbach et al. ..... 383/207
5,535,885 A * 7/1996 Daniel et al. ..... 206/469
5,941,642 A * 8/1999 Darmstadter ..... 383/207

* cited by examiner

*Primary Examiner*—Harold Pyon
*Assistant Examiner*—Alicia Chevalier
(74) *Attorney, Agent, or Firm*—Ladas & Parry

(57) ABSTRACT

A pouch of the present invention comprises a front and a rear walls and a narrow pouring portion, and at least one wall portion is partially protruded to an outward direction of the pouch to be provided with a bulge portion having a hollow structure at vicinity of the pouring portion. Alternatively, a cut line of the pouring portion is positioned based on a vertex of a vertical angle of an assumed right triangle which is drawn at the pouring portion by the predetermined regulations. A half-cut line as an opening aid may be provided to a position to be opened of the pouch, the half-cut line being formed so as to have a combination of a deep part and a shallow part and/or a combination of a wide part and a narrow part. The bulge portion may be formed by subjecting a preheated resin film to press molding with the use of a die comprising a cavity and a core, and then cooling the thus press-molded resin film while it is held in the die.

26 Claims, 41 Drawing Sheets

POUCH AND METHOD OF PRODUCING FILM FOR POUCH

BACKGROUND OF THE INVENTION

1. Field of the Invention

The present invention relates to a pouch capable of storing a fluid content such as liquid, viscous fluid or powder, and particularly to a discharge-improved pouch provided with a pouring portion having a narrow width in which the pouring portion is improved in expanding ability and configuration-keeping ability, which is preferably applicable to, for example, a pouch for refilling its content into a refill container.

The present invention further relates to a method of producing a film to be used as material forming the above mentioned pouch.

The present invention still further relates to an easy open pouch which is provided with an improved half-cut line as an opening aid to facilitate opening of the pouch, and particularly to an easy open pouch which is facilitated in opening to such an extent that the pouch is easily torn along the half-cut line when an opening operation, and in addition improved in safety of storage to such an extent that it hardly causes spontaneous tearing on the ordinary handling such as a manufacturing process or a transporting or distributing operation.

2. Description of the Related Art

As a pouch for refill which stores and seals up a fluid content such as liquid, a self-standing pouch incorporating with features of a three-dimensional container as well as self-standing ability has been conventionally used, and various technical efforts are adapted to the pouch in order to pour a content from the opened pouch into another container without spill. For example, an opening is made by cutting out only a corner of the pouch, and an upper portion of the pouch is not entirely cut out. Alternatively, a narrow pouring portion is formed at one position of the upper portion of the pouch, or a separately formed pouring parts such as a plastic mold product is mounted at one position of the upper portion of the pouch.

The manner to cut out the corner of the pouch is easy, but it is difficult for this manner to control pouring direction of the content. In particular, when the content is poured into a container having a small opening such as tapered bottle, an opening of the pouch which is small and flexible is liable to get off the aimed opening of the container during a course of pouring to spill the content out, thereby causing problems in easiness and safety of pouring.

As to the other manner in which a separately formed pouring parts such as a plastic mold product is mounted at one position of the upper portion of the pouch, this manner needs many steps to produce the pouch, and also causes high cost of the pouring parts it self. In addition, since the pouch provided with the separately formed pouring parts is relatively thick, cost for storing or transporting gets expensive. Further, when the content is filled into such a pouch, number of empty pouches to be stacked in a feeder of a filling machine is reduced because of a large thickness of the pouch, and an operator has to frequently supply them into the feeder. Accordingly, this manner causes problems of a large cost and a complicated process.

If the rest in which a narrow pouring portion is formed at one position of the upper portion of the pouch is adapted, it is possible to expect a certain improvements in handling and safety of pouring. However, when the pouring portion formed in such a manner is torn and opened, the thus formed opening of the pouring portion is not easily expanded, and flow of pouring is not steady. In particular, when an amount of the remaining content gets small, the opening of the pouring portion is liable to spontaneously close, and if the pouch is pushed in this condition in order to push out the content, the content may flush and spill out. Accordingly, Even this manner also causes the problems in easiness and safety of pouring operation.

On the other hand, as an easy open pouch, there has been conventionally known a pouch in which a notch having an optional shape is formed at an end portion of an opening position. The notch serves as a start point of tearing to facilitate opening of the pouch. However, since the notch can not control tearing to be developed in a constant direction, it is difficult to tear the pouch along a cut line indicating desired direction only by the notch.

In order to solve this problem, for example, use of the notch is combined with a manner in which the pouch is formed from a lamination film having an intermediate layer made of an uniaxial oriented film, an oriented direction of which is aligned with a direction of the cut line (a tearing direction), or a manner in which half-cut line is formed along the cut line.

However, the manner using the uniaxial oriented film causes an expensive cost of a material. Besides, when the cut line is set inclined with respect to an axis of the pouch, it is difficult to align the oriented direction of the film with the cut line.

As to the other manner forming the half cut, since irradiation of a laser beam is available to carry out this manner, an initial cost of a laser machine is expensive but a running cost is cheap, and it is easy to form a half-cut line of any direction, thereby providing advances in those points.

However, an opening position extends from a seal portion present at one side of the pouch to the other seal portion present at an opposite side of the pouch, and a middle of the opening position is non seal portion corresponding to a storing space. Therefore, when the half-cut line is formed at such an opening position, a tearing direction is made steady so as to be torn along the half-cut line, but a tear strength at the seal portion becomes larger than that at the non seal portion as the middle portion, thereby requiring a strong force at beginning of tear.

To the contrary, when the half-cut line is made deep by increasing a power of the laser beam, a tear strength at the seal portion is reduced and tearing is made easy, but a tear strength at the non seal portion as the middle portion is also reduced and gets excessively weak. Accordingly, such a pouch is liable to be broken from the half-cut line by some impact, thereby causing a problem in safety.

SUMMARY OF THE INVENTION

This invention has been achieved in order to the above described problems, and a first object of this invention is to provide a pouch, particularly a pouch for refill, in which it is not necessary for production of the pouch to separately form a molded poring parts, and it is possible to produce the pouch at a good productivity as well as a low cost through a process similar to that applicable to an ordinary pouch, and when an end portion of a pouring portion formed at a corner of an upper portion of the pouch is cut out, thus formed opening of the pouring portion easily expands and keeps its configuration, and when a content is poured out, the opening of the pouring portion is prevented from spontaneously closing, and it is possible that the content of the pouch is safely and easily poured into a bottle having even a small opening until pouring is completely finished.

A second object of this invention is to provide a method of producing a film to be converted into the pouch concerned with the first object.

A third object of this invention is to provide an easy open pouch excellent in safety and productivity, in which a half-cut line having an improved shape is formed at a tearing position of the pouch, and it is possible to easily tear the pouch along the half-cut line at the time of an opening operation, and breakage or splitting of the half-cut line is not caused on the ordinary operations in a production process or a distribution stage, and the pouch is applicable to various pouches including a flat pouch such as a three-side sealed type or a four-side sealed type, and it is particularly applicable to a pouch liable to get an actual torn direction off the intended cut line, such as the pouch concerned with the first object because of its bulge portion. The bulge portion will be explained herein after.

A first aspect of a first invention to achieve the first object provides a pouch which is formed of a flexible film and comprising wall portions constituting a front and a rear walls and a pouring portion, wherein both sides of the pouring portion is defined by seal portions so as to form a poring channel, and at least one wall portion is partially protruded to an outward direction of the pouch to be provided with a bulge portion having a hollow structure at vicinity of the pouring portion.

In the pouch as designed above, when an upper end of the pouring portion is torn off, the thus opened pouring portion can spontaneously expand to form large opening, and accordingly the pouch is excellent in a configuration-keeping ability of the opening. When the content of the pouch is poured into another container, the opening of the pouring portion is prevented from spontaneously closing, and even a viscous content can be smoothly pored out from the pouring portion, thus making it possible that the content is safely and easily poured into another container until pouring is completely finished.

In a first preferable embodiment concerned with the first aspect of the first invention, the bulge portion has an out line defined by combination of flat faces, and a cross section defined by combination of straight lines when the bulge portion is cut out in parallel with its protrusive direction.

In the present invention, a flat face for the bulge portion means as a face which does not contain a curved line extending in a vertical direction. Therefore, when the bulge portion is defined flat face, a cross section obtained when the bulge portion is cut out in parallel with a protrusive direction of the bulge portion has a shape defined by straight lines, but the other cross section obtained when the bulge portion is cut out in parallel with a horizontal direction of the bulge portion may have a shape containing a curved line or a round part.

In the pouch as designed above, since a linear corner portion is formed at a boundary between the two flat faces, the bulge portion can be improved in resistance to a pushing load and restoration from collapse because of a rib effect of that linear corner portion, thereby more improving the configuration-keeping ability.

In a second preferable embodiment concerned with the first aspect of the first invention, the pouch is a self-standing pouch, and the bulge portion is extending on the wall portion so as to develop an upper part of the bulge portion in an obliquely downward direction from vicinity of the poring portion to a center line with respect to a width direction of the pouch, curve a middle part of the bulge portion to a further downward direction, and develop a lower part of the bulge portion in a vertically downward direction, and width and height of the bulge portion are set so as to have a predetermined size at vicinity of the pouring portion, gradually reduce along the obliquely downward direction, and keep constant from the curved middle part of the bulge portion to a further lower position.

In a third preferable embodiment concerned with the first aspect of the first invention, the pouch is a self-standing pouch, and the pouring portion is disposed at an upper corner of the pouch so as to extend in an obliquely upward direction, and the bulge portion is extending on the wall portion so as to develop in a curved form from vicinity of the pouring portion toward a diagonally lower corner of the pouch, and width of the bulge portion are set so as to have a predetermined size at vicinity of the pouring portion, gradually reduce along the obliquely downward direction, and form a linear rib at a lower part.

In a fourth preferable embodiment concerned with the first aspect of the first invention, the pouch is a self-standing pouch, and the pouring portion is disposed at an upper corner of the pouch so as to extend in an obliquely upward direction, and the bulge portion is extending on the wall portion so as to develop in a curved form from vicinity of the pouring portion toward a diagonally lower corner of the pouch, and width and height of the bulge portion are set so as to have a predetermined size at vicinity of the pouring portion, gradually reduce along the obliquely downward direction, and keep almost constant at a lower part.

In a fifth preferable embodiment concerned with the first aspect of the first invention, the pouch is a self-standing pouch, and the pouring portion is disposed at an upper corner of the pouch so as to extend in an obliquely upward direction, and the bulge portion is extending on the wall portion so as to develop in an obliquely downward direction from vicinity of the pouring portion to vicinity of a center of the pouch or develop in a V-turned form from vicinity of the pouring portion to vicinity of an opposite upper corner of the pouch via vicinity of the center of the pouch, and width and height of the bulge portion are set so as to have a predetermined size at vicinity of the pouring portion, and become small at a further tailing part.

In the pouch according to the second to the fifth preferable embodiments concerned with the first aspect of the first invention, the pouch can be bent to an outward direction of the pouch along the lengthened bulge portion by volume and weight of the content, thereby outward expanding an area lower than the pouring portion as well as the opening and the pouring channel. Accordingly, the content of the pouch can be smoothly flowed to the pouring portion and smoothly poured out from the pouring portion.

Besides, when the bulge portion takes such a V-turned form as in the fifth preferable embodiment, the V-shaped bulge portion is coincide with a bent line which is formed at an upper area of the wall portion by filing, degassing and sealing up the pouch. Accordingly, the V-shaped bulge portion can steady configuration of the pouch and improve an appearance of the pouch. The V-shaped bulge portion is also excellent in a visual balance. Further, when the pouch having the V-shaped bulge portion is opened, the pouch can be bent to an outward direction of the pouch along the V-shaped bulge portion by volume and weight of the content, thereby outward expanding a center area of the pouch as well as the opening and the pouring channel.

Accordingly, the content of the pouch can be smoothly flowed to the pouring portion and smoothly poured out from the pouring portion.

A second aspect of the first invention to achieve the first object provides a pouch which is formed of a flexible film and comprises wall portions constituting a front and a rear walls and a pouring portion, wherein both sides of the pouring portion are defined by seal portions so as to form a neck portion, a shoulder portion starting from a lower end of the neck portion, and a poring channel passing through the neck and the shoulder portions, and the pouring portion is provided with a cut line indicating a course for opening of the pouring portion, the cut line passing over a vertex of a vertical angle of an assumed right triangle or a position closer to a center of the pouch than the vertex when the assumed right triangle is drawn by taking a straight line defined by two connection points connecting an inside line of the seal portion of the neck portion and that of the shoulder portion as its base, facing its vertical angle toward an upper end of the pouring portion, and setting its vertex of the vertical angle on an axis of the pouring channel.

When the pouring portion of the pouch is torn off, and the content is poured out from the narrow pouring portion, bent lines (wrinkles) extending toward the upper end of the pouring portion are liable to be formed at both sides of the pouring portion owing to an internal pressure of the content. This bent lines cross over each other to choke an upper part of the pouring portion. In contrast, since the pouch of the second aspect of the first invention provided with a cut line properly positioned, when this pouch is opened, an upper part to cause the choking can be torn off the pouring portion, thus making it possible that the content is safely and easily poured out until pouring is completely finished.

A third aspect of the first invention to achieve the first object provides a pouch which is formed of a flexible film and comprises wall portions constituting a front and a rear walls and a pouring portion, wherein both sides of the pouring portion are defined by seal portions and cut off portions so as to form a neck portion, a shoulder portion starting from a lower end of the neck portion, and a poring channel passing through the neck portion, and the pouring portion is provided with a cut line indicating a course for opening of the pouring portion, and both transit portions transiting from an inside line of the seal portion of the neck portion to that of the shoulder portion are curved, the cut line passing over one point on a trace drawn by a vertex of a vertical angle of an assumed right triangle or a position closer to a center of the pouch than at least one point on the trace when the trace is drawn by taking the assumed right triangle having the base longer than a width of the pouring channel, inserting the vertical angle into the pouring channel from lower side thereof, sliding the assumed right triangle with both sides defining the vertical angle being kept in contact with the both inside lines of the seal portions of the pouring portion.

In the pouch according to the third aspect of the first invention, since the both transit portions transiting from the inside line of the seal portion of the neck portion to that of the shoulder portion, i.e., a base of the pouring channel, are shaped into curved lines, an edge of the pouring channel is very smooth. Accordingly, even if an internal pressure of the content is loaded on this transit portion, it does not cause rupture or stripping of the seal portion, thus preventing breakage of the pouch.

Further, since a position of the cut line is set in the above described manner, a cross point of the bent lines (wrinkles) extending from the base of the pouring portion toward the upper end of the pouring portion is formed on the cut line or at a position upper than the cut line . Accordingly, when the upper portion of the pouring portion is cut out along the cut line, a position upper than the cross point where choking of the pouring portion occurs can be cut off. As the result, the opening can spontaneously expand with an excellent configuration-keeping ability, and the opening can be prevented from spontaneously closing during the pouring action.

In one preferable embodiment concerned with the third aspect of the first invention, the both inside lines of the seal portions defining the neck portion are shaped into upward protrusive arcs respectively so as to taper the pouring channel of the neck portion off to an upper end of the pouring channel.

Such a design is very suitable to a construction of the pouring portion for a liquid content. When angle or direction of the cut line comes near vertical with respect to a widthwise direction of the pouch, an upper side of the neck portion can be made long, thereby facilitating that a pouring direction is controlled downward. On the other hand, when angle or direction of the cut line comes near horizontal, a lower side of the neck portion can be made long, and accordingly the pouring portion can be shaped into a long gutter-like form.

A second invention to achieve the second object provides a method of producing a film for pouch, which comprises steps of: preheating a resin film; subjecting the thus preheated resin film to press molding with the use of a die comprising a cavity piece and a core piece and having a portion corresponding to a shape of a bulge portion to be provided for the resin film; and, cooling the thus press-molded resin film while it is held in the die.

According to this method, sink of molding can be reduced, and even when the bulge portion is formed to such a lamination film as not suitable for being molded, it is possible to form the bulge portion having a shape which is very similar to a desired shape and excellent in its configuration-keeping ability at a good productivity.

A third invention to achieve the third object provides a pouch which is formed of a flexible film and comprising wall portions constituting a front and a rear walls, wherein a half-cut line as an opening aid is provided to a position to be opened of the pouch, the half-cut line being formed so as to have a combination of a deep part and a shallow part and/or a combination of a wide part and a narrow part.

In one preferable embodiment of the third invention, both sides of the pouch are defined by seal portions, and the half-cut line is extending on the wall portion so as to start from the seal portion of one side, traverse a non seal portion as a middle portion and reach the other seal portion of the opposite side, and depth and/or width of the half-cut line is made deep and/or wide at the seal portion from which opening is to be started in comparison with those made at the non seal portion.

When the pouch of the third invention is opened, an opening position of the pouch can be easily and exactly torn along the half-cut line. In addition, the pouch of the third invention is prevented from being ruptured, thus being excellent in safety of storage.

DETAILED DESCRIPTION OF THE PREFERRED EMBODIMENTS

The present invention will be explained in detail with reference to figures. It should be noted that the present invention is not restricted by any figure. The same numerals and symbols are used for corresponding portions across the all figures.

Figure 1:
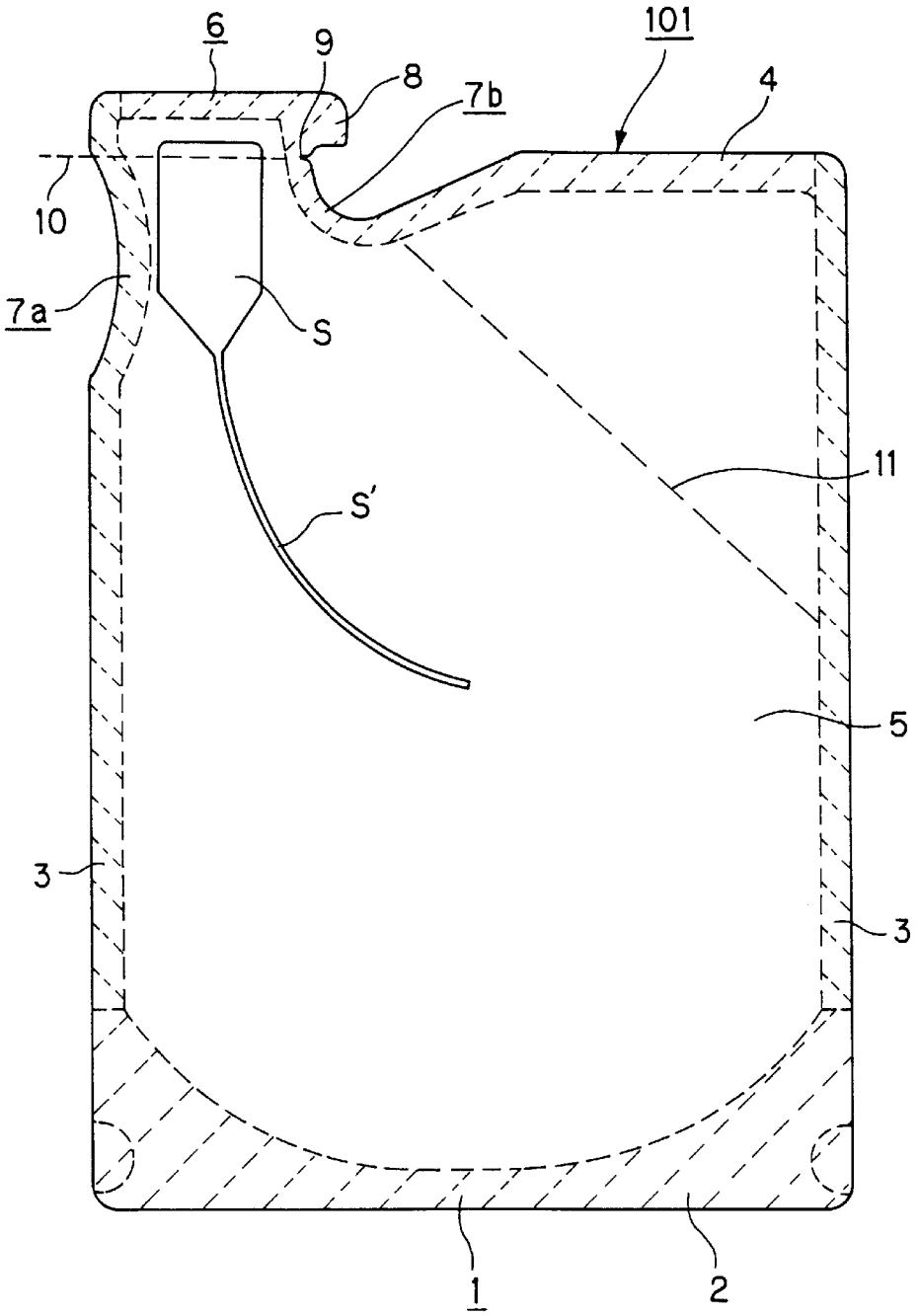
FIG. 1 is a plan view showing a pouch(101), which is one embodiment concerned with the first aspect of the first invention.

FIG. 1 is a plan view showing a pouch(101) for refill, which is one embodiment concerned with the first aspect of the first invention. A trunk portion of the pouch 101 is formed into a self-standing pouch. A bottom portion 1 is formed in the ordinary manner, in which a film for the bottom portion is folded and positioned between two flat films so as to make gusset form protruding toward the inside of the pouch, and semicircular cut off portions are formed at vicinity of lower end on both sides of the film for the bottom portion, and the film for the bottom portion is heat sealed in a boat-like shape to form a bottom heat seal portion 2. The two flat films forming a front and a rear walls are in directly contact with each other at the semicircular cut off portion and bonded together at those positions by heat sealing. The trunk portion of the pouch 101 is formed by heat sealing two films constituting two flat portions 5, i.e., a front and a rear walls, at both side ends to form trunk heat seal portions 3.

A pouring portion 6 is formed at an upper corner of the pouch 101. The pouring portion 6 are defined by upper trimmings including cut off portions 7*a*, 7*b* present at both sides and an upper heat seal portion 4, and extends upward and a little protrudes. Both sides of the pouring portion are heat sealed so as to form a narrow pouring channel passing through the pouring portion. Width of the pouring portion is partially narrowed at a middle height by the cut off portions 7*a*, 7*b*. A V-shaped notch 9 and a pinch piece (pinch portion) 8 adjacent thereto are formed at an upper portion on one side of the pouring portion.

Both the front and the rear wall portions 5 of the pouch 101 are provided with bulge portions S and linear ribs S' in order to make a pouring channel of the pouring portion spontaneously expand. The bulge portion S and the linear rib S' are formed in a hollow structure by partially protruding the wall portion 5 to an outward direction of the pouch. The bulge portion S integrates with the linear rib S', and they extends from vicinity of the pouring portion to vicinity of a center of the pouch.

The bulge portion S is formed at vicinity of the pouring portion 6. When the pouring portion 6 is disposed at one upper corner as in the pouch 101, the bulge portion may be formed at a position which is closer to the pouring portion than both center lines with respect to the width direction and the length direction. A head part of the bulge portion is usually positioned in the pouring channel, and it is preferable to make the head part of the bulge portion closer to an upper end of the pouring portion so as to extend the cut line 10 across the bulge portion S. The linear rib S' of the pouch 101 starts from the lower end of the bulge portion S, and it forms a downward protrusive curve. However, the linear rib may starts from any position as far as it connects with the bulge portion, and it may also go along any course. In the pouch 101, the bulge portion S and the linear rib S' are formed at the same position of each wall portion 5 with a symmetrical relationship so as to superpose the bulge portion and the linear rib of one wall onto those of the other wall.

The bulge portion S of the pouch 101 has a shape in which the upper part thereof is square in parallel with a peripheral of the pouch and the lower part thereof is downward tapered. The linear rib S' is connected with a lower tip of the bulge portion S, and its downward protrusive curve is fitted to a U-shape bend (wrinkles) which is formed at the upper area of the pouch 101 by a content when the pouch 101 is filled with the content, degassed and sealed at a position of the upper-heat seal portion 4.

When the pouch 101 for refill as designed above is filled with the content, degassed and sealed at a position of the upper heat seal portion 4, the pouch 101 has a self-standing ability, easiness of handling and good appearance. When the content of the pouch 101 is poured into another container, particularly a refill container, the end portion of the pouring portion 6 can be easily torn from the notch 9 along the cut line 10 by pinching and laterally pulling the pinch portion 8 with fingers, thus opening the pouring portion 6.

Since both the wall portions 5 of the pouch 101 are partially formed into the bulge portion S and the linear rib S' in which the linear rib S' connects with the lower tip of the bulge portion and forms a downward protrusive curve, and each set of the bulge portion S and the linear rib S' extends on the wall portion from vicinity of the pouring portion 6 to vicinity of the center of the pouch 101, if the opened pouch 101 is stood somewhere, preferably on a plane face, the opening and the pouring channel of the opened pouch 101 can be made to spontaneously expand with its configuration well kept by the bulge portion S. In addition, since the linear rib S' connecting with the lower tip of the bulge portion S is shaped into a downward protrusive curve, the pouch 101 can be bent to an outward direction of the pouch along that curve by volume and weight of the content, thereby outward expanding an area lower than the pouring portion as well as the opening and the pouring channel. Accordingly, the content of the pouch 101 can be smoothly flowed to the pouring portion 6 and smoothly poured out from the pouring portion 6.

When the content of the pouch 101 is poured into another container, such as bottle, an upper corner portion opposite to the pouring portion 6 may be diagonally bent along a bent line 11 so as to turn the bent corner toward the center of the pouch, and such an operation may be followed by supporting the bent portion by hand, putting the cut off portion 7*b* at an edge of an opening of the container, and gradually slanting the pouch 101 to pour the content. According to this manner, since the bent portion at the bend line 11 serves as the support to further improve the configuration-keeping ability of the opening of the pouring portion, the pouring channel and the area lower than the pouring portion, even if a viscous content is stored in the pouch, the content can be smoothly flowed to the pouring portion and the opening of the pouring portion is prevented from spontaneously closing, thus making it possible that the content is safely and easily poured into another container until pouring is completely finished.

Besides, FIG. 1 shows the cut off portion 7*a* which is disposed one side opposite to the cut off portion 7*b* of the pouring portion 6. The cut off portion 7*a* is incidentally formed, and it may be used for pouring out as well as the other cut off portion 7*b*. When the cut off portion 7*a*is put at the opening of another container, steadiness of the pouring portion to the opening of another container is also improved, thereby improving easiness of pouring.

Figure 2:
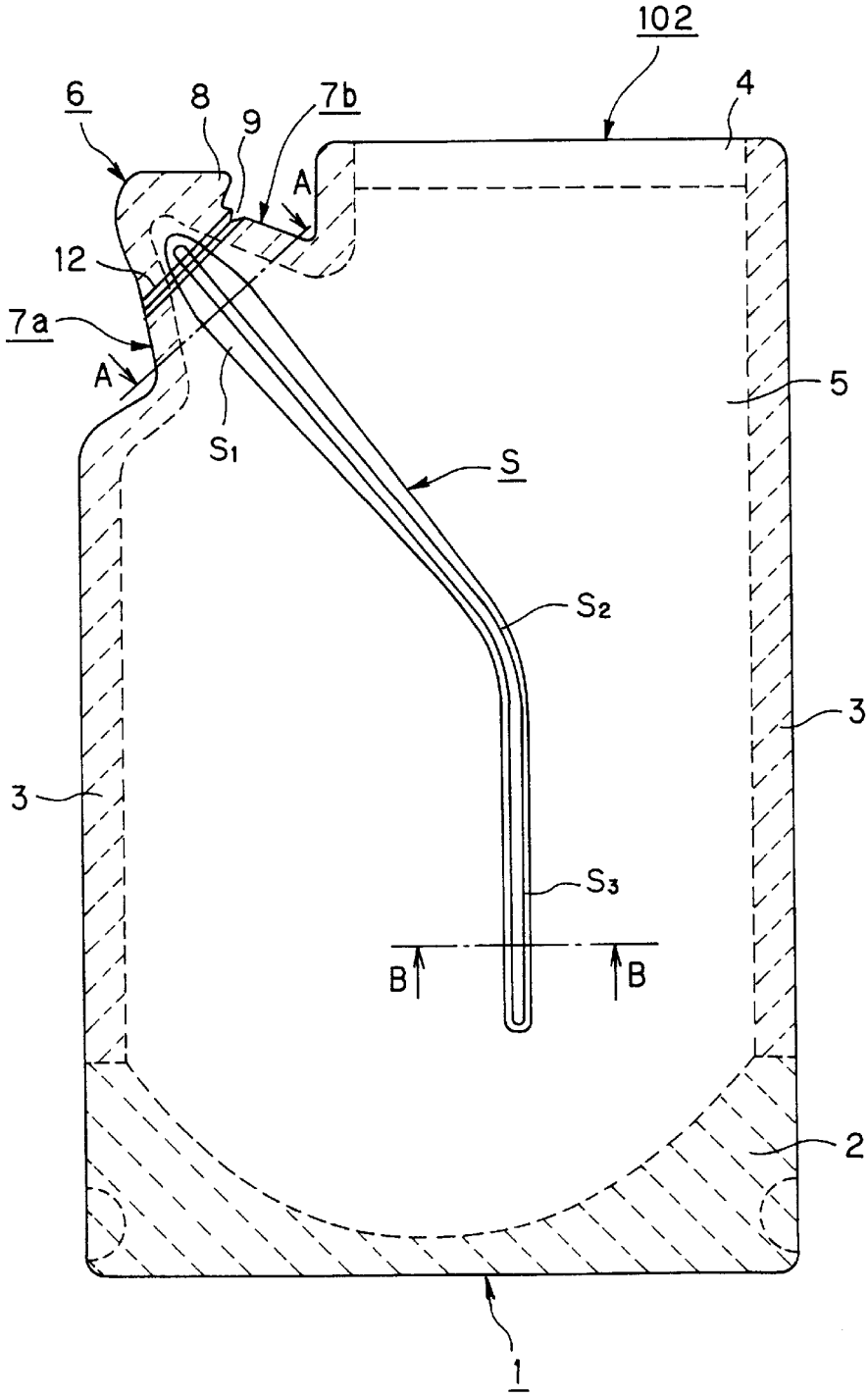
FIG. 2 is a plan view showing a pouch(102), which is a first preferable embodiment concerned with the first aspect of the first invention.
Figure 3A:
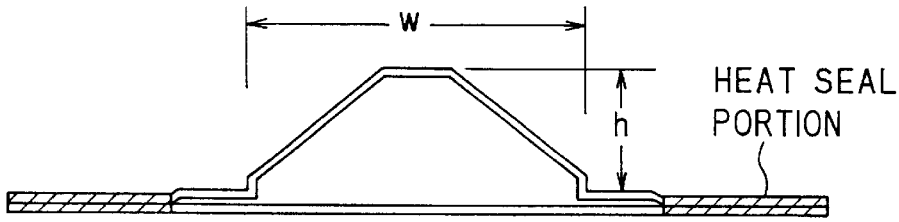
FIG. 3 includes 3A, 3B, 3C and 3D, and each of them is an enlarged sectional view showing one example of a cross section of the bulge portion of the pouch 102 in FIG. 2.
Figure 3B:
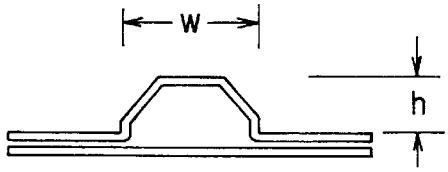
Figure 3C:
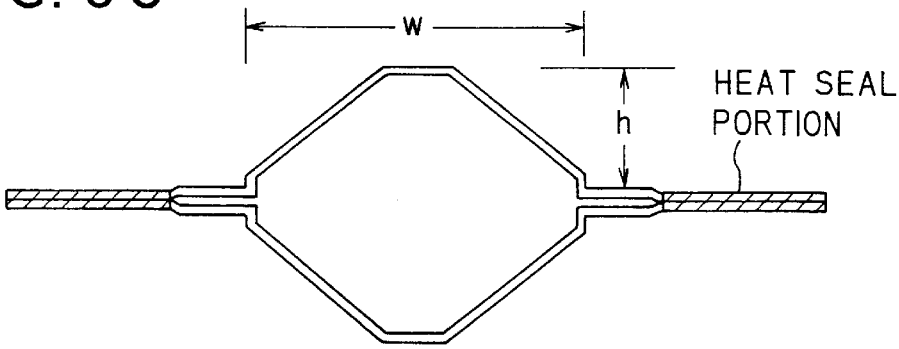
Figure 3D:
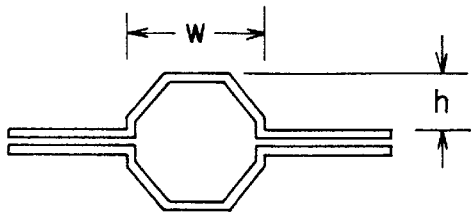
Figure 4A:
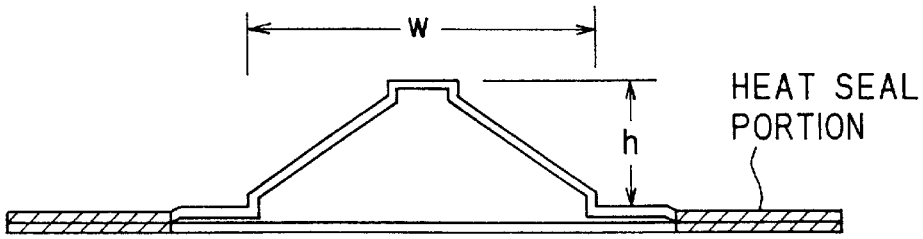
FIG. 4 includes 4A, 4B, 4C and 4D, and each of them is an enlarged sectional view showing another example of a cross section of the bulge portion of the pouch 102 in FIG. 2.
Figure 4B:
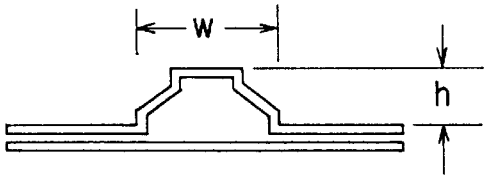
Figure 4C:
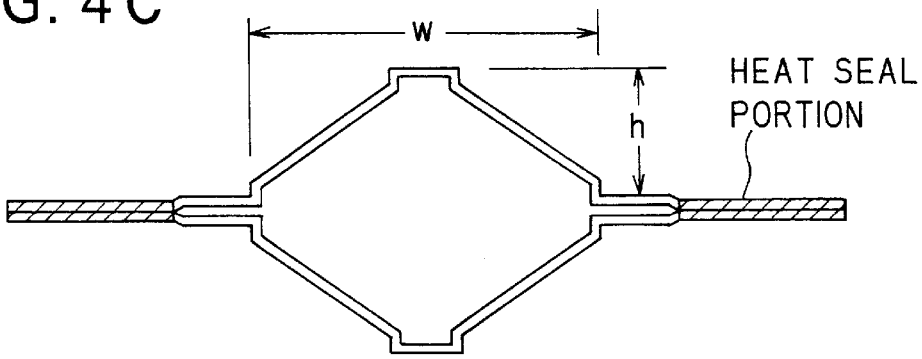
Figure 4D:
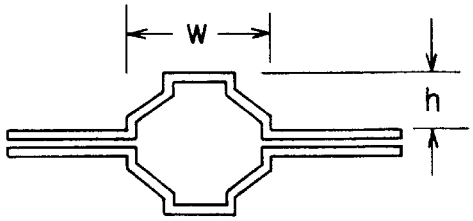

FIG. 2 is a plan view showing a pouch(102) for refill, which is a first preferable embodiment concerned with the first aspect of the first invention. FIG. 3 includes 3A, 3B, 3C and 3D, and each of them is an enlarged sectional view showing one example of a cross section obtainable by cutting out the bulge portion of the pouch 102 in FIG. 2 in parallel with its widthwise direction. More specifically, FIG. 3A is an enlarged sectional view of an A—A section obtainable in a case where the bulge portion is disposed only on the front wall portion, and FIG. 3B is an enlarged sectional view of an B-B section obtainable in the same case. FIG. 3C is an enlarged sectional view of an A—A section obtainable in a case where the bulge portion is disposed on both the wall portion, and FIG. 3D is an enlarged sectional view of an B—B section obtainable in the same case.

Besides, FIG. 4 includes 4A, 4B, 4C and 4D, and each of them is an enlarged sectional view showing another example of a cross section obtainable by cutting out the bulge portion of the pouch 102 in FIG. 2 in parallel with its widthwise direction. More specifically, FIG. 4A is an enlarged sectional view of an A—A section obtainable in a case where the bulge portion is disposed only on the front wall portion, and FIG. 4B is an enlarged sectional view of an B—B section obtainable in the same case. FIG. 4C is an enlarged sectional view of an A—A section obtainable in a case where the bulge portion is disposed on both the wall portion, and FIG. 4D is an enlarged sectional view of an B—B section obtainable in the same case.

A trunk portion of the pouch 102 is formed into a self-standing pouch. A bottom portion 1 is formed in the ordinary manner, in which a film for the bottom portion is folded and positioned between two flat films so as to make gusset form protruding toward the inside of the pouch, and semicircular cut off portions are formed at vicinity of lower end on both sides of the film for the bottom portion, and the film for the bottom portion is heat sealed in a boat-like shape to form a bottom heat seal portion 2. The two flat films forming a front and a rear walls are in directly contact with each other at the semicircular cut off portion and bonded together at those positions by heat sealing. The trunk portion of the pouch 102 is formed by heat sealing two films constituting two flat portions 5, i.e., a front and a rear walls, at both side ends to form trunk heat seal portions 3.

A pouring portion 6 is formed at an upper corner of the pouch 102. Both sides of the pouring portion 6 is defined by heat seal portion to form a narrow pouring channel passing through the pouring portion 6, and further cut off to form cut off portions 7*a*, 7*b* and shape the pouring portion 6 into a protruding neck-like form.

A V-shaped notch 9 as an opening aid and a pinch portion 8 adjacent thereto are formed at an upper portion on one side of the pouring portion 6 by trimming of the cut off portion 7*b*. The notch 9 and the pinch portion 8 may be formed at an opposite side having the cut off portion 7*a* or both sides of the pouring portion 6. A cut line starts from a position of the notch 9 and indicates an intended tear direction. At least one half cut line 12 may be formed at a position of the cut line by, for example, irradiation of the laser beam to facilitate tearing and steady a direction of tearing. The half-cut line 12 stops at an intermediate depth of the resin film. The pouch 102 of FIG. 2 has three half-cut lines. It is preferable to form the half-cut line 12 along the cut line.

In order to sufficiently expand the opening of the pouring portion, it is preferable that the bulge portion S is made to extend in an obliquely downward direction from vicinity of the pouring portion to at least vicinity of a center of the pouch. A tail of the bulge portion may be further extended from the center of the pouch in order to improve an expanding ability. The tail of the bulge portion is usually extended in a right or obliquely downward direction, but a direction thereof may be set in consideration of design of the pouch.

In the pouch 102 of FIG. 2, the bulge portion S extends on the wall portion 5. An upper part(S1) of the bulge portion develops in an obliquely downward direction from vicinity of the poring portion 6 to a center line with respect to a width direction of the pouch. Subsequently to the upper part (S1), a middle part(S2) of the bulge portion curves to a further downward direction. Thereafter, a lower part(S3) of the bulge portion develops in a vertically downward direction. Width and height of the bulge portion are set so as to be large at vicinity of the pouring portion 6, gradually reduce along the obliquely downward direction, and keep constant from the curved middle part (S2) to an end of the lower part (S3).

The bulge portion S may be formed to only one wall portion 5 selected among the front and the rear walls, or both the wall portions 5 so as to provide a symmetrical relationship between the two bulge portions.

It is preferable that the bulge portion S is excellent in resistance to a pushing load or restoration from collapse. Such properties may be provided to the bulge portion S by shaping a cross section obtained when the bulge portion S is cut out in parallel with its widthwise direction into, for example, those as shown in FIG. 3 or FIG. 4.

That is, as described hereinbefore, FIG. 3A is an enlarged sectional view of an A—A section obtainable in a case where the bulge portion S is disposed only on the front wall portion of pouch 102. The bulge portion of FIG. 3A has a configuration in which a top portion is a horizontal face of about 2.0 mm width, each side of the horizontal face connects with a declining face declining like a shoulder, and each low end of the declining face connects with a vertically standing face.

When the bulge portion S takes the above described configuration, an out line of the bulge portion can be defined by combination of flat faces, and the cross section obtained when the bulge portion is cut out in parallel with its protrusive direction can be defined by combination of straight lines. In such a configuration, a linear corner portion is formed at a boundary between the two flat faces, and thus the bulge portion can be improved in resistance to a pushing load and restoration from collapse because of a rib effect of that linear corner portion.

FIG. 3B is an enlarged sectional view of an B—B section obtainable in a case where the bulge portion S is disposed only on the front wall portion of pouch 102. The bulge portion of FIG. 3A has a configuration in which a top portion is a horizontal face of about 2.0 mm width, each side of the horizontal face connects with a declining face declining like a shoulder, and each low end of the declining face connects with a vertically standing face. Width(w) and height(h) of the B—B section are smaller than those of the A—A section. It is preferable to set width of the top face of the B—B section similarly to a position of A—A section, i.e., about 2.0 mm. It also is preferable to set an over all width(w), i.e., distance between the two vertically standing face, of the B—B section to about from 3.0 to 4.0 mm.

Height(h) of the bulge portion S is, for example, in a range of 2.0 to 5.0 mm at the A—A section of FIG. 3A, and in a range of 1.8 to 1.0 mm at the B—B section of FIG. 3B.

If the bulge portion shown in FIGS. 3A and 3B is formed to both the wall portions with a symmetrical configuration, an A—A section becomes as shown in FIG. 3C, and a B—B section becomes as shown in FIG. 3D.

The bulge portion S may be formed so as to shape a widthwise cross section into those as in FIGS. 4A, 4B, 4C and 4D. In the bulge portion S of FIG. 4, a vertically standing face is connected with not only the lower end of each the inclining face but also each of the side ends of a horizontal top face. In such a configuration, number of the flat faces defining the bulge portion is increased and number of the linear corners at boundaries of the flat surfaces is also increased. Therefore, rib effect of the linear corner can be strengthened to further improve in resistance to a pushing load and restoration from collapse.

Besides, an upper heat seal portion 4 of the pouch 102 is a non sealed opening before filling of the pouch, and it is sealed up by heat sealing after the pouch is filled with the content. The pouches shown in another FIGS. may be operated in the similar manner.

When the pouch 102 for refill as designed above is filled with the content, degassed and sealed at a position of the upper heat seal portion 4, the pouch 102 has a self-standing ability, easiness of handling and good appearance. When the content of the pouch 102 is poured into another container, particularly a refill container, the end part of the pouring portion 6 can be easily torn from the notch 9 along the half-cut line 12 by pinching the pinch portion 8 with fingers and pulling it in parallel with the half-cut line 12, thus opening the pouring portion 6.

Since both the wall portions 5 of the pouch 102 are partially formed into the bulge portion S(S1, S2, S3) in which the bulge portion S extends on the wall portion from vicinity of the pouring portion 6, via vicinity of the center of the pouch 102, and to the lower area of the pouch, if the opened pouch 102 is stood somewhere, preferably on a plane face, the opening and the pouring channel of the opened pouch 102 can be made to spontaneously expand with its configuration well kept by the upper part (S1) of the bulge portion. In addition, the pouch 102 can be bent to an outward direction of the pouch along the lengthened bulge portion S(S1, S2, S3) by volume and weight of the content, thereby outward expanding an area lower than the pouring portion as well as the opening and the pouring channel. Accordingly, the content of the pouch 102 can be smoothly flowed to the pouring portion 6 and smoothly poured out from the pouring portion 6.

Further, the lower part (S3) of the bulge portion provides rib effect because it takes vertical position, thereby improving in a self-standing ability and a configuration-keeping ability of the pouch.

The content of the pouch 102 can be poured into another container, such as bottle, in such manner that the trunk portion of the pouch 102 is supported by hand, the cut off portion 7*a* or 7*b* is put to an edge of the opening of the container, and then the opened pouring portion 6 is put into the opening of the container. According to this manner, steadiness of the pouring portion to the opening of another container is improved, and even if a viscous content is stored in the pouch, the content can be smoothly flowed to the pouring portion and the opening of the pouring portion is prevented from spontaneously closing, thus making it possible that the content is safely and easily poured into another container until pouring is completely finished.

Figure 5:
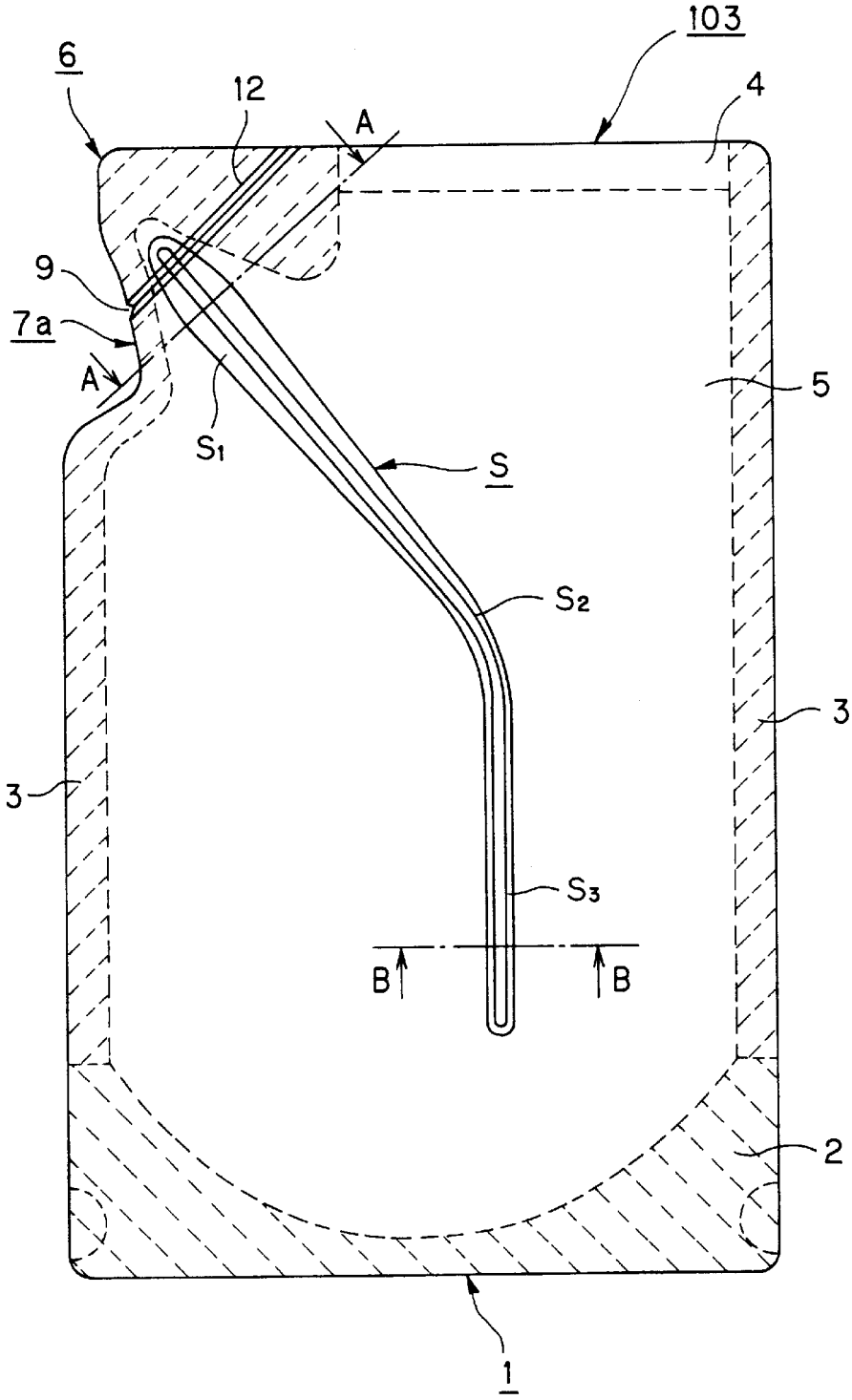
FIG. 5 is a plan view showing a pouch(103), which is the other example of the first preferable embodiment concerned with the first aspect of the first invention.

FIG. 5 is a plan view showing a pouch(103) for refill, which is the other example of the first preferable embodiment concerned with the first aspect of the first invention.

The pouch 103 of FIG. 5 is the same as the pouch 102 already shown in FIG. 2 except that only one cut off portion 7*a* is formed at the one side of the pouring portion 6 along a side line of the pouch, and the notch 9 is formed at a start point of one half-cut line 12 positioned on an edge of the cut off portion 7*a*. In the pouch 103, the pinch portion which is not shown in FIG. 5 may be formed at an upper side of the notch 9.

When the content of the pouch 103 is poured into another container, it is difficult to put an upper end of the pouring portion 6 into the opening of the container, but it is possible to carry out a pouring operation with the cut off portion 7*a* being put to an edge of the opening of the container, thus making it possible, as well as the pouch 102 of FIG. 2, that the content is safely and easily poured into another container until pouring is completely finished.

Figure 6:
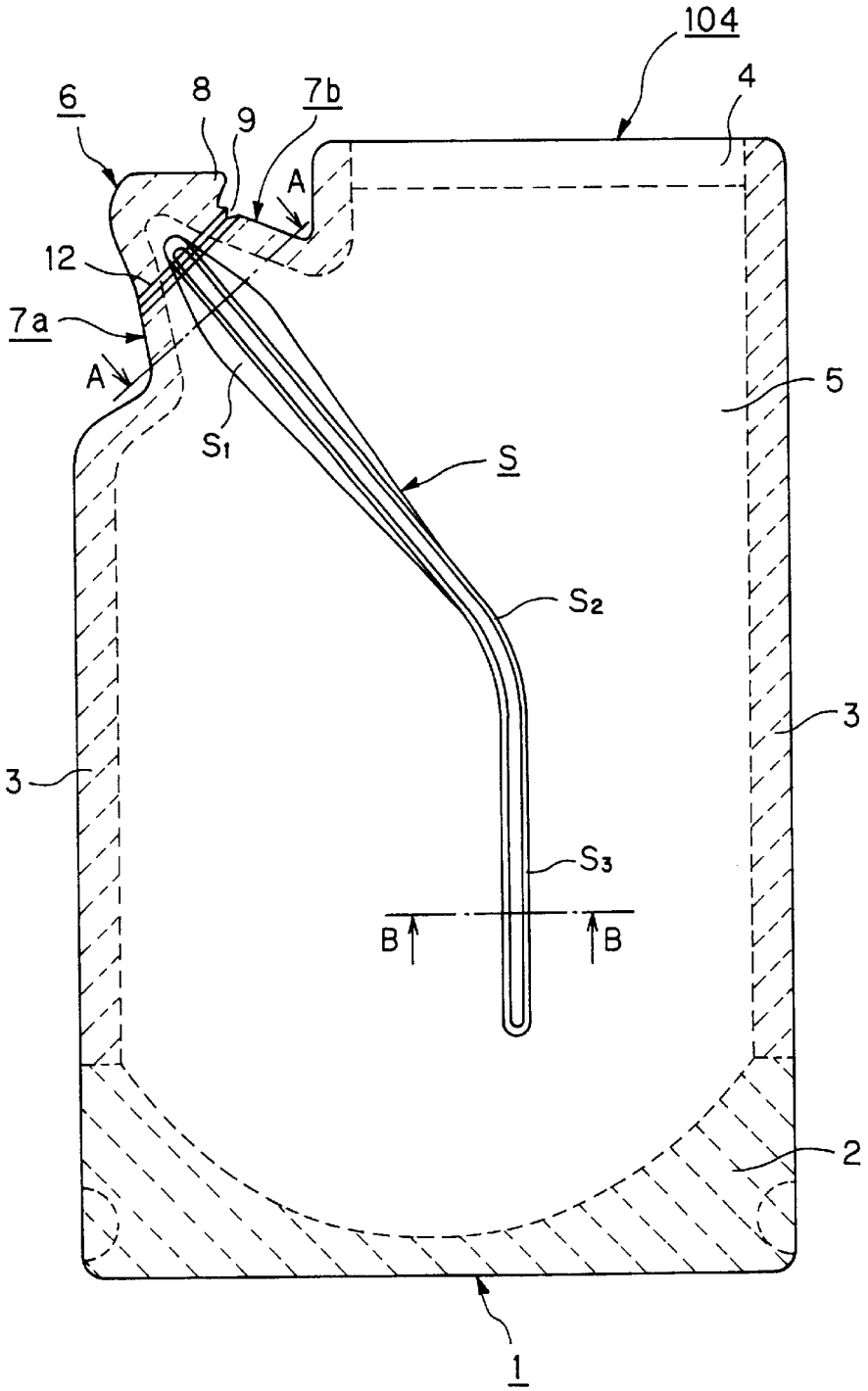
FIG. 6 is a plan view showing a pouch(104), which is the second preferable embodiment concerned with the first aspect of the first invention.

FIG. 6 is a plan view showing a pouch(104) for refill, which is the second preferable embodiment concerned with the first aspect of the first invention.

FIG. 7 includes 7A, 7B, 7C and 7D, and each of them is an enlarged sectional view showing one example of a cross section obtainable by cutting out the bulge portion of the pouch 104 in FIG. 6 in parallel with its widthwise direction. More specifically, FIG. 7A is an enlarged sectional view of an A—A section obtainable in a case where the bulge portion is disposed only on the front wall portion, and FIG. 7B is an enlarged sectional view of an B—B section obtainable in the same case. FIG. 7C is an enlarged sectional view of an A—A section obtainable in a case where the bulge portions are disposed on both the wall portions so as to make a symmetrical relationship, and FIG. 7D is an enlarged sectional view of an B—B section obtainable in the same case.

Figure 7A:
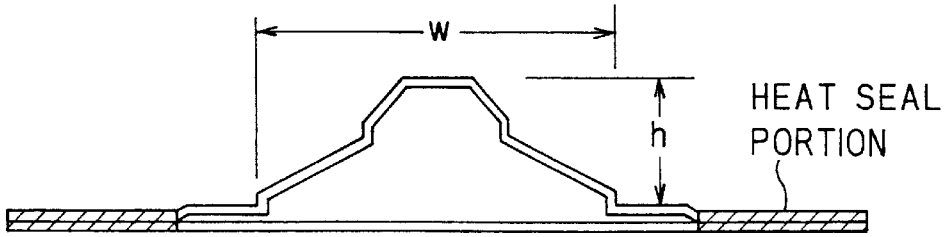
FIG. 7 includes 7A, 7B, 7C and 7D, and each are enlarged sectional views showing an example of a cross section of the bulge portion of the pouch 104 in FIG.6.
Figure 7B:
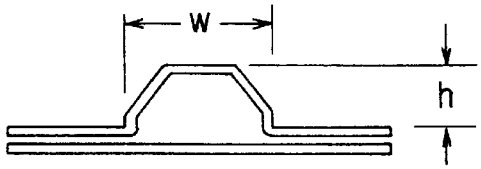
Figure 7C:
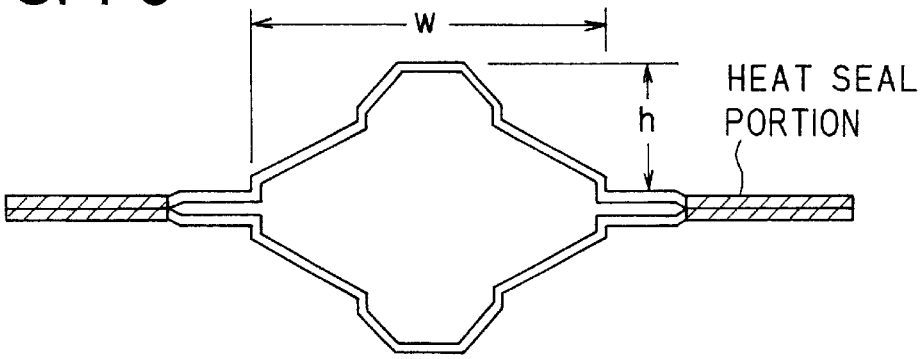
Figure 7D:
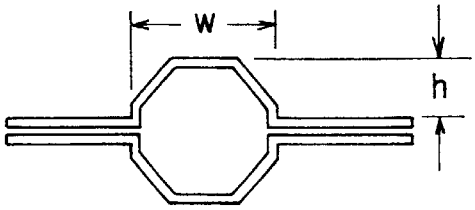

The pouch 104 of FIG. 6 is the same as the pouch 102 already shown in FIG. 2 except that an area from the part S1 to S2, where width and height of the bulge portion S is gradually reduced, forms steps having plural slanting faces per each side of the bulge portion, as exemplified by the enlarged sectional view of the A—A section in FIG. 7A.

That is, the bulge portion shown in FIG. 7A has a configuration in which a top portion is a horizontal face, each side of the horizontal face connects with a first declining face declining like a shoulder, each low end of the first declining face connects with a first vertically standing face, each low end of the first vertically standing face connects with a second declining face also declining like a shoulder, and each low end of the second declining face connects with-a second vertically standing face.

In such a configuration, since the area from the upper part S1 to the middle part S2 of the bulge portion S, which is relatively liable to be collapsed because of its relatively large width and height, is defined a large number of flat faces, rib effect is more improved, thereby improving the area from S1 to S2 of the bulge portion in strength, resistance to pushing load and restoration from the pushing load. Accordingly, the pouch 104 is more improved in a spontaneously expanding of the opening, a configuration-keeping ability of the pouring portion and a configuration-keeping ability of the pouch itself. Thus, the content of the pouch 104 can be more smoothly flowed to the pouring portion 6 and more smoothly poured out from the pouring portion 6.

FIG. 8–FIG. 13 are views to explain a third preferable embodiment concerned with the first aspect of the first invention. In the each figure, "A" is a plan view showing a pouch, and "B" is an enlarged sectional view of A—A cross section.

Figure 8A:
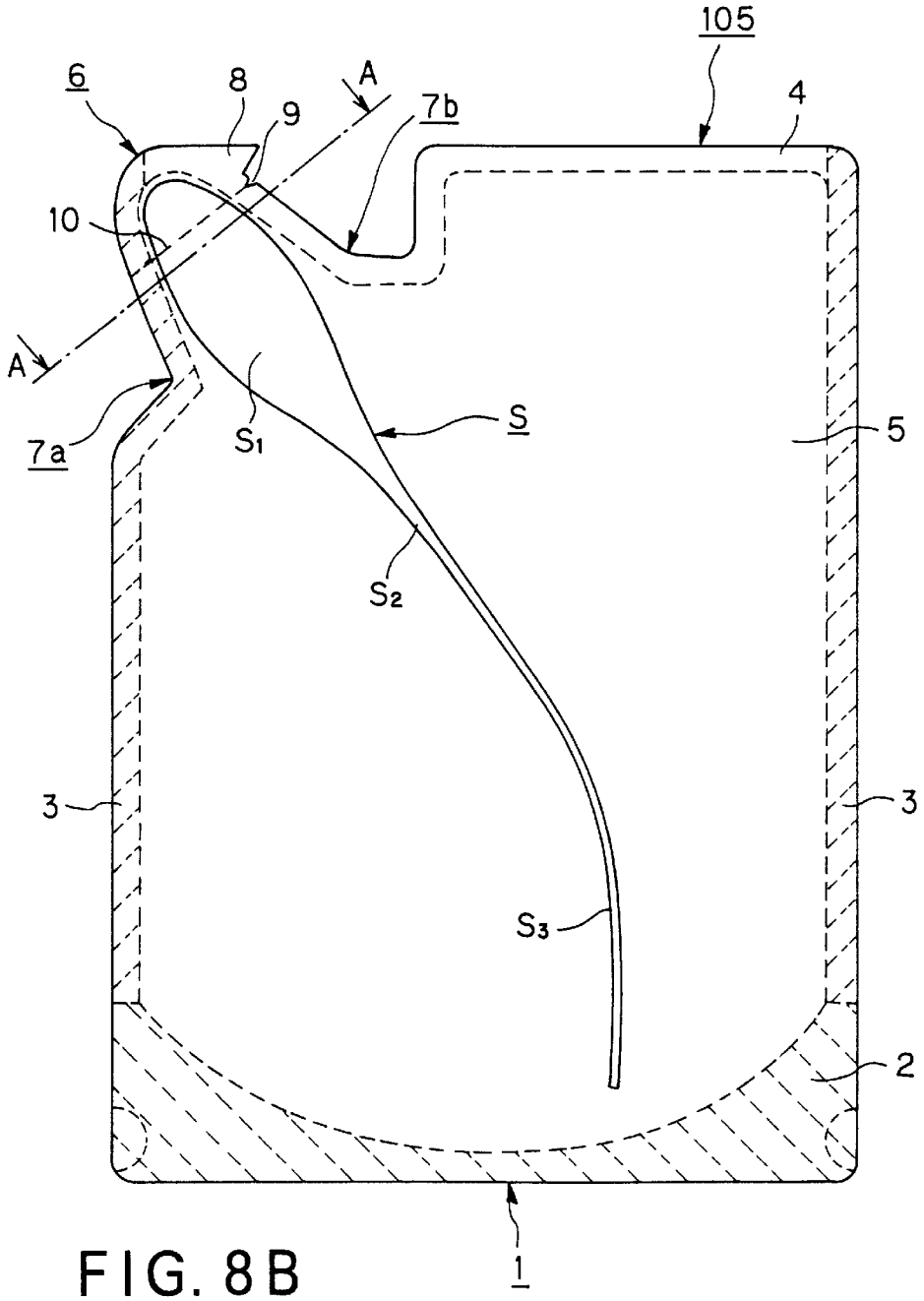
FIGS. 8A, 8B, 9A, 9B, 10A, 10B, 11A, 11B, 12A, 12B, 13A and 13B are views to explain a third preferable embodiment concerned with the first aspect of the first invention. In the each figure, "A" is a plan view, and "B" is an enlarged sectional view of A—A cross section.

FIG. 8A is a plan view showing a pouch(105) for refill. A trunk portion of the pouch 105 is formed into a self-standing pouch. A pouring portion 6 is formed at an upper corner of the pouch 105 so as to a little protrude in an obliquely upward direction. A peripheral portion of the pouring portion 6 is defined by heat sealing. One end of the heat sealed peripheral portion of the pouring portion connects with the upper end of a trunk heat seal portion 3, and the other end of the same connects with an upper heat seal portion 4. Cut off portions 7*a*, 7*b* are formed at both sides of the pouring portion 6 by trimming.

A V-shaped notch 9 as an opening aid and a pinch portion 8 adjacent thereto are formed at an upper portion on one side of the pouring portion 6 by trimming of the cut off portion 7*b*. The notch 9 and the pinch portion 8 may be formed at an opposite side having the cut off portion 7*a* or both sides of the pouring portion 6. A cut line 10 starts from a position of the notch 9 and indicates an intended tear direction. At least one half cut line may be formed at a position of the cut line by, for example, irradiation of the laser beam to facilitate tearing and steady a direction of tearing.

In the pouch 105 of FIG. 8, the bulge portions S are provided to the front and the rear wall portion so as to be superposed to each other in an symmetrical relationship. The bulge portion extends on the each wall portion so as to develop in a curved form from vicinity of the pouring portion toward a diagonally lower corner of the pouch, and width of the bulge portion are set so as to be large at vicinity (S1) of the pouring portion 6, gradually reduce along the obliquely downward direction (S2), and form a linear rib at a lower part (S3).

Figure 8B:
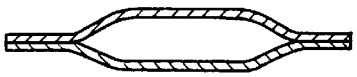

FIG. 8B is an enlarged sectional view showing one example of a cross section obtainable by cutting out the bulge portion of the pouch 105 in FIG. 8A in parallel with its widthwise direction. As shown in FIG. 8B, an opening to be formed at the pouring portion of this example is shaped into an elliptical form.

When the pouch 105 for refill as designed above is filled with the content, degassed and sealed at a position of the upper heat seal portion 4, the pouch 105 has a self-standing ability, an easiness of handling and a good appearance. When the content of the pouch 105 is poured into another container, particularly a refill container, the end portion of the pouring portion 6 can be easily torn from the notch 9 along the cut line 10 by pinching the pinch portion 8 with fingers and pulling it in parallel with the cut line 10, thus opening the pouring portion 6.

Since both the wall portions 5 of the pouch 105 are partially formed into the bulge portion S(S1, S2, S3) in which the two bulge portions are arranged so as to be superposed to each other in an symmetrical relationship, and the each bulge portion S extends on the wall portion in a curved form from vicinity of the pouring portion 6, via vicinity of the center of the pouch 105, toward a diagonally lower corner of the pouch, if the opened pouch 105 is stood somewhere, preferably on a plane face, the opening and the pouring channel of the opened pouch 105 can be made to spontaneously expand with its configuration well kept by the upper part (S1) of the bulge portion. In addition, the pouch 105 can be bent to an outward direction of the pouch along the lengthened bulge portion S(S1, S2, S3) by volume and weight of the content, thereby outward expanding an area lower than the pouring portion as well as the opening and the pouring channel. Accordingly, the content of the pouch 105 can be smoothly flowed to the pouring portion 6 and smoothly poured out from the pouring portion 6.

Further, the lower part (S3) of the bulge portion provides rib effect because it takes vertical position, thereby improving in a self-standing ability and a configuration-keeping ability of the pouch.

The content of the pouch 105 can be poured into another container, such as bottle, in such manner that the trunk portion of the pouch 105 is supported by hand, the cut off portion 7*a* or 7*b* is put to an edge of the opening of the container, and then the opened pouring portion 6 is put into the opening of the container. According to this manner, steadiness of the pouring portion to the opening of another container is improved, and even if a viscous content is stored in the pouch, the content can be smoothly flowed to the pouring portion and the opening of the pouring portion is prevented from spontaneously closing, thus making it possible that the content is safely and easily poured into another container until pouring is completely finished.

Figure 9A:
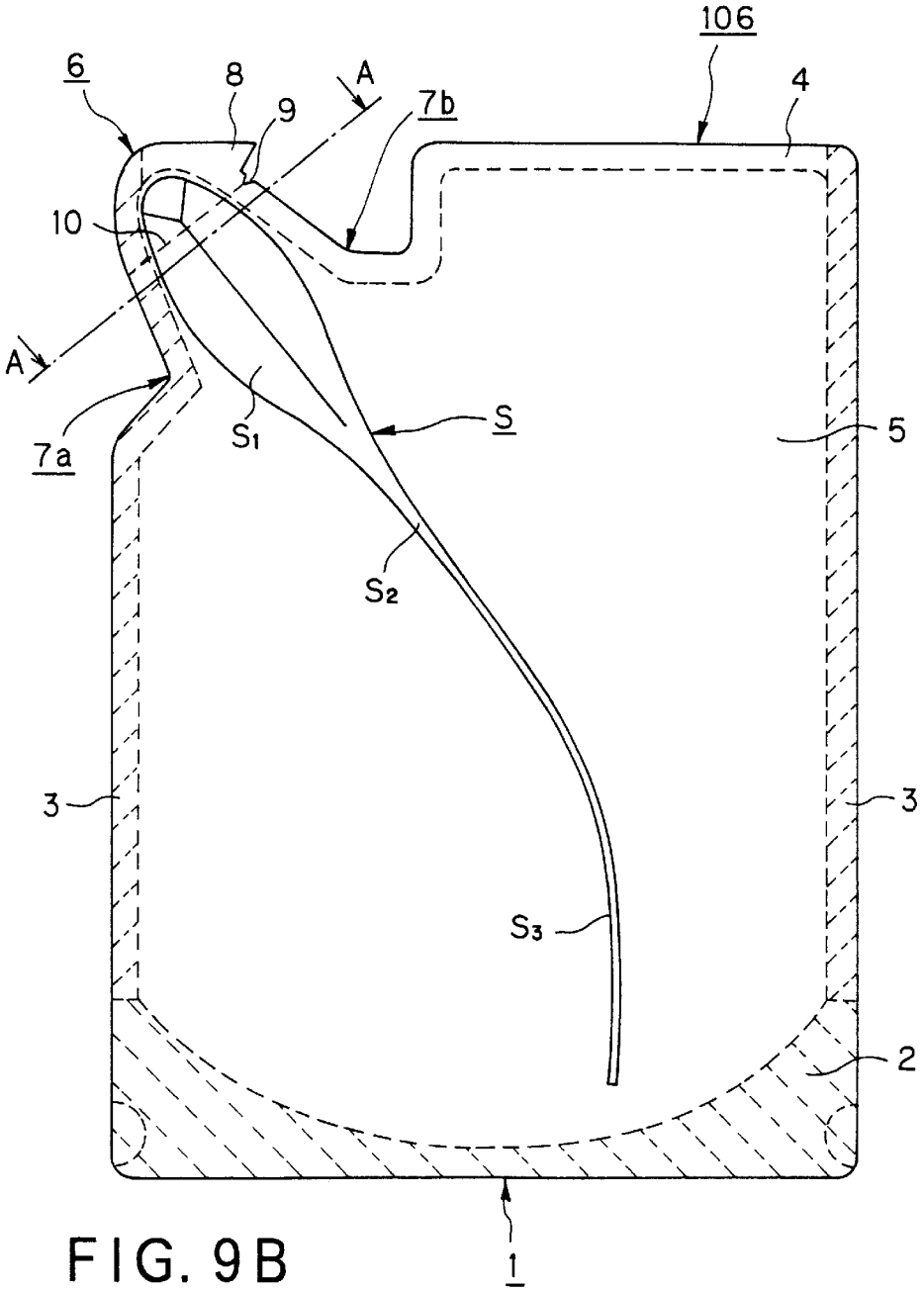
Figure 9B:
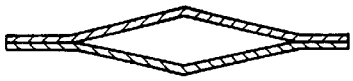

A pouch 106 shown in FIG. 9A and 9B is the same as the pouch 105 of FIG. 8 except that a top of the upper part (S1) of the bulge portion is shaped into a deformed triangular pyramid.

In such a configuration, the pouring portion provided with the part SI of the bulge portion is improved in a configuration-keeping ability and a restoration ability by ridgelines of the triangular pyramid. For example, even when the upper part (S1) of the bulge portion which is positioned at the pouring channel of the pouring portion 6 is once collapsed by an opening operation, this part can spontaneously return to the original configuration after removing the pushing load, and then the opening of the pouring portion can be expanded with its diamond shaped cross section kept well. Along with that, expansion of an inner space at about the center of the pouch can be steadied by the middle part (S2) of the bulge portion.

Figure 10A:
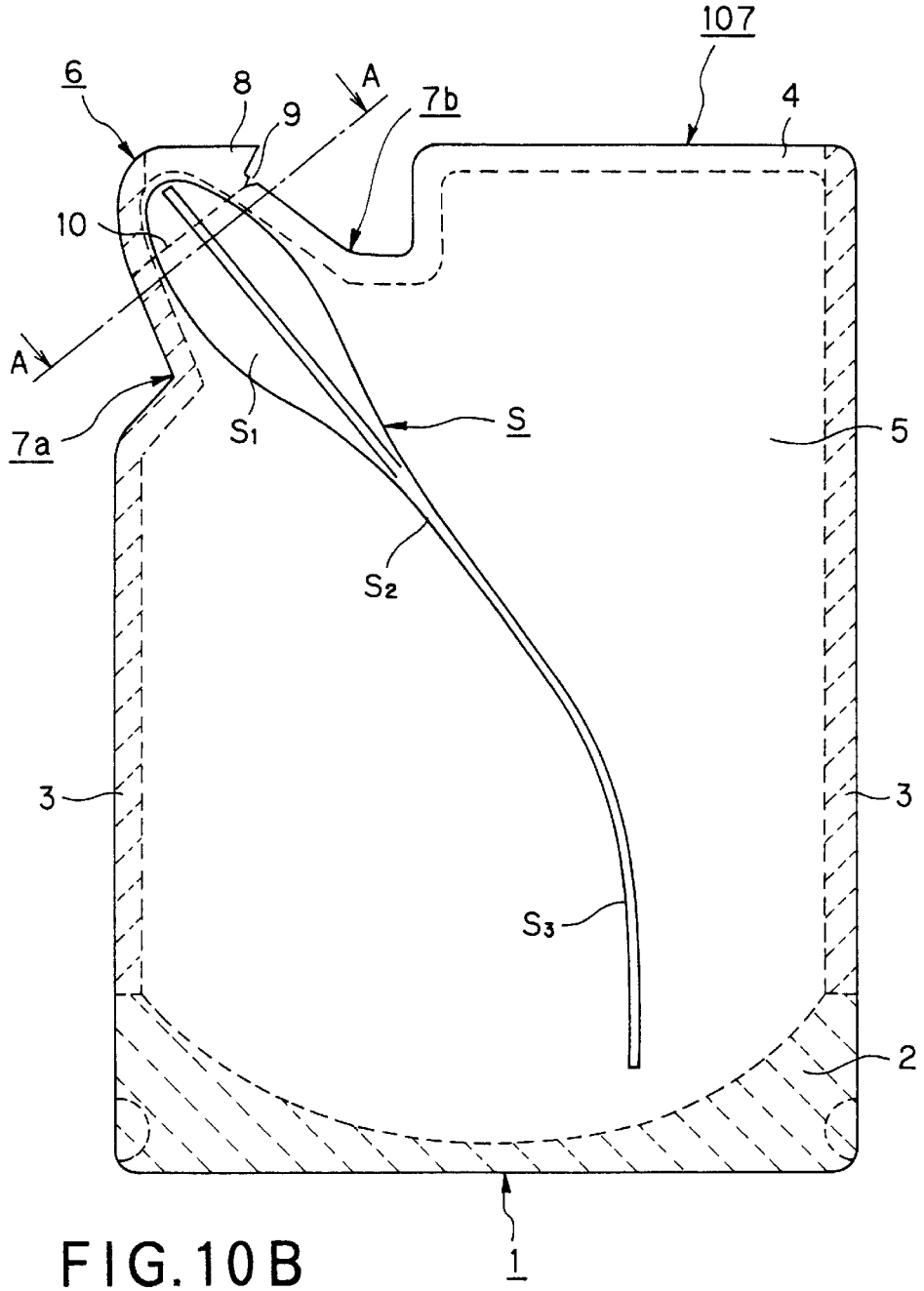
Figure 10B:
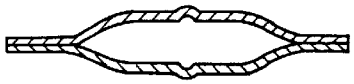

A pouch 107 shown in FIG. 10A and 10B is the same as the pouch 105 of FIG. 8 except that a configuration of the upper part (S1) of the bulge portion is changed so as to shape a top of the bulge portion into a linear rib extending along a center line of the bulge portion.

FIG. 10B is an enlarged sectional view showing one example of a cross section obtainable by cutting out the bulge portion of the pouch 107 in FIG. 10A in parallel with its widthwise direction. As shown in FIG. 10B, an opening to be formed at the pouring portion of this example is shaped into a long elliptical form in which a projection is formed at each center of the front and the rear sides by the linear rib.

In such a configuration, the pouring portion provided with the part S1 of the bulge portion is improved in a configuration-keeping ability and a restoration ability by rib effect of the linear rib additionally formed at the top of part Si in the similar way of the ridgelines of the triangular pyramid (FIG. 9), thereby improving a spontaneously expanding of the opening.

Furthermore, since the pouring portion 6 is bent outward along the linear rib of the part S1, the opening of the pouring portion 6 can be more improved in a configuration-keeping ability.

Figure 11A:
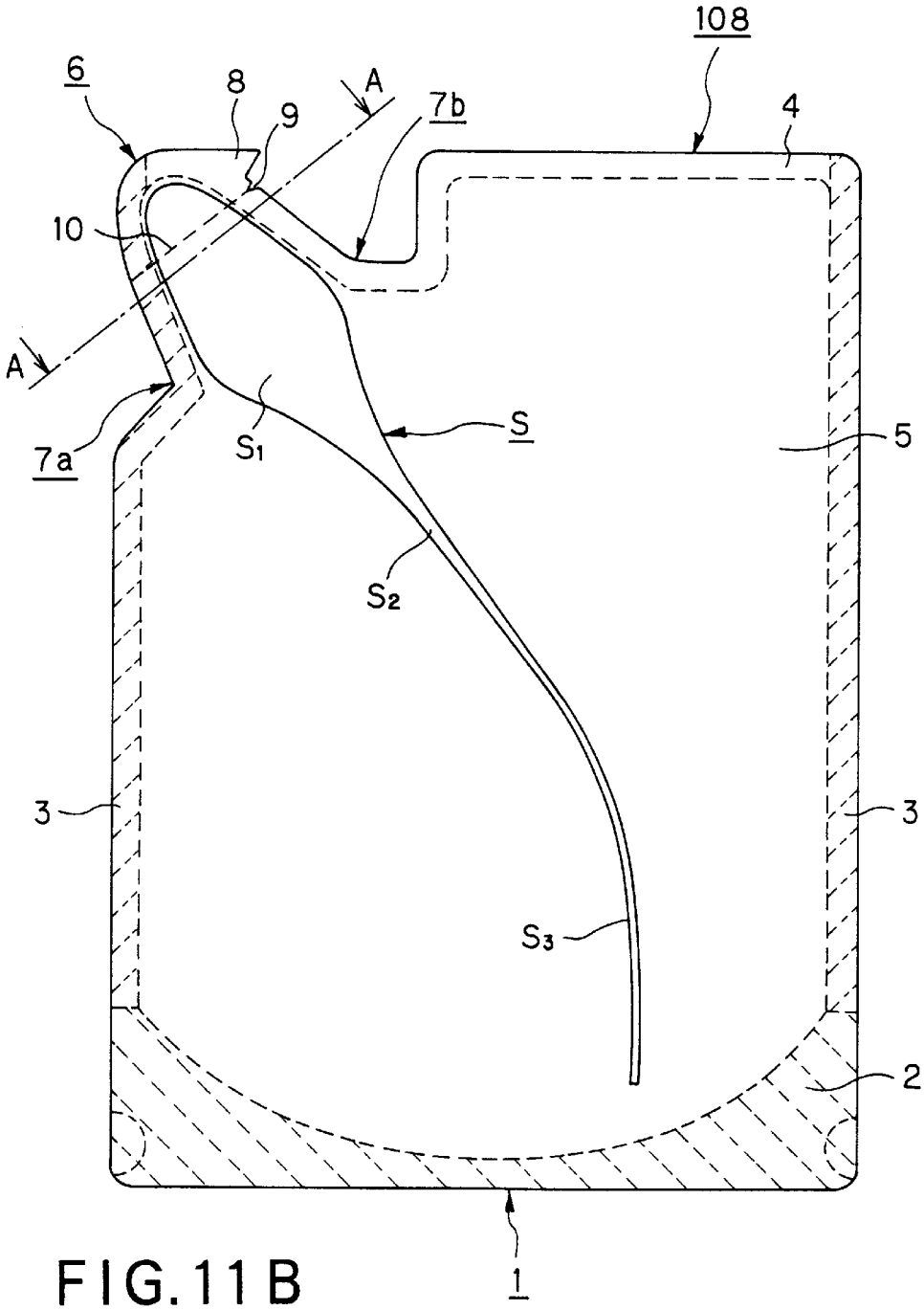
Figure 11B:
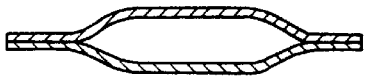

A pouch 108 shown in FIGS. 11A and 11B is the same as the pouch 105 of FIG. 8 except that the upper part S1 of the bulge portion is enlarged to almost all area of the pouring channel so as to extend from a base position to an upper end of the pouring portion 6.

FIG. 11B is an enlarged sectional view showing one example of a cross section obtainable by cutting out the bulge portion of the pouch 108 in FIG. 11A in parallel with its widthwise direction. As shown in FIG. 11B, an opening to be formed at the pouring portion of this example is shaped into a long elliptical form in the similar way of the pouch 105 of FIG. 8.

In such a configuration, the pouring portion 6 can be largely expanded across an entire area thereof when opened, and also the inner space from about the center of the pouch 108 to the pouring portion 6 can be largely expanded. Accordingly, the content can be more smoothly flowed to the pouring portion 6, and even a viscous content can be smoothly flowed out from the pouring portion 6.

Figure 12A:
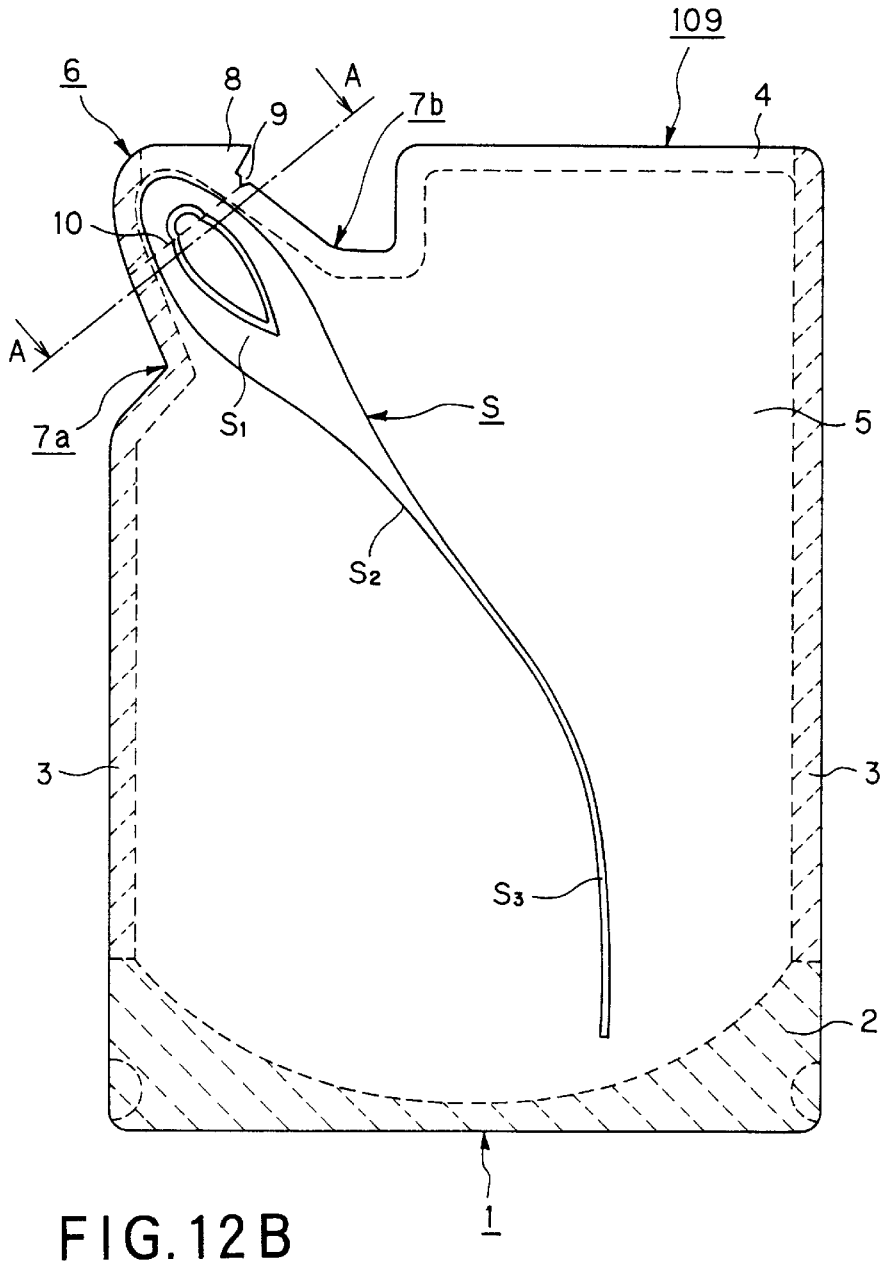
Figure 12B:
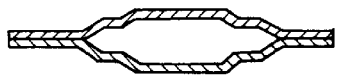

A pouch 109 shown in FIGS. 12A and 12B is the same as the pouch 105 of FIG. 8 except that the upper part S1 of the bulge portion is shaped into a stepwise form including two portions different in height, in which an upper step of the bulge portion is a little smaller than a lower step of the same and it is positioned like an island.

FIG. 12B is an enlarged sectional view showing one example of a cross section obtainable by cutting out the bulge portion of the pouch 109 in FIG. 12A in parallel with its widthwise direction. As shown in FIG. 12B, an A—A section of the pouring portion 6 has a stepwise form including portions different in height per each of the front and the rear side.

In such a configuration, the pouring portion provided with the part S1 of the bulge portion is improved in a resistance to a pushing load and a restoration from collapse by the stepwise form including two portions different in height, thereby improving a spontaneously expanding of the opening and a configuration-keeping ability of the pouring portion. Accordingly, even when the upper part (S1) of the bulge portion which is positioned at the pouring channel of the pouring portion 6 is once collapsed by an opening operation, this part can spontaneously return to the original configuration after removing the pushing load.

The above described stepwise form may includes more than two portions different in height.

Figure 13A:
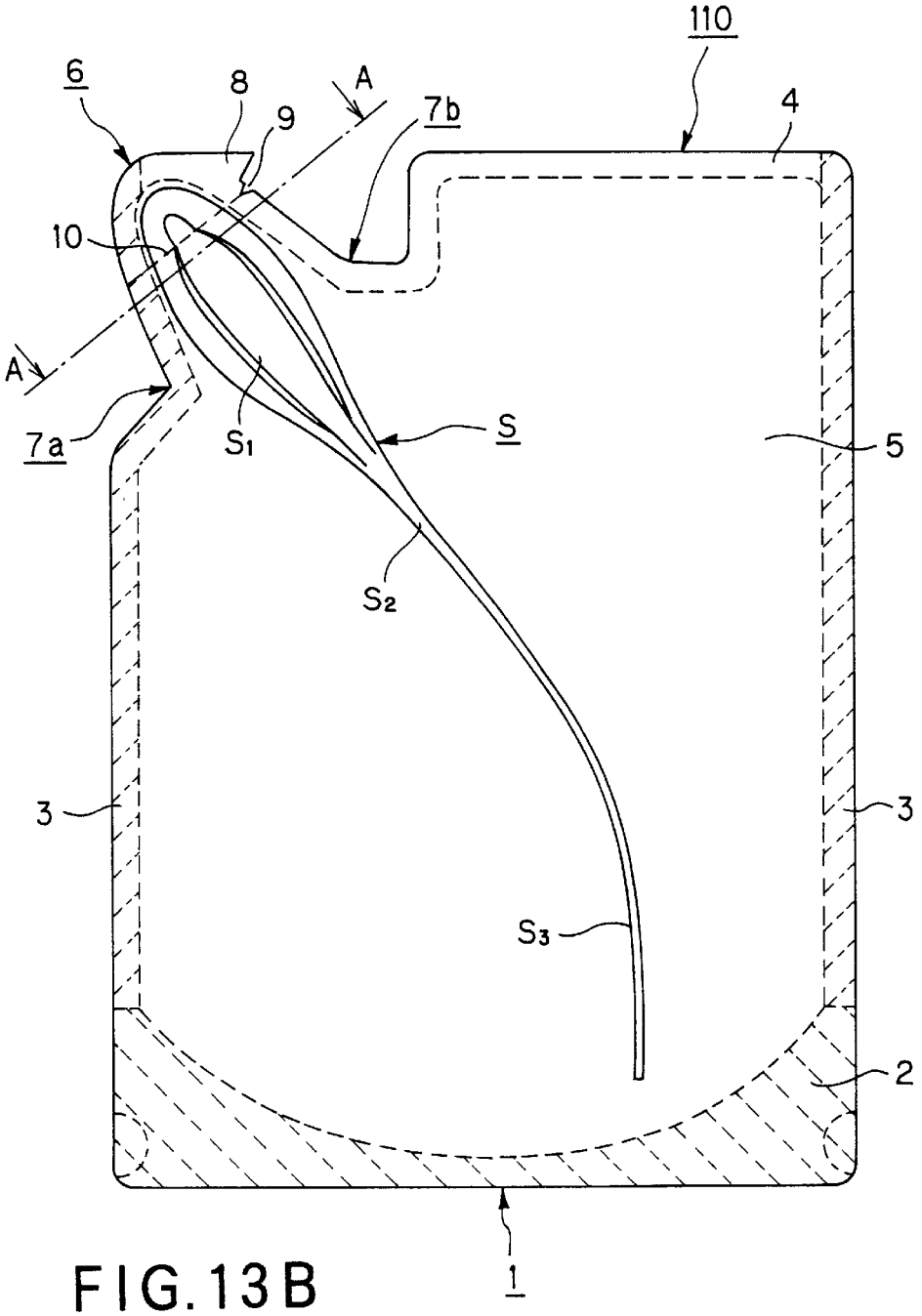
Figure 13B:
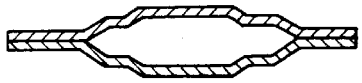

A pouch 110 shown in FIGS. 13A and 13B is the same as the pouch 105 of FIG. 8 except that the upper part S1 of the bulge portion is shaped into a stepwise form including two portions different in height, in which an upper step of the part S1 is gradually inclined toward the middle part S2 of the bulge portion and connected with the upper end of the middle part S2 together with an lower step of the part S1. The above described pouch 109 in FIG. 12 has a configuration like an island, but the pouch 110 of the FIG. 13 does not have such a configuration.

In such a configuration, the pouring portion provided with the part S1 of the bulge portion is improved in a resistance to a pushing load and a restoration from collapse by the stepwise form including two portions different in height, thereby improving a spontaneously expanding of the opening and a configuration-keeping ability of the pouring portion.

Accordingly, even when the upper part S1 of the bulge portion which is positioned at the pouring channel of the pouring portion 6 is once collapsed by an opening operation, this part can spontaneously return to the original configuration after removing the pushing load.

As described above, according to the first to third preferable embodiments concerned with the first aspect of the present invention, it is not necessary for production of the pouch to separately form a molded poring parts, it is possible to produce the pouch at a good productivity as well as a low cost through a process similarly to that applicable to an ordinary pouch, and it is easy to fill the content into these pouches. When the pouch of these embodiments is formed into a self-standing pouch and filled with the content followed by sealing up, the pouch is excellent in a self-standing ability, a configuration-keeping ability and appearance. In an opening operation, an end part of a pouring portion formed at a corner of an upper position of the pouch can be easily cut out, thereby forming an opening excellent in an expanding ability and a configuration-keeping ability. Even if a viscous content is stored in the pouch of these embodiments, the content can be smoothly flowed to the pouring portion and poured out from the pouring portion, thus making it possible that the content is safely and easily poured into even a container having a small opening without spill until pouring is completely finished.

Figure 14:
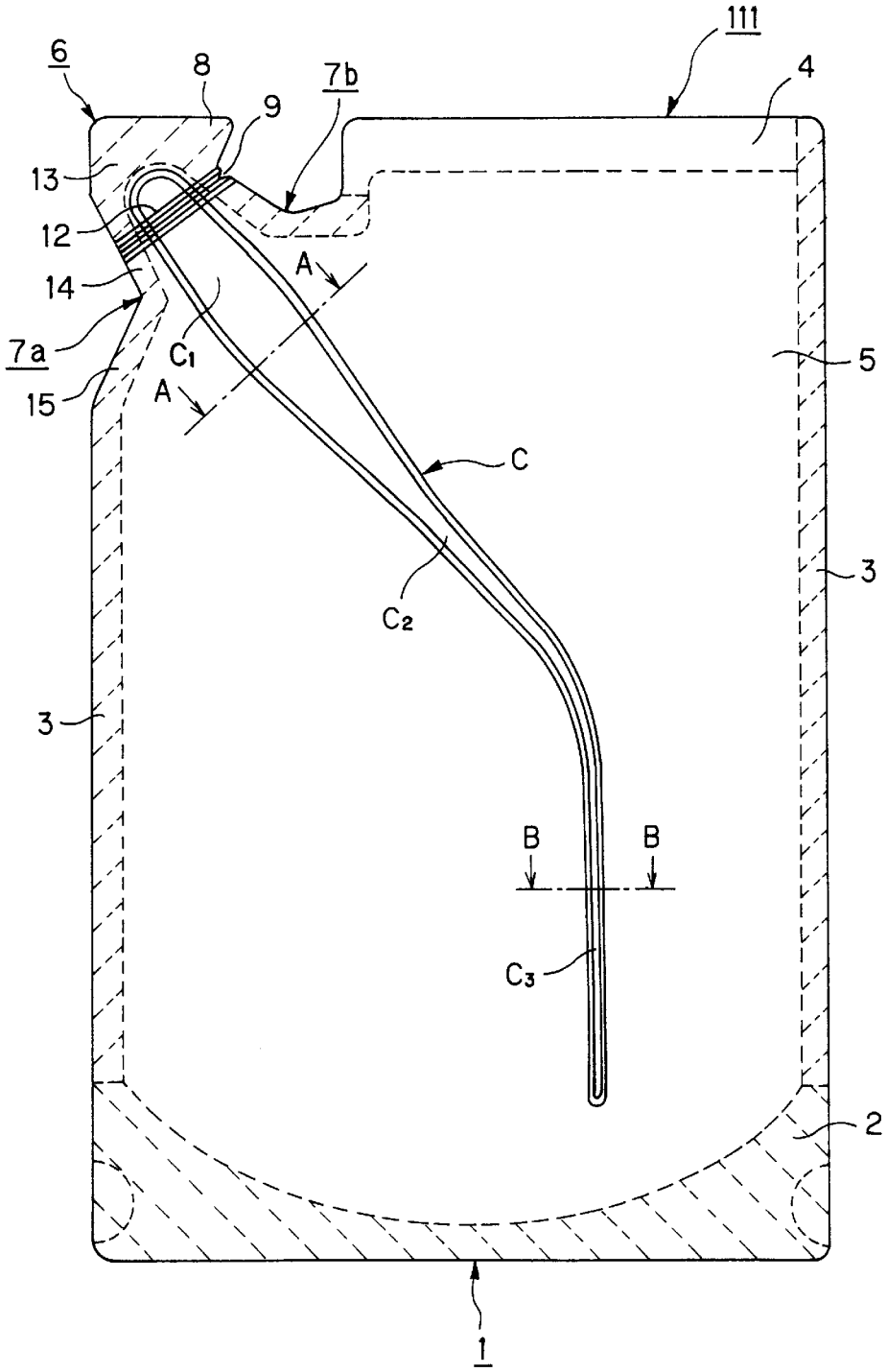
FIG. 14 is a plan view showing a pouch(111), which is the firth preferable embodiment concerned with the first aspect of the first invention.
Figure 15A:
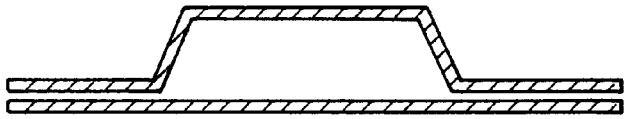
FIG. 15 includes 15A, 15B, 15C and 15D, and each of them is an enlarged sectional view showing one example of a cross section of the bulge portion of the pouch 111 in FIG. 14.
Figure 15B:
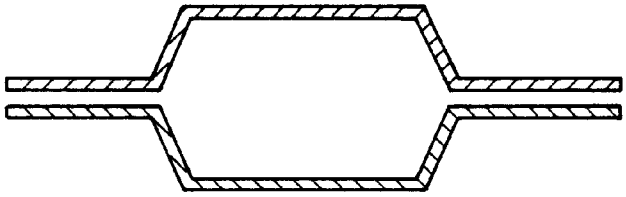
Figure 15C:
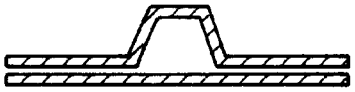
Figure 15D:
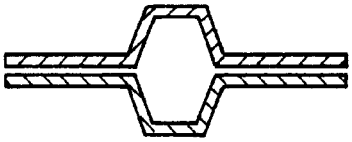

FIG. 14 is a plan view showing a pouch(111) for refill, which is a fourth preferable embodiment concerned with the first aspect of the first invention.

FIG. 15 includes 15A, 15B, 15C and 15D, and each of them is an enlarged sectional view showing one example of a cross section obtainable by cutting out the bulge portion of the pouch 111 in FIG. 14 in parallel with its widthwise direction. More specifically, FIG. 15A is an enlarged sectional view of an A—A section obtainable in a case where the bulge portion is disposed on only one wall portion. FIG. 15C is an enlarged sectional view of an A—A section obtainable in a case where the bulge portions are disposed on both the wall portions so as to superpose the two bulge portions to each other in a symmetrical relationship. FIG. 15B is an enlarged sectional view of an B—B section obtainable in the case where the bulge portion is disposed on only one wall portion. FIG. 15D is an enlarged sectional view of an B—B section obtainable in the case where the bulge portions are disposed on both the wall portions so as to make a symmetrical relationship the same as in FIG. 15B.

A trunk portion of the pouch 111 is formed into a self-standing pouch. A bottom portion 1 is formed in the ordinary manner, in which a film for the bottom portion is folded and positioned between two flat films so as to make gusset form protruding toward the inside of the pouch, and semicircular cut off portions are formed at vicinity of lower end on both sides of the film for the bottom portion, and the film for the bottom portion is heat sealed in a boat-like shape to form a bottom heat seal portion 2. The two flat films forming a front and a rear walls are in directly contact with each other at the semicircular cut off portion and bonded together at those positions by heat sealing. The trunk portion of the pouch 111 is formed by heat sealing two films constituting two flat portions 5, i.e., a front and a rear walls, at both side ends to form trunk heat seal portions 3.

A pouring portion 6 is formed at an upper corner of the pouch 111 so as to protrude in an obliquely upward direction. A peripheral portion of the pouring portion 6 is defined by heat sealing, and cut off portions 7*a*, 7*b* are formed at both sides of the pouring portion 6 by trimming, thereby forming an upper portion 13, a neck portion 14 and a shoulder portion 15.

A V-shaped notch 9 as an opening aid and a pinch portion 8 adjacent thereto are formed at an upper portion on one side of the pouring portion 6 by trimming of the cut off portion 7*b*. The notch 9 and the pinch portion 8 may be formed at an opposite side having the cut off portion 7*a* or both sides of the pouring portion 6.

A cut line starts from a position of the notch 9 and indicates an intended tear direction. It is preferable to form at least one half cut line 12 at a position of the cut line. In FIG. 14, five cut lines are formed in parallel, one is formed along the cut line and defined as a center line, and the two lines are allotted on one side of the center line, and the other two lines are allotted on the opposite side. When plural half-cut lines are formed, an actual torn direction unfortunately getting off the center half-cut line is led by an adjacent half-cut line, thereby more steadying the torn direction.

In the pouch 111 of FIG. 14, the bulge portions C extends on at least one wall portion so as to develop in a curve form from vicinity of the pouring portion toward a diagonally lower corner of the pouch, and width and height of the bulge portion are set so as to be large at vicinity (C1) of the pouring portion 6, gradually reduce along the obliquely downward direction (C2), and keep constant at a lower part (C3). A top and both sides of the bulge portion are defined by flat faces, and thus a cross section of the bulge portion is shaped into a trapezoidal form.

It is preferable that the bulge portion is provided to both the front and the rear walls so as to superpose the two bulge portion to each other in a symmetrical relationship.

In FIG. 14, the content is filled into the pouch 111 through a position of the upper heat seal portion 4, and thereafter the upper heat seal portion 4 is heat sealed.

Since the top and the both sides of the bulge portion C are defined by flat faces and the cross section of the bulge portion C is shaped into a trapezoidal form as shown in FIG. 15, the bulge portion is excellent in a resistance to a pushing load and a restoration from collapse. Accordingly the bulge portion C can improve the pouring portion in a spontaneously opening ability and a configuration-keeping ability at vicinity of the pouring portion to make pouring easy. Further, the bulge portion can smoothly flow the content toward the pouring portion at a middle area of the pouch. The bulge portion can also improve a configuration-keeping ability and a self-standing ability at a lower area of the pouch.

Such a bulge portion can be formed at a good productivity by an embossing process.

When the pouch 111 for refill as designed above is filled with the content, degassed and sealed at a position of the upper heat seal portion 4, the pouch 111 has a self-standing ability, easiness of handling and good appearance. When the content of the pouch 111 is poured into another container, particularly a refill container, the end part of the pouring portion 6 can be easily torn from the notch 9 along the half-cut line 12 by pinching the pinch portion 8 with fingers and pulling it in parallel with the half-cut line 12, thus opening the pouring portion 6.

Since at least one wall portions 5 of the pouch 111 are partially formed into the bulge portion C(C1, C2, C3) in which the bulge portion C extends on the wall portion so as to develop in a curved form from vicinity of the pouring portion 6, via vicinity of the center of the pouch 102, and to the lower position of the pouch, if the opened pouch 111 is stood somewhere, preferably on a plane face, the opening and the pouring channel of the opened pouch 111 can be made to spontaneously expand with its configuration well kept by the upper part (C1) of the bulge portion. In addition, the pouch 111 can be bent to an outward direction of the pouch along the lengthened bulge portion C(C1, C2, C3) by volume and weight of the content, thereby outward expanding an area lower than the pouring portion as well as the opening and the pouring channel. Accordingly, the content of the pouch 111 can be smoothly flowed to the pouring portion 6 and smoothly poured out from the pouring portion 6.

Further, the lower part (C3) of the bulge portion provides rib effect because it takes a constant width and height and a vertical position, thereby improving in a self-standing ability and a configuration-keeping ability of the pouch.

The content of the pouch 111 can be poured into another container, such as bottle, in such manner that the trunk portion of the pouch 111 is supported by hand, the cut off portion 7*a* or 7*b* is put to an edge of the opening of the container, and then the opened pouring portion 6 is put into the opening of the container. According to this manner, steadiness of the pouring portion to the opening of another container is improved, and even if a viscous content is stored in the pouch, the content can be smoothly flowed to the pouring portion and the opening of the pouring portion is prevented from spontaneously closing, thus making it possible that the content is safely and easily poured into another container until pouring is completely finished.

Figure 16:
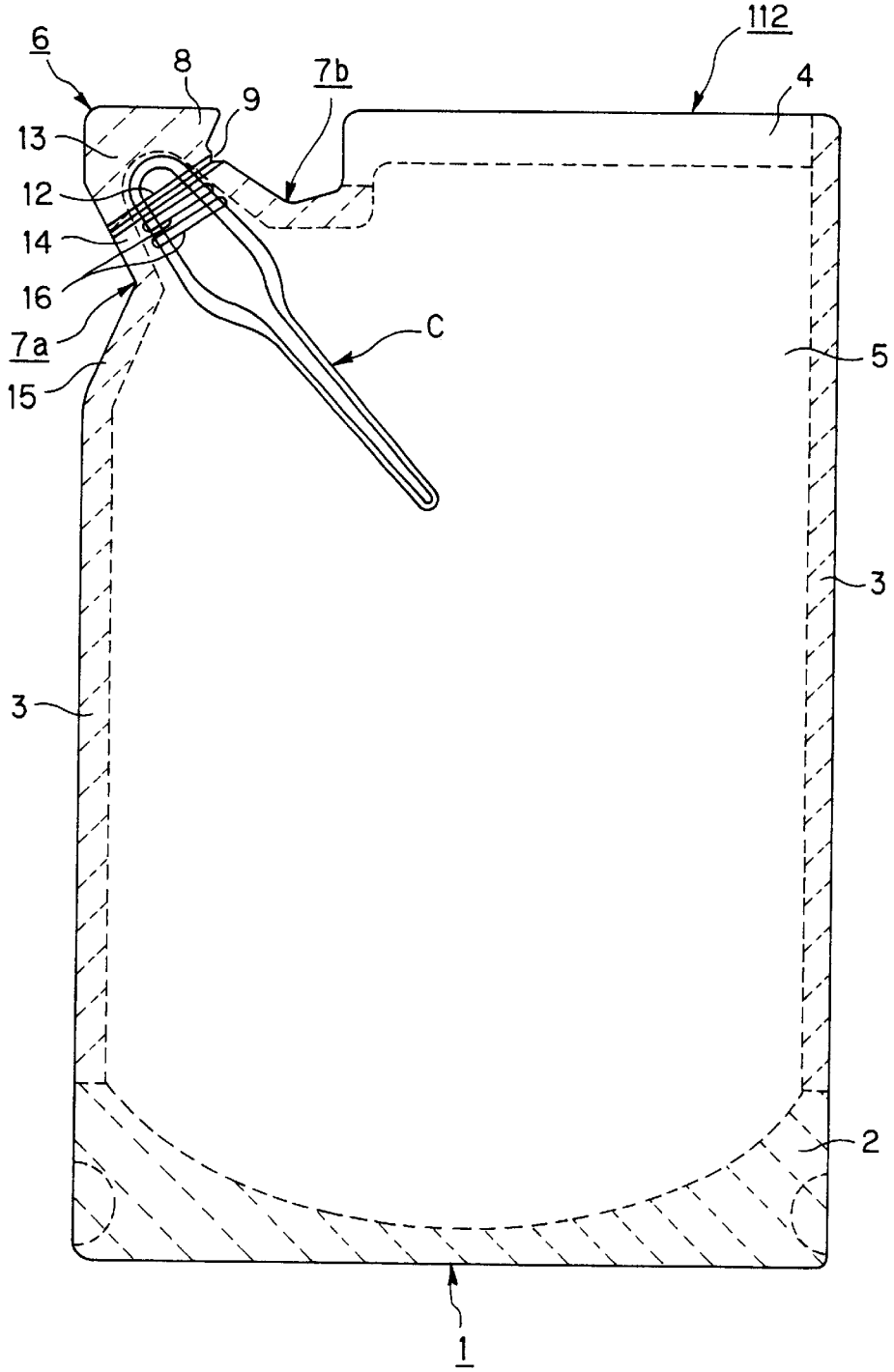
FIG. 16 is a plan view showing a pouch(112), which is a fifth preferable embodiment concerned with the first aspect of the first invention.
Figure 17:
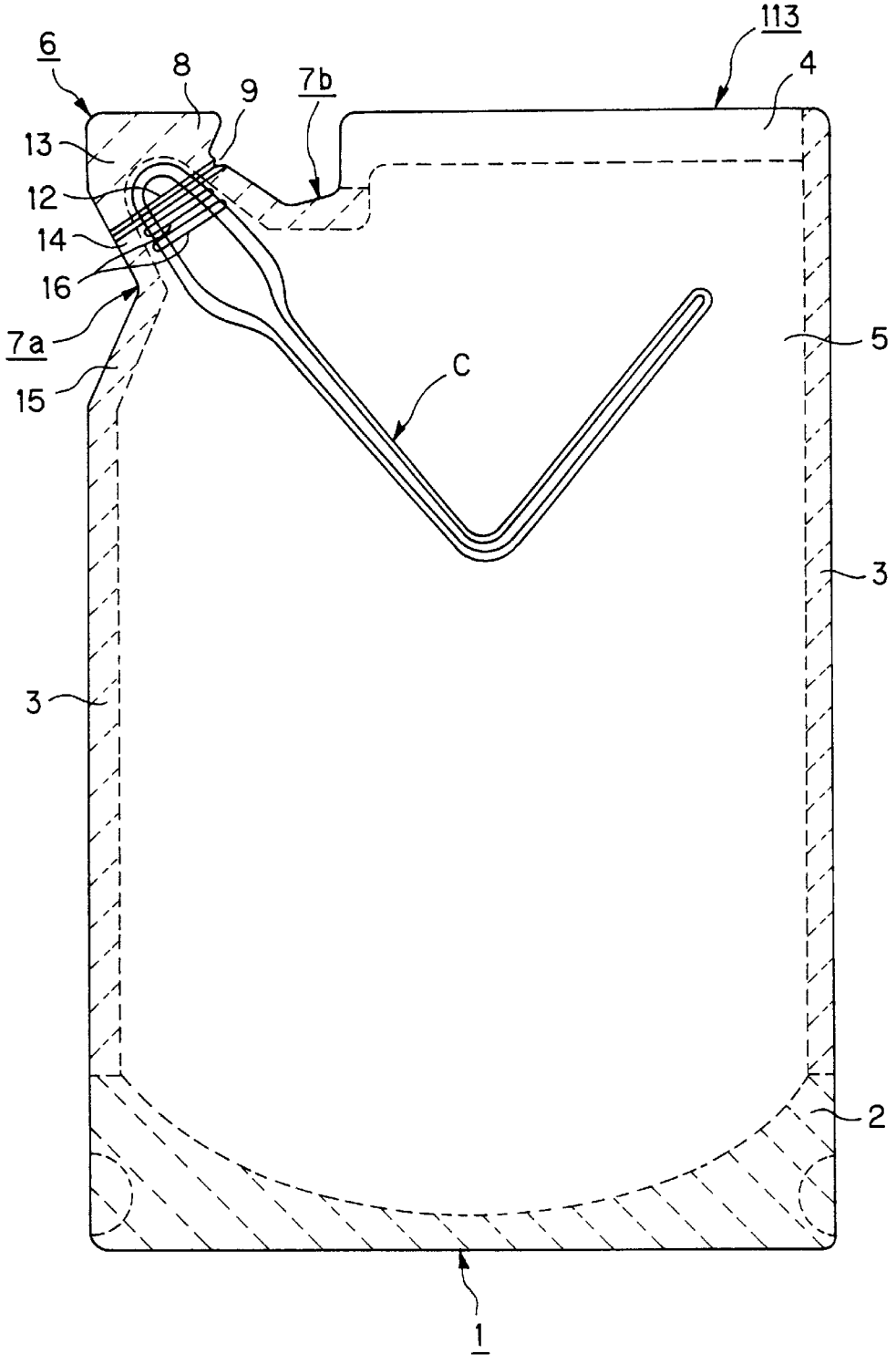
FIG. 17 is a plan view showing a pouch(113), which is the other example of the fifth preferable embodiment concerned with the first aspect of the first invention.

FIG. 16 is a plan view showing a pouch(112) for refill, which is a fifth preferable embodiment concerned with the first aspect of the first invention. Besides, FIG. 17 is a plan view showing a pouch(113) for refill, which is a the other example of the fifth preferable embodiment concerned with the same aspect.

A trunk portion of the pouch 112 is formed into a self-standing pouch in the similar way to the pouch 111 of FIG. 14.

A pouring portion 6 is formed at an upper corner of the pouch 112 so as to protrude in an obliquely upward direction. A peripheral portion of the pouring portion 6 is defined by heat sealing, and cut off portions 7*a*, 7*b* are formed at both sides of the pouring portion 6 by trimming, thereby forming an upper portion 13, a neck portion 14 and a shoulder portion 15.

Two inside lines defining the both sides of the pouring channel are formed so as to taper off the pouring channel to its upper end with two-stage changing of slant. A slant of the each inside line changes at the connection point which connects an inside line of the neck portion 14 and that of the shoulder portion 15 with each other. The inside line of the shoulder portion has a gentle slant in comparison with that of the neck portion.

A V-shaped notch 9 as an opening aid and a pinch portion 8 adjacent thereto are formed at an upper portion on one side of the pouring portion 6 by trimming of the cut off portion 7*b*. The notch 9 and the pinch portion 8 may be formed at an opposite side having the cut off portion 7*a* or both sides of the pouring portion 6.

A cut line starts from a position of the notch 9 and indicates an intended tear direction. At least one half cut line 12 may be formed at a position of the cut line. As shown in FIG. 16, it is preferable to additionally form one or more half-cut lines at both sides of the center half-cut line so as to be extended by the center half-cut line in parallel therewith. When plural half-cut lines are formed, an actual torn direction unfortunately getting off the center half-cut line is led by an adjacent half-cut line, thereby more steadying the torn direction.

In the pouch 112 of FIG. 16, at least one wall portions 5 of the pouch 112 are partially formed into the bulge portion C in which the bulge portion C protrudes to an outward direction of the pouch 112, and extends on the wall portion so as to develop from vicinity of the pouring portion 6 to vicinity of the center of the pouch 102. In the pouch 112, width and height of the bulge portion C are set so as to be large at vicinity of the pouring portion 6, a little immediately reduce along the obliquely downward direction, and keep constant at a further tailing part. A top and both sides of the bulge portion are defined by flat faces, and thus a cross section of the bulge portion is shaped into a trapezoidal form.

Besides, in order to more improve a configuration-keeping ability of the pouring portion 6, a reinforcement rib 16 may be formed at the pouring portion 6 so as to extend across the bulge portion C by a lower side of the half-cut line 12.

It is preferable that the bulge portion is provided to both the front and the rear walls so as to superpose the two bulge portion to each other in a symmetrical relationship.

A pouch 113 shown in FIG. 17 is the same as the pouch 112 of FIG. 16 except that a pattern of the bulge portion is changed. As shown in FIG. 17, the bulge portion C of the pouch 113 extends on the wall portion so as to develop in a V-turned form from vicinity of the pouring portion to vicinity of an opposite upper corner of the pouch via vicinity of the center of the pouch, and width and height of the bulge portion C are set so as to be large at vicinity of the pouring portion 6, a little immediately reduce along the obliquely downward direction, and keep constant at a further tailing V-shaped part. A top and both sides of the bulge portion are defined by flat faces, and thus a cross section of the bulge portion is shaped into a trapezoidal form.

Similarly to the pouch 111 of FIG. 15, a reinforcement rib 16 may be formed at the pouring portion 6 of the pouches 112 and 113 so as to extend across the bulge portion C by a lower side of the half-cut line 12.

It is also preferable for the pouches 112 and 113 that the bulge portion C is provided to both the front and the rear walls so as to superpose the two bulge portion to each other in a symmetrical relationship.

As described above, according to the fourth and fifth preferable embodiments concerned with the first aspect of the present invention, it is not necessary for production of the pouch to separately form a molded poring parts, it is possible to produce the pouch at a good productivity as well as a low cost through a process similarly to that applicable to an ordinary pouch, and it is easy to fill the content into these pouches. When the pouch of these embodiments is formed into a self-standing pouch and filled with the content followed by sealing up, the pouch is excellent in a self-standing ability, a configuration-keeping ability and appearance. In an opening operation, an end part of a pouring portion formed at a corner of an upper position of the pouch can be easily cut out, thereby forming an opening excellent in an expanding ability and a configuration-keeping ability. Even if a viscous content is stored in the pouch of these embodiments, the content can be smoothly flowed to the pouring portion and poured out from the pouring portion, and the pouring channel can be prevented from spontaneously closing, thus making it possible that the content is safely and easily poured into even a container having a small opening without spill until pouring is completely finished.

A second aspect of the first invention will be explained hereinafter. When a narrow pouring portion protruding upward is formed at an upper corner of the pouch, a peripheral of the pouring portion may be defined by heat seal portion so as to form a neck portion and a shoulder portion starting from a lower end of the neck portion.

The content of such a pouch can be poured into another container, such as bottle, in such manner that the pouring portion is opened by cutting off a heat seal portion positioned at an upper end of the pouring portion, and the pouch is tilted to put the opened pouring portion into the opening of the container.

In such a pouring operation, the content present at the inside of the pouch flows to the pouring portion, and an internal pressure of the content acts to outward direction of the pouch, thereby expanding a base position of the pouring portion. But at the same time, since a pouring channel passing through the pouring portion is narrow and long, bent lines (wrinkles) extending toward the upper end of the pouring portion are liable to be formed at both sides of the pouring portion along an assumed tangent which passes over a connection point connecting an inside line of the heat seal portion defining the neck portion and that defining the shoulder portion, thereby choking the pouring portion at apposition upper than a cross point of the two assumed tangents.

The inventors of the present invention found the fact that the choked position is varied depending on a configuration of the pouring portion, such as a configuration in which slant and/or length of the inside lines of the heat seal portion defining both sides of the pouring portion are symmetrical or not symmetrical with respect to the axis of the pouring portion, but the choked position is a little varied, and a boundary between the choked position and the expanded base position of the pouring portion is formed at about a vertex of a vertical angle of an assumed right triangle when the assumed right triangle is drawn by taking a straight line defined by two connection points connecting an inside line of the seal portion of the neck portion and that of the shoulder portion as its base, facing its vertical angle toward an upper end of the pouring portion, and setting its vertex of the vertical angle on the axis of the pouring channel.

That is, when the cut line is set so as to pass over such a vertex of the assumed right triangle or pass over a position lower than the vertex, force of the bent line to choke the pouring portion can be removed by cutting out the pouring portion along the cut line, thereby securing the opening operation of the pouring portion. To the contrary, when the cut line is set at a position upper than the vertex of the assumed right triangle, the force of the bent line to choke the pouring portion can not be removed even after cutting out, thereby choking the pouring portion.

Therefore, it is preferable that the cut line of the pouring portion is set so as to pass over the vertex of the vertical angle of such an assumed right triangle or pass over a position closer to a center of the pouch than the vertex, and it is also preferable that the pouring portion is shaped so as to make the shoulder portion slanted as well as the neck portion.

The second aspect of the first invention has been achieved in consideration of the above mentioned findings.

Figure 18:
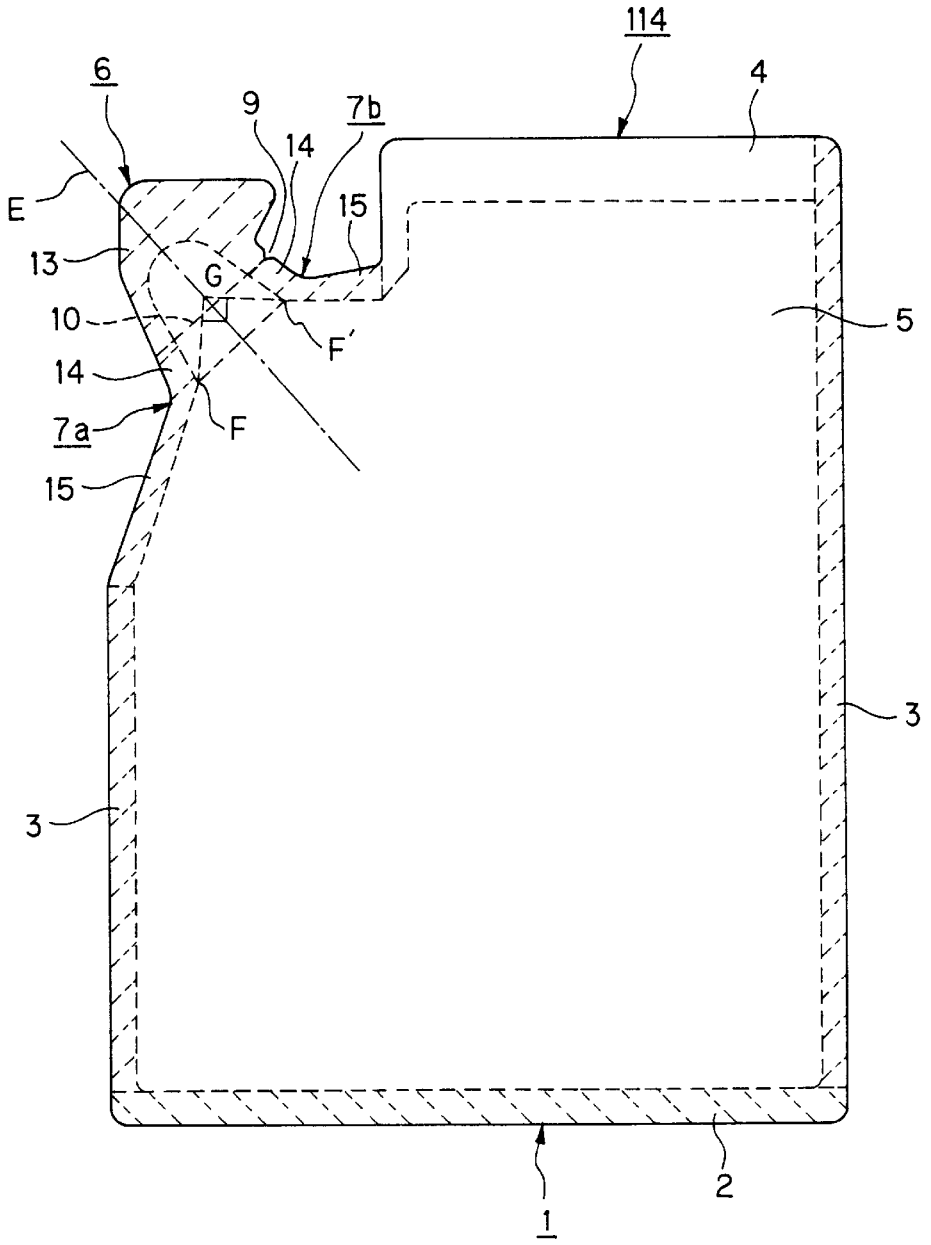
FIG. 18, FIG. 19 and FIG. 20 are plan views showing a pouch 114, a pouch 115 and a pouch 116 respectively, which are preferable embodiments concerned with the second aspect of the first invention.
Figure 19:
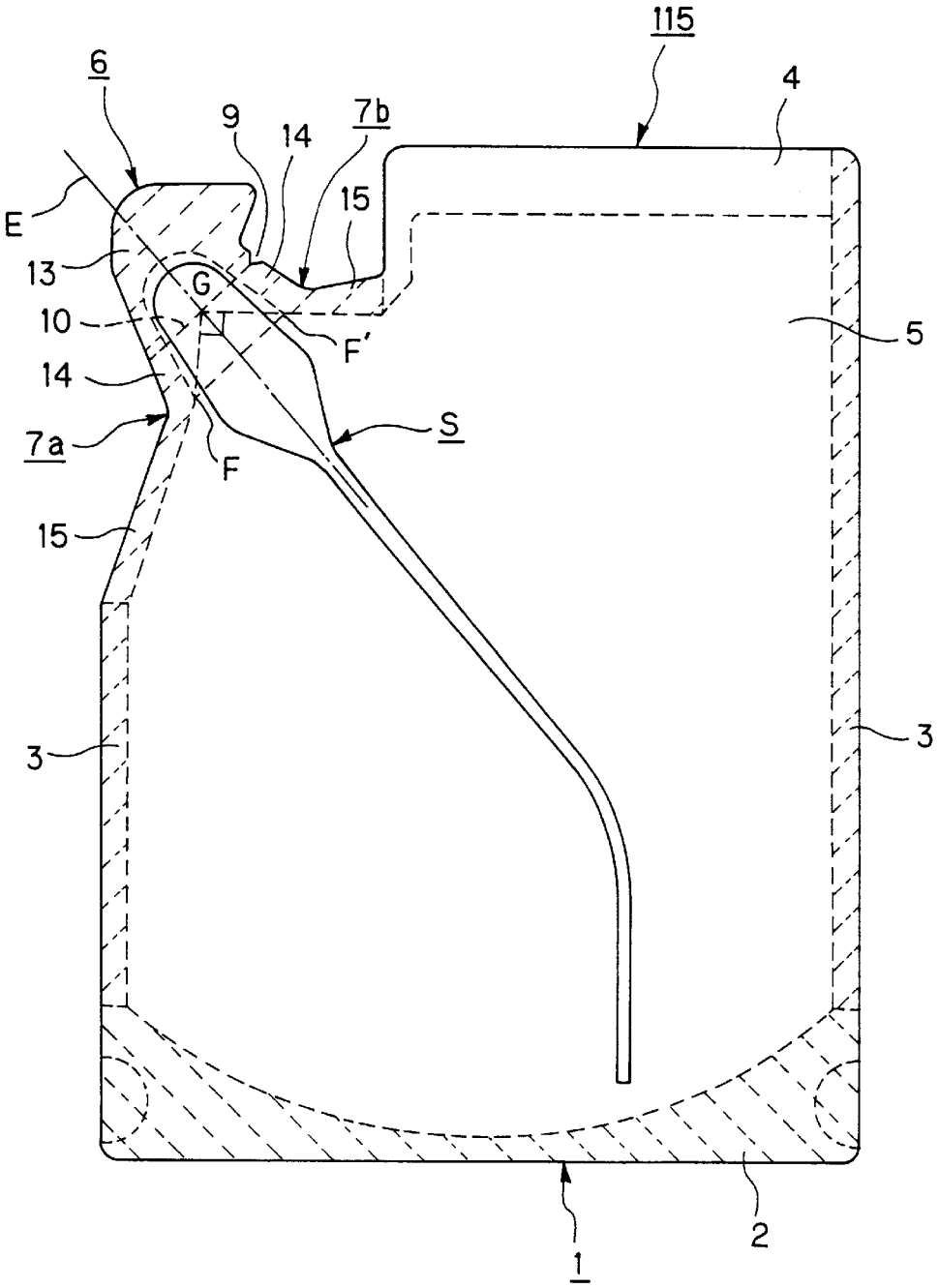
Figure 20:
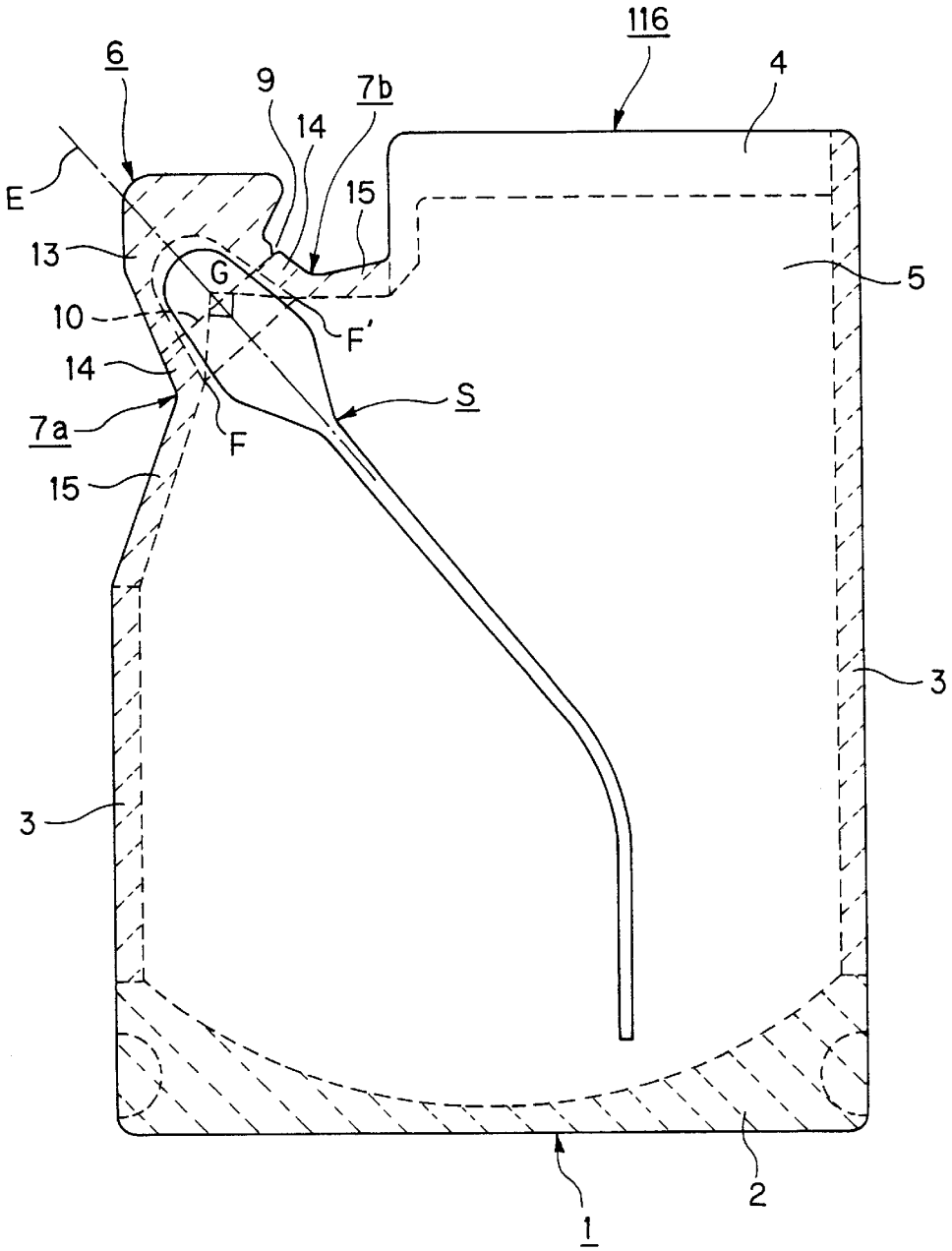

FIG. 18, FIG. 19 and FIG. 20 are plan views showing a pouch 114, a pouch 115 and a pouch 116 respectively, which are preferable embodiments concerned with the second aspect of the first invention.

In the each figure of FIG. 18, FIG. 19 and FIG. 20, the content is filled into the pouch through a position of an upper heat seal portion 4, and thereafter the upper heat seal portion 4 is heat sealed by, for example, a degas-sealing process.

In FIG. 18, a trunk portion of the pouch 114 is formed into a four-side sealed pouch. That is, a bottom portion 1 and a trunk portion of the pouch is defined by a bottom heat seal portion 1 and trunk heat seal portions 3, and they are formed by superposing two flexible films which are to constitute a front and a rear wall portions, and then heat sealing them at a lower end portion and both side end portions.

A pouring portion 6 is formed at an upper corner of the pouch 114 so as to protrude in an obliquely upward direction. A peripheral portion of the pouring portion 6 is defined by heat sealing, and cut off portions 7*a*, 7*b* are formed at both sides of the pouring portion 6 by trimming, thereby forming an upper portion 13, a neck portion 14 and a shoulder portion 15 starting from a lower end of the neck portion 14.

A V-shaped notch 9 as an opening aid and a wide heat seal portion adjacent thereto to be used as a pinch portion are formed at an upper portion on one side of the pouring portion 6 by trimming of the cut off portions 7*b*. The notch 9 and the wide heat seal portion may be formed at an opposite side having the cut off portion 7*a* or both sides of the pouring portion 6.

Inside lines of the heat seal portions formed at the both sides of the neck portion 14 and the shoulder portion 15 define the pouring channel, and accordingly the narrow pouring channel passes through the neck portion 14 and the shoulder portion 15. The inside lines of the neck portion and the shoulder portion may take any extent of inclination with respect to the axis of the pouring channel, and for example, the inside line of the each shoulder portion 15 can become perpendicular to the axis of the pouring channel so as to make two lines extended from the inside lines of both the shoulder portion aligned. The pouch 114 of the FIG. 18 shows an preferable example, in which the two inside lines defining the both sides of the pouring channel are formed so as to taper off the pouring channel to its upper end with two-stage changing of slant, and a slant of the each inside line changes at the connection point connecting an inside line of the neck portion and that of the shoulder portion with each other, and further the inside line of the shoulder portion has a gentle slant in comparison with that of the neck portion with respect to a base line of the pouring channel. If extent of slant is viewed with respect to the axis of the pouring channel, the inside line of the shoulder portion has a steep slant in comparison with that of the neck portion.

In such a configuration, since an angle defined by two bent lines which are formed at both sides of the pouring portion and extends toward the upper end of the pouring portion is made small, a non choked position can be elongated toward the upper end of the pouring channel, thus more preventing the spontaneously closing of the pouring portion.

In the pouch 114 of FIG. 18, the two-stage changing of slant is shaped into a broken line, and the connection point connecting the inside line of the neck portion and that of the shoulder portion can be definitely observed. However, the turning corner of the two-stage changing of slant may be shaped into a smoothly round corner.

A cut line 10 of the pouch 114 starts from position of the notch 9, crosses perpendicularly to an axis (E) of the pouring channel, and indicates a course for opening of the pouring portion 6. The cut line 10 is set so as to pass over the vertex (G) of the vertical angle of an assumed right triangle or pass over a position closer to a center of the pouch than the vertex (G) when the assumed right triangle is drawn by taking a straight line defined by two connection points (F, F') connecting an inside line of the seal portion of the neck portion 14 and that of the shoulder portion 15 as its base, facing its vertical angle toward an upper end of the pouring portion 6, and setting its vertex (G) of the vertical angle on the axis (E) of the pouring channel.

The cut line 10 may be composed only of a printed indication or a half-cut line may be formed along the cut line 10 by irradiation of the laser beam or the like.

When the pouch 114 for refill as designed above is filled with the content, degassed and sealed at a position of the upper heat seal portion 4, the pouch 114 has no self-standing ability because of its four side sealed construction, but it is easy to be formed and excellent in productivity and cost.

When the content of the pouch 114 is poured into another container, such as bottle, the end portion of the pouring portion 6 can be easily torn from the notch 9 along the cut line 10 by pinching the pinch portion 8 with fingers and pulling it in parallel with the cut line 10, thus opening the pouring portion 6.

Since thus opened pouch 114 provided with the cut off portion 7*a*, 7*b* at both sides of the pouring portion 6, and the opening position is set in such a manner as described above by the cut line 10, the content of the pouch 114 can be poured into another container, such as bottle, in such manner that the trunk portion of the pouch 114 is supported by hand, the pouch 114 is tilted, the cut off portion 7*a* or 7*b* is put to an edge of the opening of the container, and then the opened pouring portion 6 is put into the opening of the container. According to this manner, steadiness of the pouring portion to the opening of another container is improved, and the choking of the pouring portion 6 to be caused by the internal pressure can be prevented during the poring operation, thus making it possible that the content is safely and easily poured into another container until pouring is completely finished.

The pouch 115 shown in FIG. 19 is the same as the pouch 114 of FIG. 18 except that a trunk portion of the pouch 115 is formed into a self-standing pouch, and a notch 9 and a cut line 10 of the pouring portion 6 are set so as to make the cut line 10 pass over a vertex (G) of a vertical angle of an assumed right triangle, and both the front and the rear wall portions 5 of the pouch 115 are partially formed into the bulge portion S, in which the two bulge portions are arranged so as to be superposed to each other in a symmetrical relationship, and the each bulge portion S extends on the wall portion in a curved form from vicinity of the pouring portion 6 to a diagonally lower corner of the pouch, and width and height of the bulge portion S are set so as to be large at vicinity of the pouring portion 6, and gradually reduce along the obliquely downward direction.

The bulge portion S of the pouch 115 is formed by an embossing process. As to height of the bulge portion, the highest part at vicinity of the pouring portion 6 has a height of 4.0 mm, and a part from vicinity of the center of the pouch to a lower area of the pouch has a height of 0.8 mm.

When the pouch 115 for refill as designed above is filled with the content, degassed and sealed at a position of the upper heat seal portion 4, the pouch 115 has a self-standing ability, easiness of handling and good appearance.

When the content of the pouch 115 is poured into another container, such as bottle, the end part of the pouring portion 6 can be easily torn from the notch 9 along the cut line 10 by pinching the pinch portion 8 with fingers and pulling it in parallel with the cut line 10, thus opening the pouring portion 6.

Since thus opened pouch 115 can stand by itself, it is possible to be temporarily stood with the opening left opened, thereby being easy in handling. Further, since both the wall portions 5 of the pouch 115 are partially formed into the bulge portion S so as to extend from vicinity of the pouring portion 6 to a diagonally lower corner of the pouch, if the pouch 115 is opened and stood somewhere, preferably on a plane face, the opening and the pouring channel of the opened pouch 115 can be made to spontaneously expand with its configuration well kept. In addition, since the bulge portion shaped into a linear rib form extends on the wall portion from vicinity of the center of the pouch to the lower area of the pouch, the center area of the pouch 115 can be bent to an outward direction of the pouch along the bulge portion, and accordingly, the content of the pouch 115 can be smoothly flowed to the pouring portion 6, and the configuration of the pouch can also be steadied.

The content of the pouch 115 can be poured into another container, such as bottle, in the same manner as that of the pouch 114 of FIG. 18, and an expanding ability and a configuration-keeping ability of the pouring portion is more excellent in comparison with the pouch 114, thus causing no problem about the choking of the pouring portion during the pouring operation.

When a pouch having the same construction as that of the pouch 115 except that the bulge portion is eliminated was tested as well as the pouch 115 to try filling the content into this pouch and pouring the content from this pouch into another container, the pouch can be properly used, and the choking of the pouring portion was not caused.

The pouch 116 shown in FIG. 20 is the same as the pouch 115 of FIG. 19 except that a notch 9 and a cut line 10 of the pouring portion 6 are set so as to make the cut line 10 pass over a position closer to a center of the pouch than the vertex (G) of a vertical angle of an assumed right triangle.

In such a configuration, the pouch 116 of FIG. 20 can be made to improve in an expanding ability of the opening formed at the pouring portion, and a harmful effect of the bent line formed by the internal pressure of the content can be eliminated from the pouring portion to prevent the pouring portion from being choked during the pouring operation as well as the pouch 115 of FIG. 19, thus making it possible that the content is safely and easily poured into another container until pouring is completely finished.

As described above, according to the second aspect of the first invention, it is not necessary for production of the pouch to separately form a molded poring parts, it is possible to produce the pouch at a good productivity as well as a low cost through a process similarly to that applicable to an ordinary pouch, and it is easy to fill the content into these pouches. When the pouch of the second aspect is formed into a self-standing pouch and filled with the content followed by sealing up, the pouch is excellent in a self-standing ability, a configuration-keeping ability and appearance. In an opening operation, an end part of a pouring portion formed at a corner of an upper position of the pouch can be easily cut out, thereby forming an opening excellent in an expanding ability and a configuration-keeping ability. Further, the opened pouring portion can be prevented from spontaneously closing during the pouring operation. Thus, the content can be safely and easily poured into even a container having a small opening without spill until pouring is completely finished.

Figure 31:
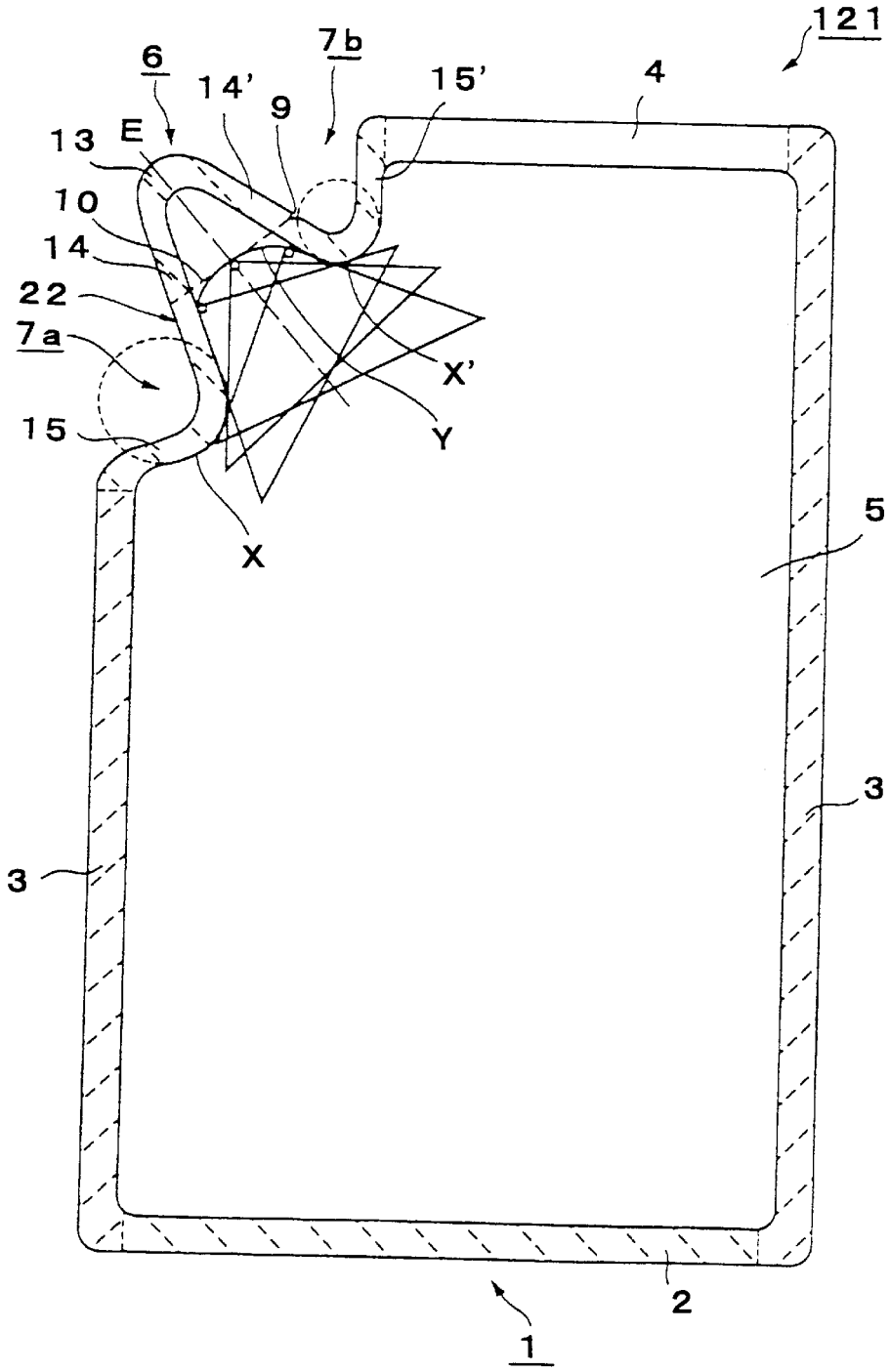
FIG. 31 is a plan view showing a pouch(121), which is one embodiment concerned with the third aspect of the first invention.

A third aspect of the first invention will be explained hereinafter. FIG. 31 is a plan view showing a pouch(121) for refill, which is a first embodiment concerned with the third aspect of the first invention.

In FIG. 31, a trunk portion of the pouch 121 is formed into a four-side sealed pouch. That is, a bottom portion 1 and a trunk portion of the pouch is defined by a bottom heat seal portion 1 and trunk heat seal portions 3, and they are formed by superposing two flexible films which are to constitute a front and a rear wall portions, and then heat sealing them at a lower end portion and both side end portions.

A pouring portion 6 is formed at an upper corner of the pouch 121 so as to protrude in an obliquely upward direction. A peripheral portion of the pouring portion 6 is defined by heat sealing to form a seal portion 22 of the pouring portion, and cut off portions 7*a*, 7*b* are formed at both sides of the pouring portion 6 by trimming, thereby forming an upper portion 13, a neck portion 14 and a shoulder portion 15 starting from a lower end of the neck portion 14.

A V-shaped notch 9 as an opening aid and a wide heat seal portion adjacent thereto to be used as a pinch portion may be formed at an upper portion on one side of the pouring portion 6 by trimming of the cut off portions 7*b*. The notch 9 and the wide heat seal portion may be formed at an opposite side having the cut off portion 7*a* or both sides of the pouring portion 6. An inside line of the heat seal portion 22 of the pouring portion 6 is symmetrically widened from the upper portion. 13 of the pouring portion to an intermediate part of the neck portion 14, 14' with respect of an axis E of the pouring channel, but it may not be symmetrical at a further lower part with respect of the axis E of the pouring channel. For example, in FIG. 31, one side line 14 of the neck portion is different from the opposite side line 14' thereof in length, and both transit portions transiting from the inside line of the seal portion of the neck portion 14, 14' to that of the shoulder portion 15, 15' are shaped into curved lines X, X' such as arcs, and further, one side line 15 of the shoulder portion is different from the opposite side line 15' thereof in length.

Though the side lines 14, 14' of the neck portion of the pouch 121 in FIG. 31 are made straight, they may be shaped into curved lines, such as upward protrusive arcs different in diameter per side of the neck portion.

The pouring portion 6 is provided with a cut line 10 indicating a course for opening of the pouring portion. The cut line 10 of the pouch 121 passes over one point on a trace Y drawn by a vertex of a vertical angle of an assumed right triangle when the trace is drawn by taking the assumed right triangle having the base longer than a width of the pouring channel, inserting the vertical angle into the pouring channel from lower side thereof, sliding the assumed right triangle with both sides defining the vertical angle being kept in contact with the both inside lines of the seal portions 22 of the pouring portion.

The cut line 10 may be composed only of a printed indication or a half-cut line may be formed along the cut line 10 by irradiation of the laser beam or the like.

When the pouch 121 for refill as designed above is filled with the content, degassed and sealed at a position of the upper heat seal portion 4, the pouch 121 has no self-standing ability because of its four side sealed construction, but it is easy to be formed and excellent in productivity and cost.

In the pouch 121, since the both transit portions transiting from the inside line of the seal portion of the neck portion 14, 14' to that of the shoulder portion 15, 15', i.e., a base of the pouring channel, are shaped into curved lines X, X', an edge of the pouring channel is very smooth. Even if an internal pressure of the content is loaded on this transit portion, it does not cause rupture or stripping of the seal portion.

Accordingly, even if width of the seal portion 14, 14' of the neck portion is relatively narrow in comparison with that of the trunk seal portion 3, the sealing is steadied, thus preventing breakage of the pouch.

When the content of the pouch 121 is poured into another container, such as bottle, the end portion of the pouring portion 6 can be easily torn from the notch 9 along the cut line 10, thus opening the pouring portion 6.

Since a position of the cut line 10 is set in the above described manner, a cross point of the bent lines (wrinkles) extending from the base of the pouring portion toward the upper end of the pouring portion is formed on the cut line 10 or at a position upper than the cut line 10. Accordingly, when the upper portion of the pouring portion 6 is cut out along the cut line 10, a position upper than the cross point where choking of the pouring portion occurs can be cut off. As the result, the opening can spontaneously expand with an excellent configuration-keeping ability, and the opening can be prevented from spontaneously closing during the pouring action.

Further, since thus opened pouch 121 is provided with the cut off portion 7*a*, 7*b* at both sides of the pouring portion 6, and the opening position is set in such a manner as described above by the cut line 10, the content of the pouch 121 can be poured into another container, such as bottle, in such manner that the trunk portion of the pouch 121 is supported by hand, the pouch 121 is tilted, the cut off portion 7*a* or 7*b* is put to an edge of the opening of the container, and then the opened pouring portion 6 is put into the opening of the container. According to this manner, steadiness of the pouring portion to the opening of another container is improved, and the choking of the pouring portion 6 to be caused by the internal pressure can be prevented during the poring operation, thus making it possible that the content is safely and easily poured into another container until pouring is completely finished.

Figure 32:
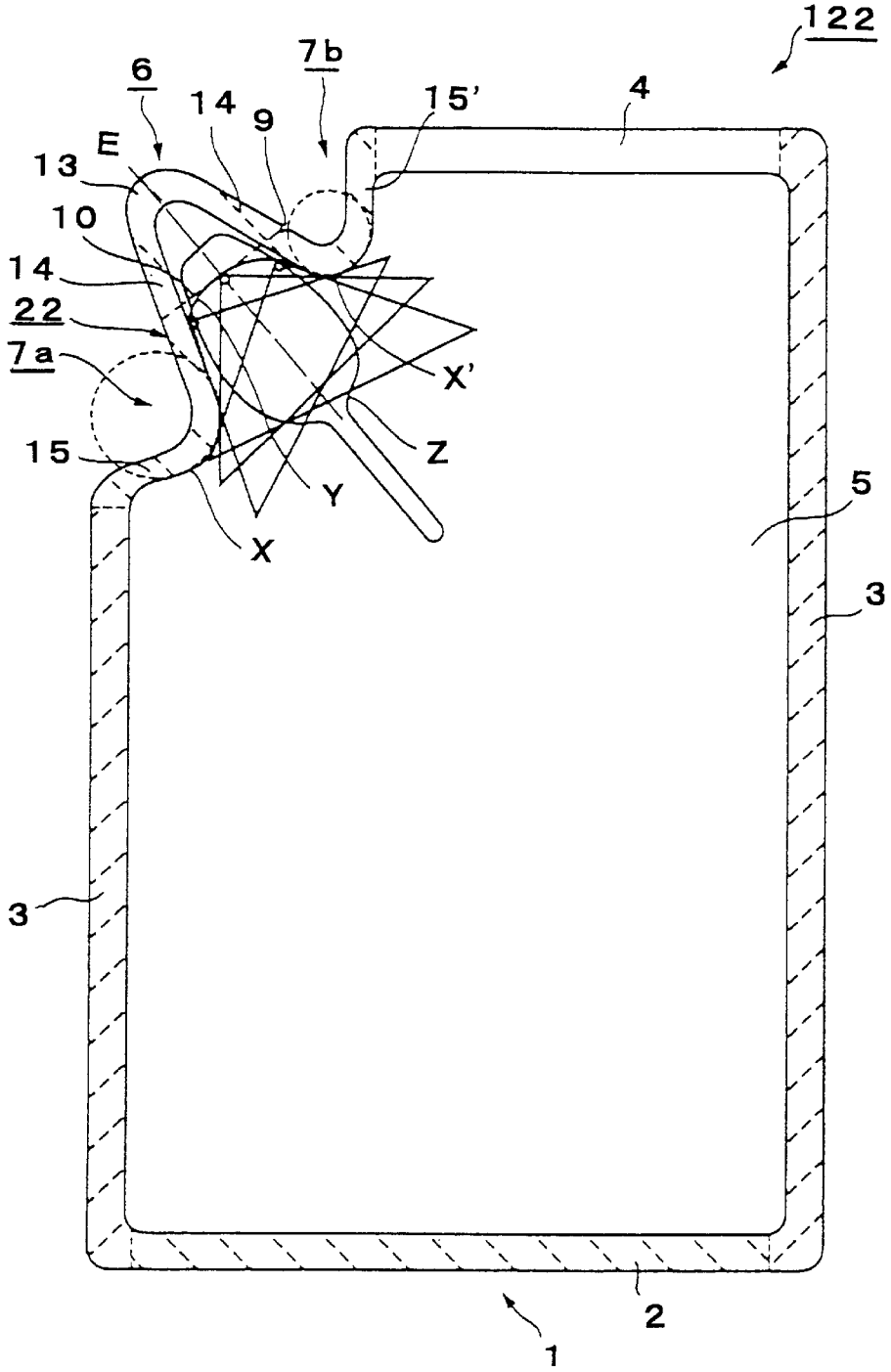
FIG. 32 is a plan view showing a pouch(122), which is another embodiment concerned with the third aspect of the first invention.

FIG. 32 is a plan view showing a pouch(122) for refill, which is a second embodiment concerned with the third aspect of the first invention.

The pouch 122 of FIG. 32 is the same as the pouch 121 already shown in FIG. 31 except that a bulge portion Z is formed to at least one wall portion so as to extend from vicinity of the pouring portion 6 to vicinity of a center of the pouch 122.

Figure 33:
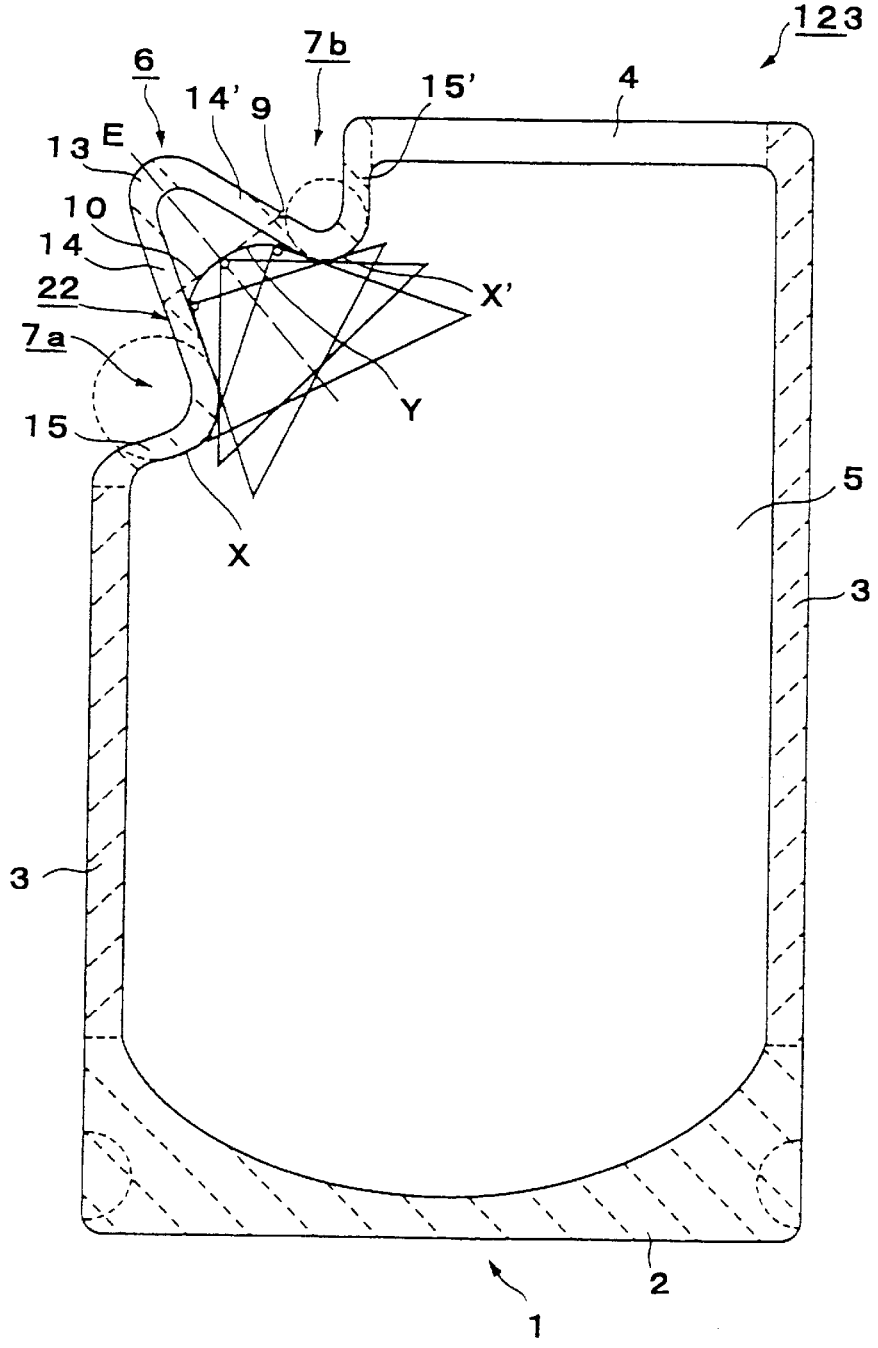
FIG. 33 is a plan view showing a pouch(123), which is still another embodiment concerned with the third aspect of the first invention.

FIG. 33 is a plan view showing a pouch(123) for refill, which is a third embodiment concerned with the third aspect of the first invention.

The pouch 123 of FIG. 33 is the same as the pouch 121 already shown in FIG. 31 except that a trunk portion of the pouch 123 is not formed into a four-side sealed pouch, but into a self-standing pouch.

When the pouch 123 for refill as designed above is filled with the content, degassed and sealed at a position of the upper heat seal portion 4, the pouch 123 has a self-standing ability, easiness of handling and good appearance.

Figure 34:
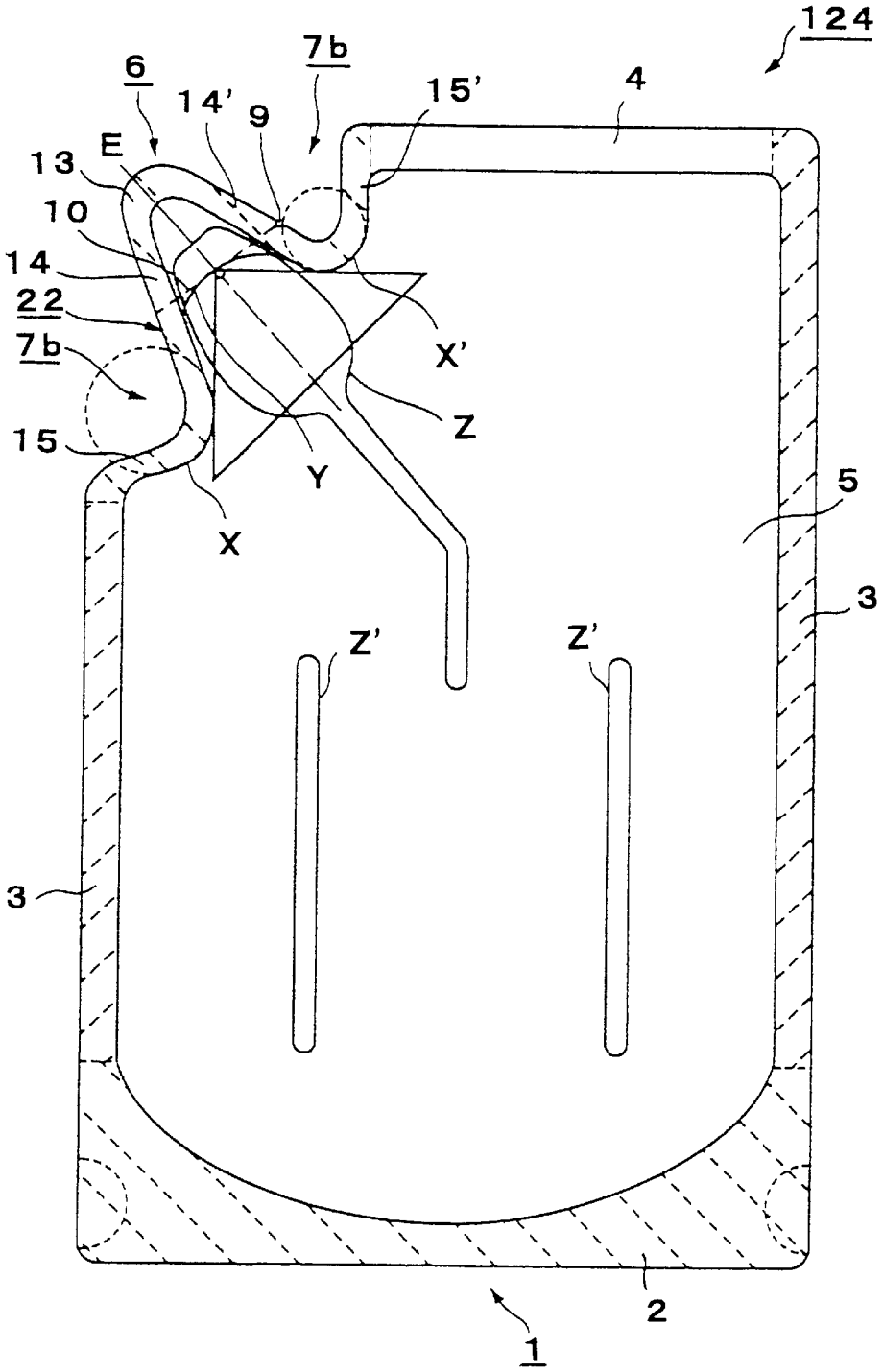
FIG. 34 is a plan view showing a pouch(124), which is still another embodiment concerned with the third aspect of the first invention.

FIG. 34 is a plan view showing a pouch(124) for refill, which is a fourth embodiment concerned with the third aspect of the first invention.

The pouch 124 of FIG. 34 is the same as the pouch 123 already shown in FIG. 33 except that bulge portions Z and Z' are formed to at least one wall portion.

The bulge portion Z comprises a head part and a tail part integrated with each other. The head part of the bulge portion Z is disposed in the pouring channel, and a tail part begins from a lower tip of the head part and extends to vicinity of a center of the pouch. On the other hand, the bulge portion Z' is shaped into a column or rib-like form, and a pair of bulge portions Z' are formed on the wall portion. The bulge portion Z' is allotted one by one per each side of the pouch so as to be disposed at a position a little close to one side of the pouch, and each bulge portion Z' is vertically extending from about a middle position to a lower position of the pouch.

A preferable height of the bulge portion Z and Z' is about 2.0 to 5.0 mm at the head part, and about 0.5 to 2.0 mm at the tail part.

When the pouch 124 for refill as designed above is opened by cut off the end portion of the pouring portion 6, the opening and the pouring channel of the opened pouch 124 can be made to spontaneously expand with its configuration well kept by the head part of the bulge portion, thereby more preventing the pouring portion 6 from closing during the pouring operation. In addition, the pouch 124 can be bent to an outward direction of the pouch along the tail part of the bulge portion Z by volume and weight of the content, thereby outward expanding an area lower than the pouring portion to the center of the pouch as well as the opening and the pouring channel. Accordingly, the content of the pouch 121 can be smoothly flowed to the pouring portion 6 and smoothly poured out from the pouring portion 6.

Further, the bulge portions Z' vertically extending at a relatively low position of the pouch can also bent the lower position of the pouch 124 to the outward direction thereof in association with the internal pressure of the content, and simultaneously provide rib effect. As the result, when the pouch 124 is made to self-stand, a middle to lower part of the pouch 124 is shaped into an angular pillar form to be steadied.

Figure 35:
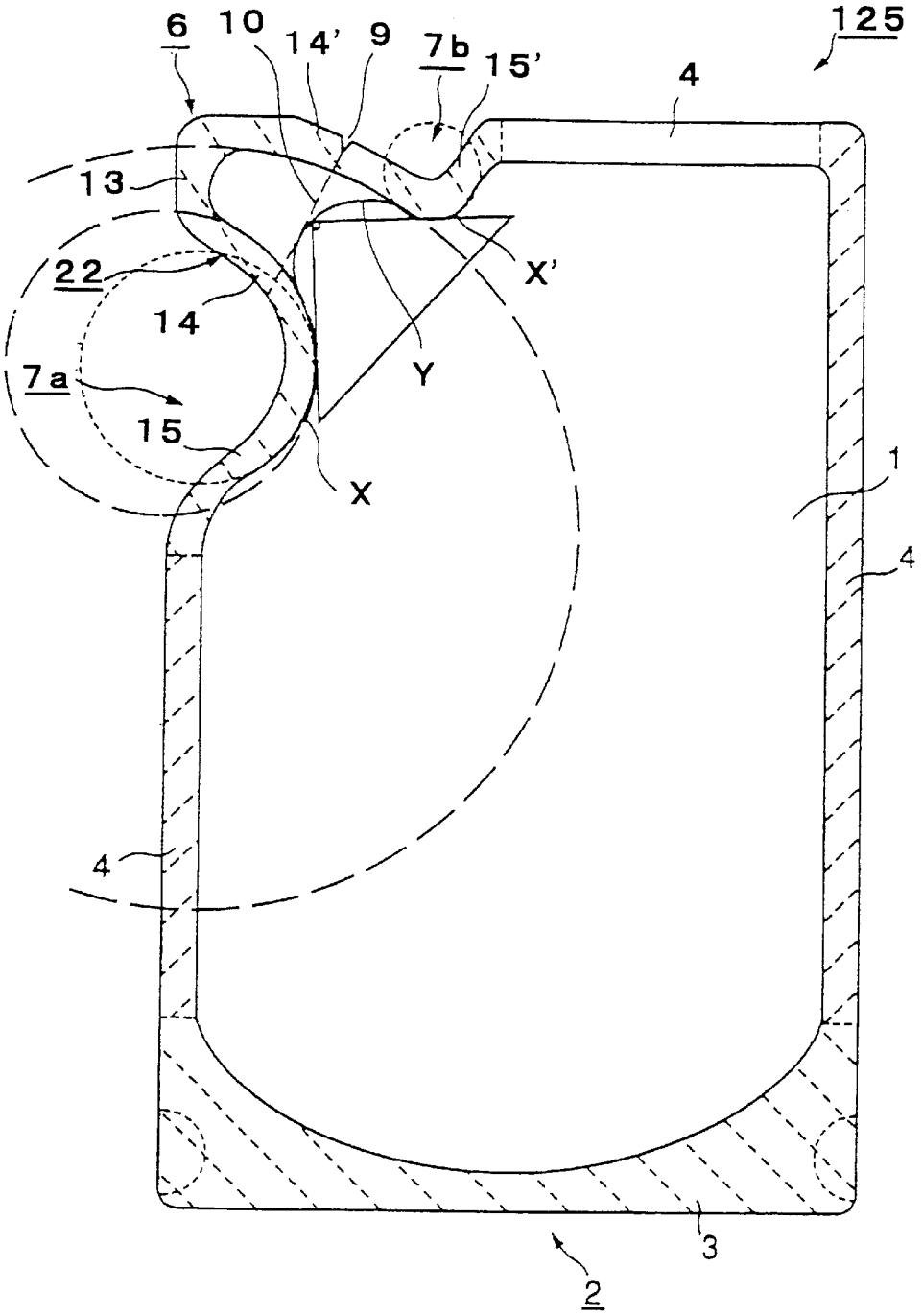
FIG. 35 is a plan view showing a pouch(125), which is still another embodiment concerned with the third aspect of the first invention.

FIG. 35 is a plan view showing a pouch(125) for refill, which is a fifth embodiment concerned with the third aspect of the first invention.

The pouch 125 of FIG. 35 is the same as the pouch 123 already shown in FIG. 33 except that formation of the pouring portion is changed.

In FIG. 35, a pouring portion 6 is formed at an upper corner of the pouch 125 so as to protrude in an obliquely upward direction. A peripheral portion of the pouring portion 6 is defined by heat sealing to form a seal portion 22 of the pouring portion, and cut off portions 7*a*, 7*b* are formed at both sides of the pouring portion 6 by trimming, thereby forming an upper portion 13, a neck portion 14 and a shoulder portion 15 starting from a lower end of the neck portion 14.

Both inside lines of the seal portions 14, 14' defining the neck portion are not straight, and each of these inside lines is shaped into an upward protrusive arc having a different diameter so as to taper the pouring channel of the neck portion off to an upper end of the pouring channel. Both transit portions transiting from the inside line of the seal portion of the neck portion 14, 14' to that of the shoulder portion 15, 15' are also shaped into arc-form lines X, X', and further. Further, the cut line 10 of the pouch 125 passes over one point on a trace Y drawn by a vertex of a vertical angle of an assumed right triangle when the trace is drawn by taking the assumed right triangle having the base longer than a width of the pouring channel, inserting the vertical angle into the pouring channel from lower side thereof, sliding the assumed right triangle with both sides defining the vertical angle being kept in contact with the both inside lines of the seal portions 22 of the pouring portion.

When the pouch 125 for refill as designed above is filled with the content, degassed and sealed at a position of the upper heat seal portion 4, the pouch 125 has a self-standing ability, easiness of handling and good appearance.

In the pouch 125, since the both transit portions transiting from the inside line of the seal portion of the neck portion 14, 14' to that of the shoulder portion 15, 15', i.e., a base of the pouring channel, are shaped into curved lines X, X', an edge of the pouring channel is very smooth. Even if an internal pressure of the content is loaded on this transit portion, it does not cause rupture or stripping of the seal portion.

Accordingly, even if width of the seal portion 14, 14' of the neck portion is relatively narrow in comparison with that of the trunk seal portion 3, the sealing is steadied, thus preventing breakage of the pouch.

When the content of the pouch 125 is poured into another container, such as bottle, the end portion of the pouring portion 6 can be easily torn from the notch 9 along the cut line 10, thus opening the pouring portion 6.

Since a position of the cut line 10 is set in the above described manner, a cross point of the bent lines (wrinkles) extending from the base of the pouring portion toward the upper end of the pouring portion is formed on the cut line 10 or at a position upper than the cut line 10. Accordingly, when the upper portion of the pouring portion 6 is cut out along the cut line 10, a position upper than the cross point where choking of the pouring portion occurs can be cut off. As the result, the opening can spontaneously expand with an excellent configuration-keeping ability, and the opening can be prevented from spontaneously closing during the pouring action.

The pouch 125 of FIG. 35 is particularly characterized in that each of the inside lines 14, 14' of the seal portions defining the neck portion is shaped into an upward protrusive arc having a different diameter. Such a design is very suitable to a construction of the pouring portion for a liquid content. When angle or direction of the cut line 10 comes near vertical with respect to a widthwise direction of the pouch, an upper side 14' of the neck portion can be made long, thereby facilitating that a pouring direction is controlled downward. On the other hand, when angle or direction of the cut line 10 comes near horizontal, a lower side 14 of the neck portion can be made long, and accordingly the pouring portion 6 can be shaped into a long gutter-like form. Therefore, the angle of the cut line 10 can be optionally set in consideration of physical properties of the content such as fluidity as far as the position of the cut line 10 is set-so as to pass over one point on the above described trace or a position closer to a center of the pouch than at least one point on the trace.

The pouch 125 of FIG. 35 can also be provided with the bulge portions Z and Z' similarly to the pouch 124 of FIG. 34.

The content of the pouch 125 can be poured into another container, such as bottle, in such manner that the trunk portion of the pouch 125 is supported by hand, the pouch 125 is tilted, the cut off portion 7*a* or 7*b* is put to an edge of the opening of the container, and then the opened pouring portion 6 is put into the opening of the container. According to this manner, steadiness of the pouring portion to the opening of another container is improved, and the choking of the pouring portion 6 to be caused by the internal pressure can be prevented during the poring operation, thus making it possible that the content is safely and easily poured into another container until pouring is completely finished.

As described above, according to the third aspect of the first invention, it is not necessary for production of the pouch to separately form a molded poring parts, it is possible to produce the pouch at a good productivity as well as a low cost through a process similarly to that applicable to an ordinary pouch, and it is possible to secure a good steadiness in heat sealing of the pouring portion and a good applicability to a filling machine. When the pouch of the third aspect is formed into a self-standing pouch and filled with the content followed by sealing up, the pouch is excellent in a self-standing ability, a configuration-keeping ability and appearance. In an opening operation, an end part of a pouring portion formed at a corner of an upper position of the pouch can be easily cut out, thereby forming an opening excellent in an expanding ability and a configuration-keeping ability. Further, the opened pouring portion can be prevented from spontaneously closing during the pouring operation. Thus, the content can be safely and easily poured into even a container having a small opening without spill until pouring is completely finished.

A fourth aspect of the first invention will be explained hereinafter. FIGS. 36, 37, 38, 39, and 40 are plan views showing pouches (126, 127, 128, 129 and 130) for refill respectively, which are preferable embodiments concerned with the fourth aspect of the first invention.

Figure 36:
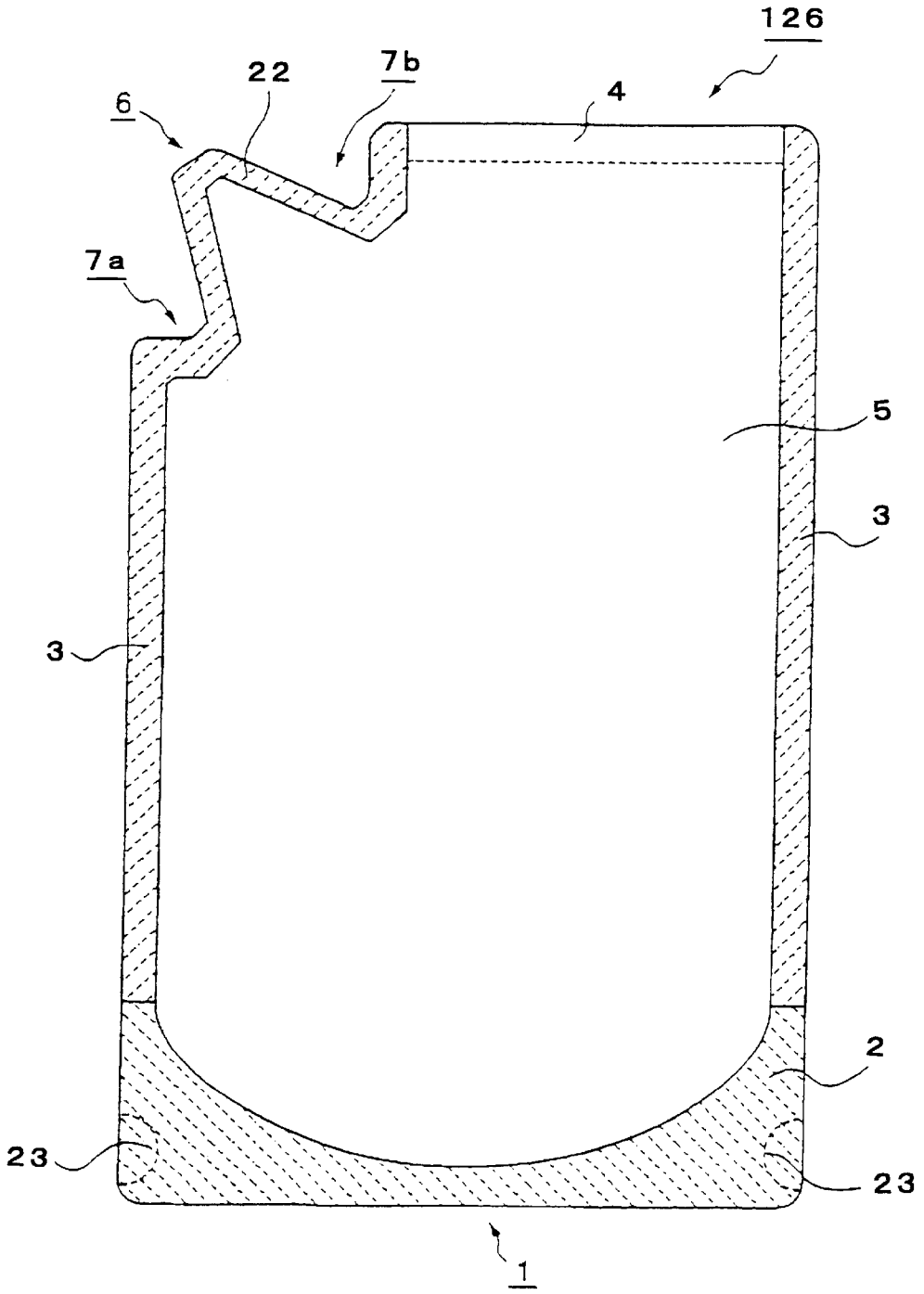
FIG. 36 is a plan view showing a pouch(126), which is one embodiment concerned with the fourth aspect of the first invention.

In FIG. 36, a trunk portion of the pouch 126 is formed into a self-standing pouch. A bottom portion 1 is formed in the ordinary manner, in which a film for the bottom portion is folded and positioned between two flat films so as to make gusset form protruding toward the inside of the pouch, and semicircular cut off portions 23 are formed at vicinity of lower end on both sides of the film for the bottom portion, and the film for the bottom portion is heat sealed in a boat-like shape to form a bottom heat seal portion 2. The two flat films forming a front and a rear walls are in directly contact with each other at the semicircular cut off portion 23 and bonded together at those positions by heat sealing. The trunk portion of the pouch 126 is formed by heat sealing two films constituting two flat portions 5, i.e., a front and a rear walls, at both side ends to form trunk heat seal portions 3.

A pouring portion 6 is formed at an upper corner of the pouch 126 so as to protrude in an obliquely upward direction. A peripheral portion of the pouring portion 6 is defined by heat sealing, and cut off portions 7*a*, 7*b* are formed at both sides of the pouring portion 6 by trimming.

Both side lines of the pouring portion 6 are at an acute angle with each other, and they are extending straight from an upper end to a downward direction with a distance between the both side lines getting widened, thereby shaping the pouring portion 6 into a reversed V-shape. It is preferable to control the acute angle between the side lines of the pouring portion 6 within the range of 40° to 70°. As to the cut off portions 7*a* and 7*b*, the cut off portions 7*a* of one side (at left side in FIG. 36) is defined by one side line of the pouring portion 6 extending straight and the other straight line extending from a lower end of this side line to one side of the pouch, and these two straight lines are at an acute angle with each other, thereby shaping the cut off portions 7*a* into a V-shape. On the other hand, the cut off portions 7*b* of the other side (at right side in FIG. 36) is defined by the other side line of the pouring portion 6 also extending straight and the other straight line extending from a lower end of this side line to an upper side of the pouch, and these two straight lines are also at an acute angle with each other, thereby shaping the cut off portions 7*b* into a V-shape.

In FIG. 36, an upper end of the pouch 126 is left non sealed except a position of the pouring portion 6, and the content is filled into the pouch 126 through this upper end, and thereafter the upper end is sealed up by heat sealing such as degas sealing to form an upper heat seal portion 4.

When the pouch 126 for refill as designed above is filled with the content, degassed and sealed at a position of the upper heat seal portion 4, the pouch 126 has a self-standing ability, easiness of handling and good appearance. When the pouch 126 is opened by cutting out the end part of the pouring portion 6 in order to pour the content of the pouch into another container, the air enters a head space present in an upper area of the pouch, and simultaneously the pouch 126 is more expanded to an outward direction of the pouch by volume and weight of the content, and further the pouring portion 6 is also expanded in a conical shape because both sides of the pouring portion 6 are cut out in reversed V-shapes.

The content of the thus opened pouch 126 can be poured out by taking up the pouch, putting the pouring portion 6 into an opening of a bottle or the like, and then tilting the pouch In this operation, the content is flowed to the pouring portion of the tilted pouch, and the opened pouring portion 6 is expanded in a conical- or funnel-shape, thereby pouring out the content. Since each of the cut off portions 7*a*, 7*b* present on the side of the pouring portion 6 has the reversed V-shape in which two cut lines extends straight to meet at an acute angle at a lower position on the side of the pouring portion, an conical expansion which is a little small but similar to the pouring portion 6 is formed by the internal pressure of the content at each side of the pouring portion, namely a position between the pouring portion 6 and an upper end on the side of the pouch and a position between the pouring portion 6 and the top of the pouch. In addition, a valley-like portions (depressed portion) are simultaneously formed between the expanded portions, and they are elongated from an end tip of the cut off portions 7*a*, 7*b* toward the center of the pouch, thereby more elongating and sharpening the conical expansion of the pouring portion 6.

As the result, the opening of the pouring portion can be steadied and improved in a configuration-keeping ability, and accordingly the pouring portion 6 can be prevented from being closed or choked during the opening operation. Besides, since the pouring portion 6 can be supported on an opening of the bottle by putting the cut off portion 7*a* or 7*b* on an edge of the bottle, the pouring portion is not liable to come off the opening of the bottle.

Figure 37:
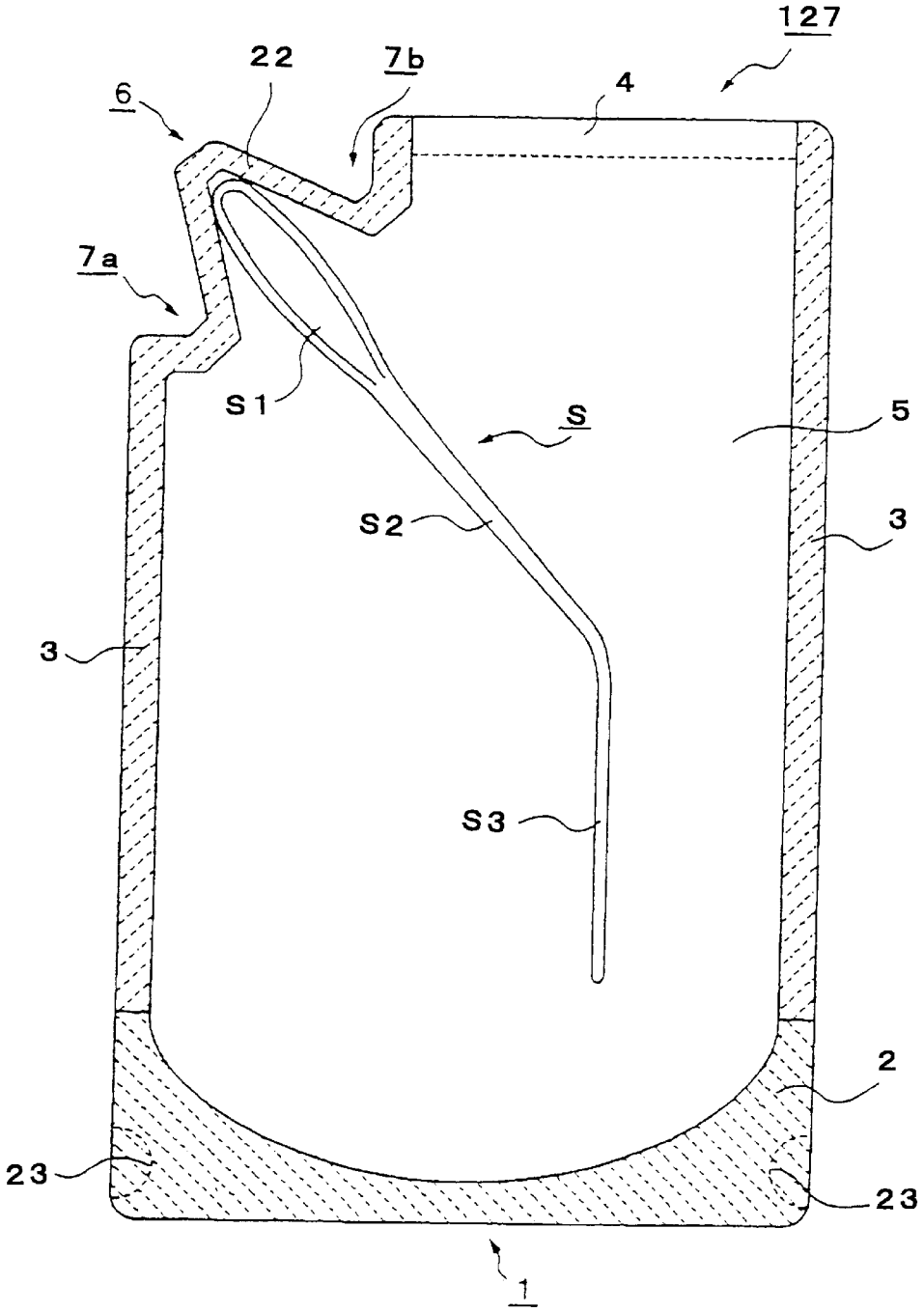
FIG. 37 is a plan view showing a pouch(127), which is another embodiment concerned with the fourth aspect of the first invention.

FIG. 37 is a plan view showing a pouch(127), which is a second embodiment concerned with the fourth aspect of the first invention.

The pouch 127 of FIG. 37 is the same as the pouch 126 of FIG. 36 except that at least one wall portion 5 is partially molded to form a bulge portion S in which the bulge portion S protrudes to an outward direction of the pouch, and has a hollow structure, and extends on the wall portion from vicinity of the pouring portion, via vicinity of the center of the pouch, and toward a diagonally lower corner of the pouch, and width and height of the bulge portion S are set so as to be large at vicinity (S1) of the pouring portion 6, gradually reduce along the obliquely downward direction (S2), and keep constant at a lower part (S3).

Surfaces of a top and both sides of the bulge portion S, in particular, at least those of the upper part S1 present in an upper area of the pouch including the pouring portion, are made flat, and then a cross section obtained when the bulge portion is cut in parallel with a protrusive direction of the bulge portion is made trapezoidal.

When the part S1 of the bulge portion which is liable to be deformed by external forces such as a pushing load because of its large width and height is formed into the above described shape, the part S1 can be strengthened, thereby improving the bulge portion S in a configuration keeping ability.

When the pouch 127 designed as described above is filled with the content, the pouch is bent to outward direction of the pouch along the parts S2 and S3 of the bulge portion by volume and weight of the content, and parts S2 and S3 of the bulge portion further provides rib effect, thereby improving the pouch 127 in a steadiness of configuration and appearance.

The pouring portion 6 can be made to simultaneously open with its configuration kept well by cutting off the upper end part of the pouring portion 6.

The content can be poured from the opened pouch 127 by taking up the pouch, putting the pouring portion 6 into the opening of the bottle, and then tilting the pouch. In this operation, the pouch is expanded by bending effect of the part S2 of the bulge portion, and the shapes of the pouring portion 6 and the cut off portions 7*a*, 7*b* associate with the effect of the bulge portion. Accordingly, the content can be flowed to the pouring portion 6 more smoothly, and the conical expansion of the pouring portion 6 can be more steadied, thereby making the pouring of content more smooth.

Since the parts S2 and S3 of the bulge portion also serves as a non skid, the pouch can be easily taken by hand, then making the pouring of content more easy.

The bulge portion S may be provided to only one wall portion. However, when the bulge portion S are formed at the same position of each wall portion with a symmetrical relationship so as to superpose the bulge portion onto those of the other wall, the bulge portion can be more improved in a spontaneous opening of the pouring portion and a configuration-keeping ability of the pouch itself.

Figure 38:
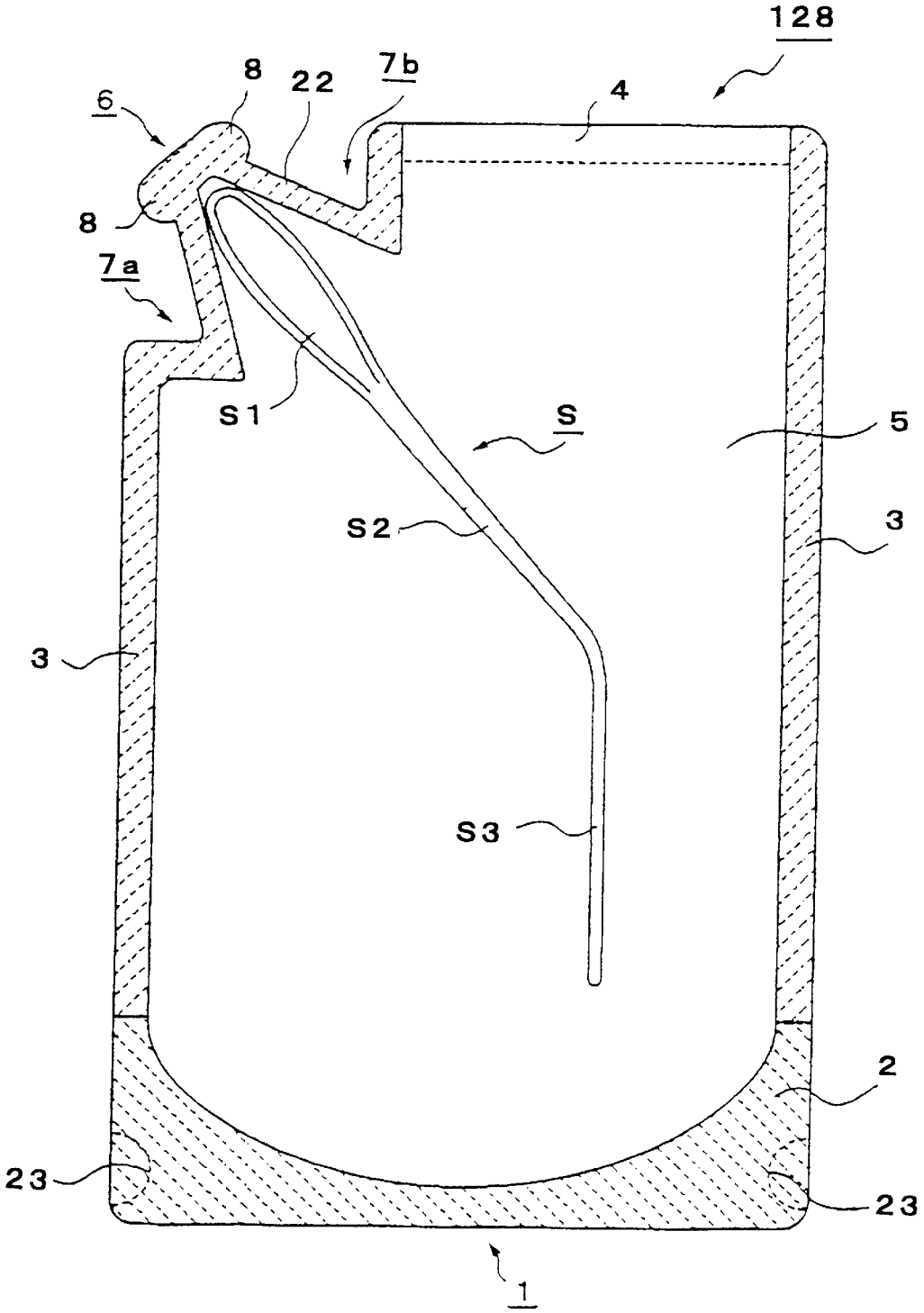
FIG. 38 is a plan view showing a pouch(128), which is still another embodiment concerned with the fourth aspect of the first invention.

FIG. 38 is a plan view showing a pouch(128), which is a third embodiment concerned with the fourth aspect of the first invention.

The pouch 128 of FIG. 38 is the same as the pouch 127 of FIG. 37 except that the cut off portions 7*a*, 7*b* of the both sides of the pouring portion are made more deep, and at the seal portion 22 of the pouring portion is also shaped into a more deep V-shape at the same position as the deepest position of the cut off portions, and the heat seal portion of the upper end part of the pouring portion 6 is widened to a widthwise direction of the pouring portion to form pinch portions 8 at both sides.

In such a design, the conical expansion of the pouring portion 6 is made more large and sharp at the pouring operation, thereby more improving an expanding ability of the pouring portion and a configuration-keeping ability of the same.

Besides, the opening operation of the pouch 128 is very easy because of the pinch portions 8.

Figure 39:
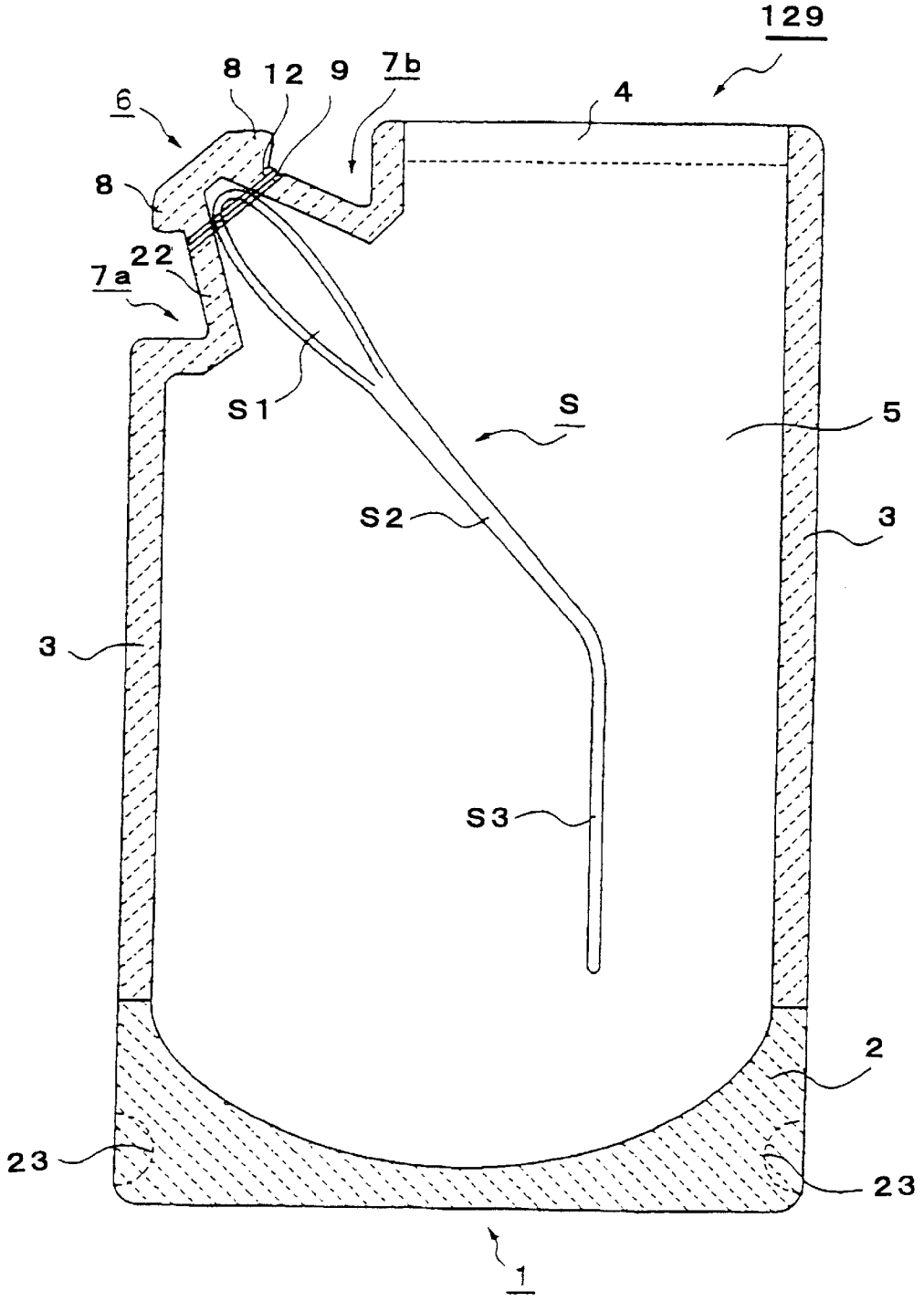
FIG. 39 is a plan view showing a pouch(129), which is still another embodiment concerned with the fourth aspect of the first invention.

FIG. 39 is a plan view showing a pouch(129), which is a fourth embodiment concerned with the fourth aspect of the first invention.

The pouch 129 of FIG. 39 is the same as the pouch 128 of FIG. 38 except that shapes of the pinch portions and the seal portions present at the lower portions of both sides of the pouring portion 6 are changed, and a notch 9 and three half-cut lines 12 as opening aids are formed at vicinity of the upper end part of the pouring portion 6.

In such a design, the pouch 129 does not require cutting means such as scissors for opening operation. The pouch 129 can be easily opened by hand, and tearing starts from the notch 9 and goes along the half-cut line.

Figure 40:
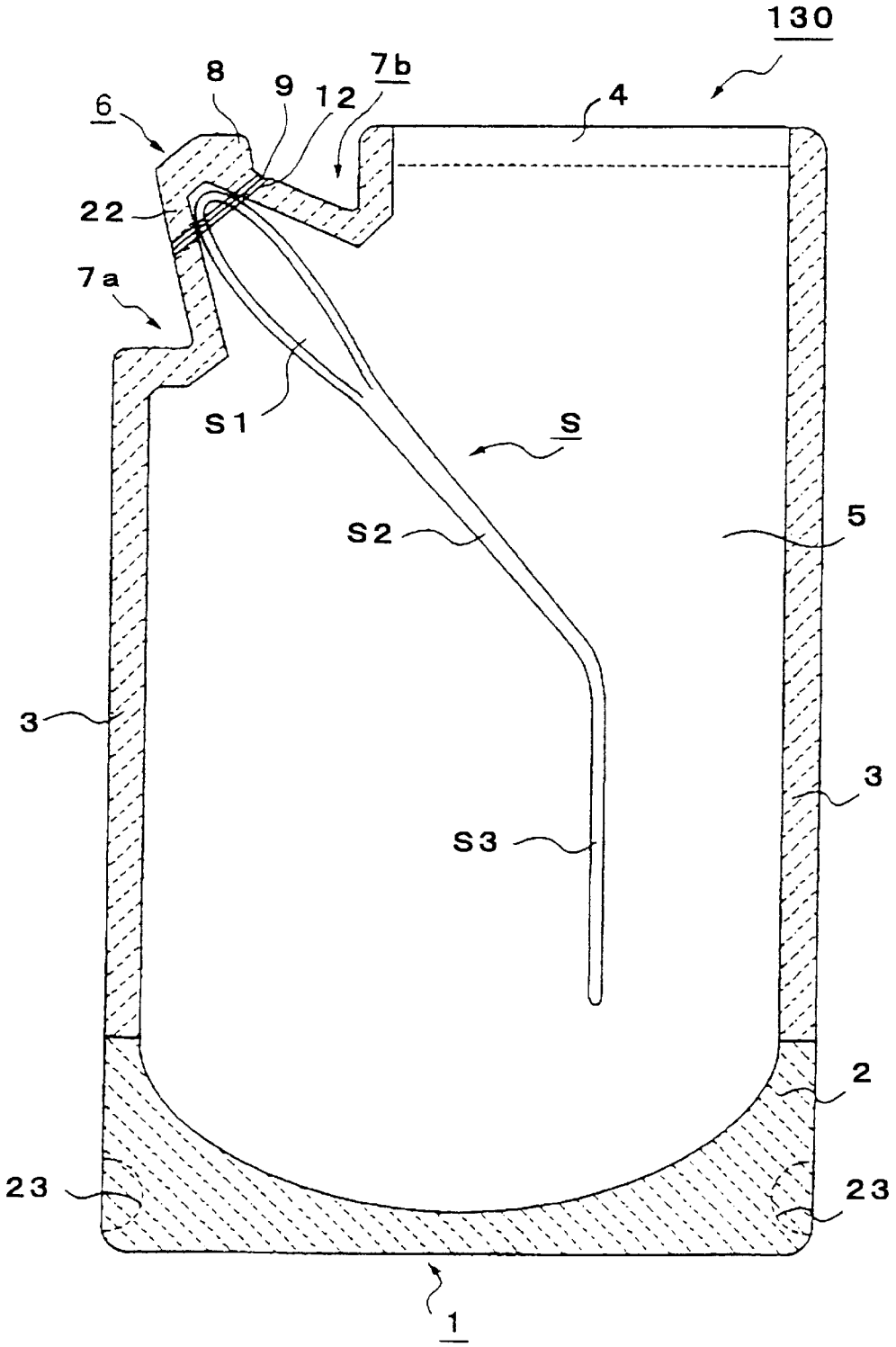
FIG. 40 is a plan view showing a pouch(130), which is still another embodiment concerned with the fourth aspect of the first invention.

FIG. 40 is a plan view showing a pouch(130), which is a fifth embodiment concerned with the fourth aspect of the first invention.

The pouch 130 of FIG. 40 is the same as the pouch 129 of FIG. 39 except that the pinch portion 8 is formed at only one side (right side in FIG. 40) of the upper end part of the pouring portion 6. In such a design, the pouch 130 can provide the same effect as that of the pouch 129 of FIG. 39.

As described above, according to the fourth aspect of the first invention, it is not necessary for production of the pouch to separately form a molded poring parts, it is possible to produce the pouch at a good productivity as well as a low cost through a process similarly to that applicable to an ordinary pouch. The pouch can be easily filled with the content, and the thus filled and sealed pouch is excellent in a self-standing ability, a configuration-keeping ability and appearance. In an opening operation, an end part of a pouring portion formed at a corner of an upper position of the pouch can be easily cut out, thereby forming an opening excellent in an expanding ability and a configuration-keeping ability. Even if a viscous content is stored in the pouch, the content is smoothly flowed to the pouring portion, and smoothly poured out from the opening of the pouring portion without spontaneously closing of the pouring portion. Thus, the content can be safely and easily poured into even a container having a small opening without spill until pouring is completely finished.

Figure 41:
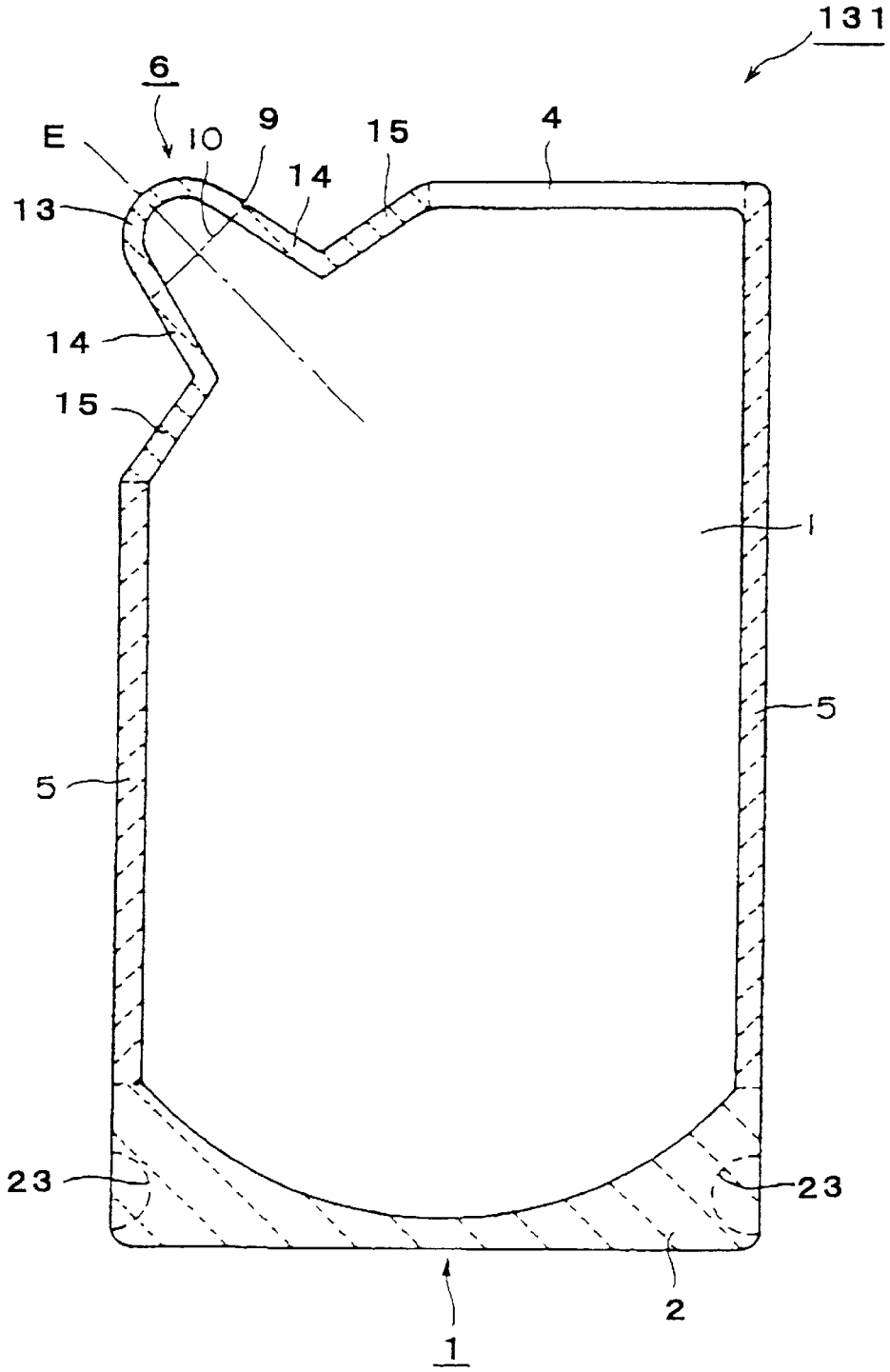
FIG. 41 is a plan view showing a pouch(131), which is one embodiment concerned with the fifth aspect of the first invention.

A fifth aspect of the first invention will be explained hereinafter. FIG. 41 is a plan view showing a pouch(131), which is one embodiment concerned with the fifth aspect of the first invention.

In FIG. 41, a trunk portion of the pouch 131 is formed into a self-standing pouch. A bottom portion 1 is formed in the ordinary manner, in which a film for the bottom portion is folded and positioned between two flat films so as to make gusset form protruding toward the inside of the pouch, and semicircular cut off portions 23 are formed at vicinity of lower end on both sides of the film for the bottom portion, and the film for the bottom portion is heat sealed in a boat-like shape to form a bottom heat seal portion 2. The two flat films forming a front and a rear walls are in directly contact with each other at the semicircular cut off portion 23 and bonded together at those positions by heat sealing. The trunk portion of the pouch 131 is formed by heat sealing two films constituting two flat portions 5, i.e., a front and a rear walls, at both side ends to form trunk heat seal portions.

A pouring portion 6 is formed at an upper corner of the pouch 131 so as to protrude in an obliquely upward direction. A peripheral portion of the pouring portion 6 is defined by heat sealing and trimming, thereby forming an upper portion 13, a neck portion 14 and a shoulder portion 15 starting from a lower end of the neck portion 14. A cut line 10 is disposed at an upper end part of the pouring portion in order to indicate a opening position, and a V-shaped notch 9 as an opening aid is formed at one end of the cut line 10.

This embodiment is characteristic in that the two seal portions defining the both sides of the neck portion and the shoulder portion are formed so as to taper off the pouring portion to its upper end with two-stage changing of slant with a symmetrical relationship with respect to the axis of the pouring portion, and the corner connecting the neck portion 14 with the shoulder portion 15 is not curved but shaped into a broken line.

An upper end of the pouch 131 is left non sealed except a position of the pouring portion 6, and the content is filled into the pouch 131 through this upper end, and thereafter the upper end is sealed up by heat sealing such as degas sealing to form an upper heat seal portion 4.

When the pouch 131 for refill as designed above is filled with the content, degassed and sealed at a position of the upper heat seal portion 4, the pouch 131 has a self-standing ability, easiness of handling and good appearance.

When the content of the pouch 131 is poured into another container, such as bottle, the end part of the pouring portion 6 can be easily torn from the notch 9 along the cut line 10 by fingers, thus opening the pouring portion 6.

In the pouch 131, since both sides of the pouring portion 6 is tapered off to its upper end with two-stage changing of slant by the broken line, the seal portion has no narrowed part, thus securing a certain width of the seal portion. In addition, since the seal portion of the neck portion 14 and that of the shoulder portion 15 are shaped into straight lines, and a portion changing the slant is shaped into the broken line, the pouring portion can be made narrow to a base of the neck portion in comparison with the case that the portion changing the slant is shaped into the curved line. Accordingly, the neck portion 14 can be entirely put into the opening of the bottle or the like, and the pouring portion 6 can be improved in a steadiness to the opening of the bottle.

The content of the pouch 131 is flowed to the pouring portion by tilting the pouch to a side provided with the pouring portion, and then the opened poring portion is easily expanded in a funnel-shape by the internal pressure of the pouch, thereby starting the pouring.

Since the opening expanded in a funnel-shape has a good configuration-keeping ability, this opening does not spontaneously close during the pouring operation, and the content can be safely and easily poured into even a container having a small opening without spill until pouring is completely finished.

As described above, according to the fifth aspect of the first invention, it is not necessary for production of the pouch to separately form a molded poring parts, it is possible to produce the pouch at a good productivity as well as a low cost through a process similarly to that applicable to an ordinary pouch. The pouch can be easily filled with the content, and the thus filled and sealed pouch is excellent in a self-standing ability, handling, a configuration-keeping ability and appearance. In an opening operation, an end part of a pouring portion formed at a corner of an upper position of the pouch can be easily cut out, thereby forming an opening. The pouring portion can be deeply put into even a narrow opening of the container such as a bottle, and the opening of the pouring portion can be expanded in a funnel-shape with a good configuration kept, and a spontaneous closing or choking of the pouring portion is not caused during the pouring operation. Thus, the content can be safely and easily poured into without spill until pouring is completely finished.

The pouch of the present invention may be formed from any flexible film, and material of the film is not restricted to specific ones. A laminate film formed mainly of plastic is usually used for production of the pouch, and it is possible for the pouch of the present invention to use laminate films known as a material of the conventional pouch storing a liquid content. A suitable film may be optionally selected among such a known films in consideration of conditions such as, kind of a content to be stored, adoption or elimination of a heat treatment after filling or the like.

Representative examples of preferable lamination films are enumerated below. In the following examples, "ON film" means as a biaxial oriented nylon film, "L-LDPE" means as linear low density polyethylene, "HDPE" means as high density polyethylene, "LDPE" means as low density polyethylene, "PP film" means as a polypropylene film, "PET film" means as a biaxial oriented polyethylene terephthalate film, "EVOH film" means as a saponified ethylene-vinyl acetate copolymer film, and "CPP film" means as a non oriented polypropylene film.

An anchor coat is one kind of primer coatings, which is coated on a substrate film in order to improve adhesion before a resin is laminated on the substrate film by extrusion coating.

(1) ON film/adhesive/L-LDPE film(as a sealant)
(2) ON film/adhesive/uniaxial oriented HDPE film/adhesive/L-LDPE film(as a sealant)
(3) ON film/adhesive/uniaxial oriented PP film/adhesive/L-LDPE film(as a sealant)
(4) ON film/adhesive/uniaxial oriented PP film/adhesive/aluminum foil/adhesive/L-LDPE film(as a sealant)
(5) ON film(having a vapor deposited silica layer)/adhesive/uniaxial oriented HDPE film/adhesive/L-LDPE film(as a sealant)
(6) ON film/anchor coat layer/co-extrusion coating layer (HDPE layer/LDPE layer) in which the L-LDPE layer is the sealant layer
(7) ON film/anchor coat layer/co-extrusion coating layer (HDPE layer/LDPE layer)/adhesive/L-LDPE film(as a sealant)
(8) PET film/adhesive/aluminum foil/adhesive/ON film/adhesive/L-LDPE film(as a sealant)
(9) PET film/adhesive/aluminum foil/adhesive/ON film/adhesive/CPP film(as a sealant)
(10) PET film/adhesive/ON film/adhesive/aluminum foil/adhesive/L-LDPE film(as a sealant)
(11) PET film/adhesive/ON film/adhesive/aluminum foil/adhesive/CPP film(as a sealant)
(12) PET film/adhesive/EVOH film/adhesive/ON film/adhesive/CPP film(as a sealant)

In the above examples, the ON film and PET film are used as a substrate film in order to impart mechanical strength or fitness to be printed to the pouch. The uniaxial oriented HDPE film and the uniaxial oriented PP film are used in such manner that its oriented direction is aligned with a tearing direction to open the pouring portion of the pouch as exactly as possible, thereby more steadying the tearing direction.

The aluminum foil, the vapor deposited silica layer and EVOH film are laminated in order to impart gas barrier property to the pouch.

The L-LDPE film and the CPP film are exemplified as the sealant layer. The L-LDPE film is excellent in a stability of heat sealed portion and a resistance to the content, and for example, it shows an excellent resistance to stress cracking which may be caused by a surface active agent. On the other hand, the CPP film is excellent in heat resistance and a low odor, and it is suitably used to store a content requiring such property of the lamination film.

As the sealant layer, there may be also used ethylene- α olefin copolymer, ethylene-vinyl acetate copolymer, ethylene-acrylic acid copolymer, ethylene-acrylic acid ester copolymer, ionomer, polyester resins or the like depending on a content to be stored.

In particular, since the ethylene- α olefin copolymer obtained through polymerization process using a single site catalyst such as a metallocene catalyst is narrow in molecular distribution and steadied in copolymerization ratio, it is excellent in a performance of heat sealing at a low temperature and a performance of hot sealing. Accordingly, when such an ethylene- α olefin copolymer is used as the sealant for a pouch which has a difference in level at its heat seal portion due to overlapped films such as observed in the self-standing pouch, a pinhole which may be caused by partially lacking of the heat sealing can be prevented, thus being preferable.

Further, when an olefin elastomer is blended into the above mentioned copolymer to use as the sealant, the sealant can be improved in flow property at a high temperature, and thus the pinhole to be caused by the difference in level of the seal portion can be more prevented.

Next, a process for producing the pouch of the present invention will be explained hereinafter.

A trunk portion of the pouch of the present invention may be formed into any style, such as three-side sealed form, four-side sealed form or the like, and preferably formed into a self-standing pouch. The pouch can be easily produced by means of a pouch-producing machine adaptable to the style of the aimed pouch. The pouch-producing machine may be provided with various working mechanisms such as a trimming device, a punching device, a heat sealing device, a laser beam irradiating device and another device for additional working, and it can deal with plural work such as formation of the pouring portion, the cut off portion present at a side of the pouring portion, the opening aid including the notch and the half-cut line, the bulge portion to be extended on the wall portion of the pouch in a curved form, or the like. Individual mechanisms or functions required by the process, for example an embossing device, may be incorporated into an inline or separated as an off line.

Though height of the bulge portion to be formed on the wall portion is not restricted in a specific range, it is preferable that the bulge portion at the vicinity of the pouring portion has a height in a range of about 1.0 to 7.0 mm, and more preferably about 2.0 to 5.0 mm. With a height lower than 1.0 mm, improvement in an expanding ability of the opening may be insufficient. With a height larger than 7.0 mm, it is not necessary to make the bulge portion so high, and a working to form the bulge portion becomes difficult, and further the bulge portion becomes bulky to deteriorate a handling of the empty pouch and a fitness to stacking operation in a filling and sealing machine, thus being undesirable.

As to height of the bulge portion at a position other than vicinity of the pouring portion, a preferable range is as follows.

In the second and third preferable embodiments of the first aspect of the first invention, it is preferable that an area of the bulge portion from vicinity of the pouring portion to the middle part which is tapering off to an obliquely downward direction is inclined so as to reduce height of the bulge portion to about 1.8 to 0.5 mm.

In the fourth preferable embodiment of the first aspect of the first invention, it is preferable that an area of the bulge portion from vicinity of the pouring portion to the middle part which is tapering off to an obliquely downward direction is inclined so as to reduce height of the bulge portion to about 2.0 to 0.8 mm. Particularly, it is more preferable for the fourth preferable embodiment that the bulge portion at the lower part has dimensions capable of shaping its cross section into trapezoidal shape in which a width of a base position at which the standing face begins is 3.0 to 4.0 mm, a width of the top face is 1.0 to 2.5 mm, and a height is 1.5 to 2.0 mm.

In the fifth preferable embodiment of the first aspect of the first invention, it is preferable that the bulge portion at a tailing part is the same as the above described lower part of the bulge portion. That is, a preferable tailing position has dimensions capable of shaping its cross section into trapezoidal shape in which a width of a base position at which the standing face begins is 3.0 to 4.0 mm, a width of the top face is 1.0 to 2.5 mm, and a height is 1.5 to 2.0 mm.

The opening aid can be formed to the pouring portion in order to facilitate an opening operation. The notch is the most common as the opening aid. As another opening aids, there may be exemplified a half-cut line formed by irradiation of the laser beam or the like, and an uniaxial oriented film constituting one layer of the lamination film with its oriented direction being aligned with a tearing direction of the pouch. An individual opening aid may be used singly or directed to the combination use. For example, the notch can be combined with the half-cut line or the lamination of the uniaxial oriented film.

The half-cut line may be shaped into a continuous straight line or a discontinuous line such as a scored line.

Tough number of the half-cut line may be only one, plural half-cut line can be formed in such manner that one or more half-cut lines are additionally formed at each side of the center half-cut line in parallel with the center half-cut line in order to care about that the half-cut line may get off the intended tearing direction.

In particular, since the pouch of the present invention is provided with the bulge portion which is usually positioned at an opening position of the pouring portion, an actual torn direction is liable to get off the intended tearing direction. Accordingly, it is preferable to use plural opening aids in combination with each other.

Shape of the notch is not restricted to I-shaped, V-shaped or the like, the notch may be take any shape as far as that shape has an acute angle facing toward the tearing direction.

When the pouch provided with the above described opening aid is opened, any cutting means such as scissors is not necessary, and the end part of the pouring portion can be easily cut off only by the hand to open the pouring portion.

In particular, the combination use of the notch and the half-cut line can easily and securely cut off the end part of the pouring portion at a position of the half-cut line to open the pouring portion, even when the pouring portion is provided with the bulge portion.

An usual pinch portion is formed at a side of the pouring portion so as to be positioned at an upper side of the opening aid by extending the heat seal portion of the same position.

In such a construction, when the pinch portion is pinched and pulled by fingers, the end portion of the pouring portion can be cut off owing to the opening aid, thus making the opening operation more easy.

The bulge portion can be formed on the film for the pouch by subjecting the film to, for example, a thermally embossing, a vacuum molding, a compressed air and vacuum molding. In particular, the thermally embossing process can exactly reproduce a fine pattern of the bulge portion, and also can form a bulge portion having a steadied configuration at a good productivity.

The followings are explanation about a method to form the bulge portion capable of improving the pouring portion of the pouch in a expanding ability and a configuration-keeping ability on the flexible film usable for the pouch, particularly the lamination film, so as to provide a steadied and optional configuration to the bulge portion, and in addition at a good productivity.

In the known art, a linearly molded portion is formed to the flexible film by a thermal pressing in which a heatable core or cavity piece and a rubber counterpart are took as a die, the flexible film is put between the core piece and the cavity piece, and then it is pressed.

The thermal pressing process is good in productivity, but in this process, a pressed or molded film is discharged from the die while it stood still heated, and then sink of molding becomes relatively large. Accordingly, it has been difficult for the thermal pressing process to carry out a precise molding according to the die, thus causing a problem.

This problem will get more serious when a film to be molded for the pouch is a lamination film having a construction in which a sealant layer is laminated on a substrate film comprising an oriented film, because such a lamination film is not always suitable for a molding process.

The bulge portion formed to the pouch of the present invention has a three dimensional and hollow shape and it is protruding in an outward direction of the pouch, but the film for the pouch is flexible and it has a relatively small stiffness. Accordingly, when the bulge portion is subjected to a pushing load caused by, for example, an own weight of stacked pouches, the bulge portion is liable to be collapsed. Therefore, the bulge portion is desired to have a configuration which can strongly resist against the pushing load and easily return to the original configuration even if it is once collapsed.

Taking the above described desire into account, it is preferable to define a top and sides of the bulge portion by flat faces. That is, it is preferable that a cross section obtained when the bulge portion is cut out in parallel with its protrusive direction is shaped into a trapezoidal form or a shape in which plural trapezoids are stacked so as to position a smaller trapezoid on a larger trapezoid. Since such a configuration has one or more steps different in height, and linear corners are formed at boundaries of the flat faces defining the steps, rib effect of the bulge portion is strengthened, thereby improving a resistance to the pushing load and a restoration ability from collapse.

However, when the bulge portion is formed to the film for the pouch by such a conventional thermal pressing process, the bulge portion of the pressed film is discharged from the die while it stood still heated, and then sink of molding becomes relatively large. Accordingly, boundaries between the flat faces defining the bulge portion is shaped into round corners to deteriorate the rib effect, thereby making benefit of the bulge portion insufficient.

To the contrary, the present invention also provides a preferable method in order to produce the film for the pouch. According to the method of the present invention described below, even when the bulge portion is formed to such a lamination film as not suitable for being molded, it is possible to form the bulge portion having a shape which is very similar to a desired shape and excellent in its configuration-keeping ability at a good productivity.

Figure 21:
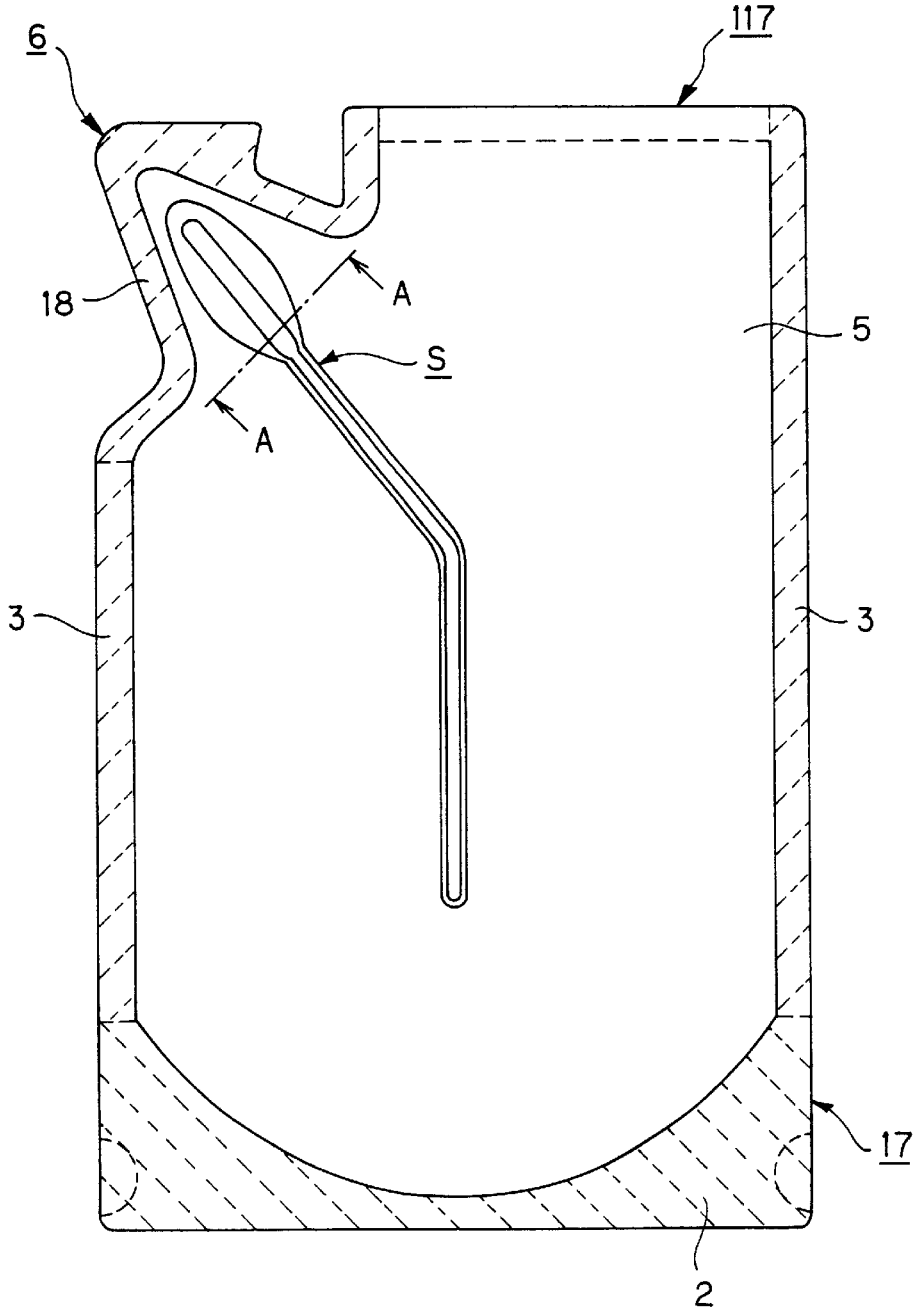
FIG. 21 is a plan view showing a pouch(117), which is one example obtainable by adapting the method of producing a film for pouch.

FIG. 21 is a plan view showing a pouch(117) for refill, which is one example obtainable by adapting the method of producing a film for pouch. The method of the present invention can be preferably adapted to formation of such a bulge portion as formed to the pouch 117.

A trunk portion of the pouch 117 of FIG. 21 is formed into a self-standing pouch. A bottom portion 1 is formed in the ordinary manner, in which a film for the bottom portion is folded and positioned between two flat films (lamination films) so as to make gusset form (17) protruding toward the inside of the pouch, and semicircular cut off portions are formed at vicinity of lower end on both sides of the film for the bottom portion, and the film for the bottom portion is heat sealed in a boat-like shape to form a bottom heat seal portion 2. The two flat films (lamination films) forming a front and a rear walls 5 are in directly contact with each other at the semicircular cut off portion and bonded together at those positions by heat sealing. The trunk portion of the pouch 117 is formed by heat sealing two films constituting two flat portions 5, i.e., a front and a rear walls, at both side ends to form trunk heat seal portions 3.

A pouring portion 6 is formed at an upper corner of the pouch 117. Peripheral portion of the pouring portion 6 is heat sealed so as to form a narrow pouring channel passing through the pouring portion, and both sides of the pouring portion 6 are cut off so as to form cut off portions 7*a*, 7*b*, thereby making the pouring portion 6 protrude in an obliquely upward direction. The lamination film forming at least one wall portion 5 of the pouch 117 is provided with a bulge portion S which has a shape shown in FIG. 21 and extends from vicinity of the pouring portion, via vicinity of a center of the pouch, and to a lower area of the pouch.

It is preferable that the bulge portion S is formed before the films are converted into the pouch, more specifically before forming the trunk heat seal portions 3. As to a configuration of the bulge portion, a cross section obtainable when the bulge portion is cut out along a line A—A may be shaped into those of FIG. 22A, FIG. 22B, FIG. 23A or FIG. 23B.

Figure 22A:
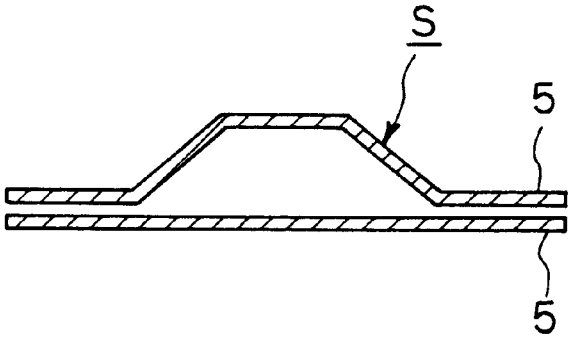
FIG. 22A and the FIG. 22B is an enlarged sectional view showing one example of a A—A cross section of the bulge portion of the pouch 117 in FIG. 21.
Figure 22B:
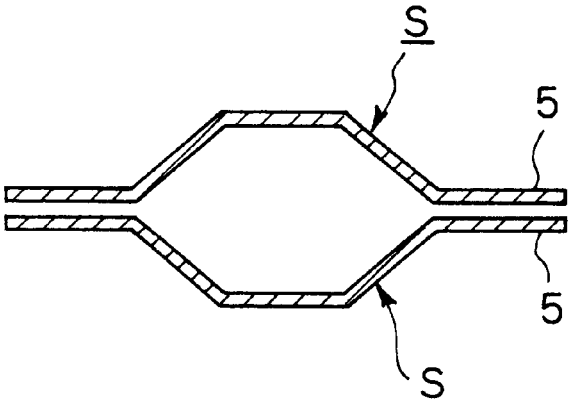

That is, each of the FIG. 22A and the FIG. 22B is an enlarged sectional view showing one example of a cross section obtainable by cutting out the bulge portion S of the pouch 117 in FIG. 21 along the line A—A. More specifically, FIG. 22A is an enlarged sectional view of an A—A section obtainable in a case where the bulge portion is disposed only on the front wall portion 5, and. FIG. 22B is an enlarged sectional view of an A—A section obtainable in a case where the bulge portions are disposed on the both wall portions 5 so as to be symmetrically positioned.

In FIG. 22A and FIG. 22B, the A—A section of the bulge portion S has a trapezoidal shape. When the bulge portion S is shaped into such a configuration, resistance of the bulge portion can be strengthened against a pushing load attacking from the outside.

Figure 23A:
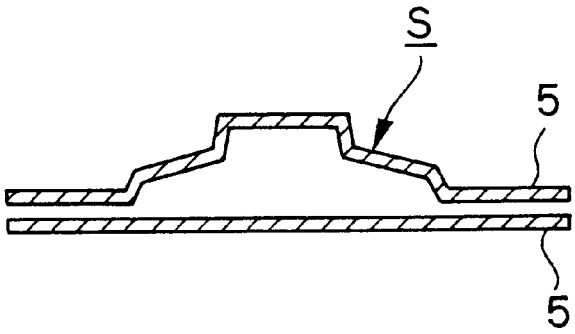
FIG. 23A and 23B are enlarged sectional views showing another example of a A—A cross section of the bulge portion of the pouch 117 in FIG. 21.
Figure 23B:
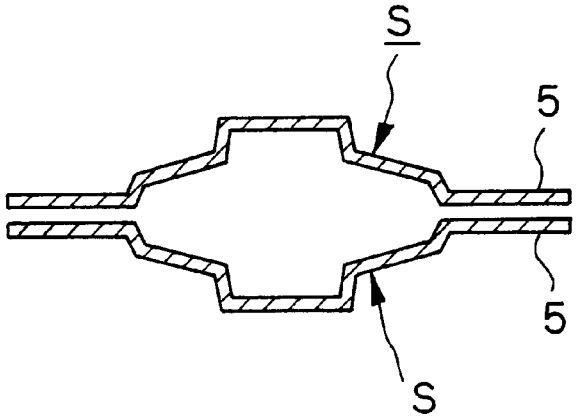

Each of the FIG. 23A and the FIG. 23B is also an enlarged sectional view showing one example of a cross section obtainable by cutting out the bulge portion S of the pouch 117 in FIG. 21 along the line A—A, but this exemplifies another configuration than FIGS. 22A and 22B. More specifically, FIG. 23A is an enlarged sectional view of an A—A section obtainable in a case where the bulge portion is disposed only on the front wall portion 5, and FIG. 23B is an enlarged sectional view of an A—A section obtainable in a case where the bulge portions are disposed on the both wall portions 5 so as to be symmetrically positioned.

In FIG. 23A and FIG. 23B, the bulge portion S has a shape obtainable by modifying the bulge portion of FIG. 22A and FIG. 22B, in which a first standing face is interposed between a side end of the top face and an upper end of the slant face, and a second standing face which is a little inclined is interposed between the lower end of the slant face and a base position of the flat portion per each side of the bulge portion S.

Thus, the A—A section shown in FIG. 23A and FIG. 23B has a shape in which plural trapezoids are stacked so as to position a smaller trapezoid on a larger trapezoid. When the bulge portion S is shaped into such a configuration, resistance of the bulge portion can be more strengthened against a pushing load, and in addition, a restoration ability from collapse can be improved.

In the pouch 117 of FIG. 21, it is preferable that the bulge portion at the vicinity of the pouring portion 6 has a height in a range of about 1.5 to 3.0 mm, and a tailing part of the bulge portion which is downward extending from a lower end of a head part of the bulge portion has a height in a range of about 0.7 to 1.5 mm.

Figure 24:
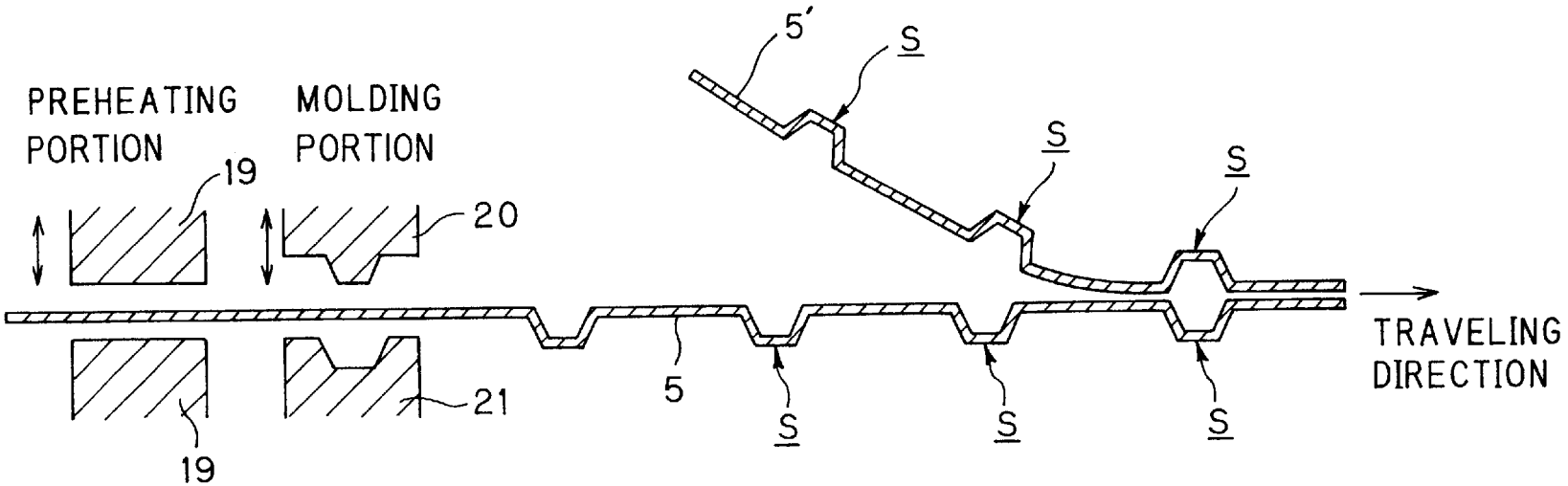
FIG. 24 is a schematic view illustrating one example of the method to produce the film for the pouch of the present invention.

FIG. 24 is a schematic view illustrating one example of the method to produce the film for the pouch of the present invention.

FIG. 24 shows a process to repeatedly form the bulge portions S to a continuous lamination film before the film is converted into the pouch. In this process, the lamination film 5 is made to travel forward along a processing line per a predetermined pitch by an intermittent action. The lamination film 5 is first carried to a preheating portion, and put between an upper and a lower preheating plates 19 which are heated at a temperature properly set within 60–110° C., and then heated. Next, the heated film is immediately carried to a molding portion, and it is pressed between the core 20 and the cavity 21 which are controlled so as to have a temperature in a range of 20 to 40° C. and simultaneously cooled in the die, and then a portion shaped into the bulge portion S is discharged from there.

When the bulge portion is formed to the both flat portions, the bulge portion S can be formed to the other film 5' by means of a second set (not shown in FIG. 24) of the preheating portion and the molding portion which is the same as the first set of those except that positions of core 20 and cavity 21 are converted to each other. The second set of the preheating portion and the molding portion can be mounted on an upper position of the first set of those. In such arrangement, the other film 5' provided with the bulge portion is discharged to meet with the film 5 which is also discharged from the first set of the preheating portion and the molding portion, thereby aligning the two bulge portions S with each other.

Since the thus matched lamination films 5 and 5' can be made to travel in a pouch forming process, it is possible to carry out a process for forming the bulge portion to the film on an in-line process together with the other process for converting the molded film into the pouch.

It is preferable to carry out a surface treatment in order to impart releasing ability to surfaces of the heating plate 19 and the core 20, in particular those with which sealant layers of the lamination films 5, 5' will come contact.

It is also preferable that a compressed air vent and/or a vacuum vent is provided to the core 20 and/or the cavity 21 in order to incorporating a compressed air operation and/or a vacuum operation with the press molding operation. It is more preferable that the compressed air vent and the vacuum vent are allotted to the core piece 20 and the cavity piece 21 in order to associate the compressed air operation and the vacuum operation with each other.

For example, when the vacuum operation is carried out at the cavity piece, and the compressed air operation is simultaneously carried out at the core piece, the lamination film is brought into a strongly close contact with the whole of the inside surface of the cavity piece 21, and thus the bulge portion having a shape very similar to an inside shape of the cavity piece 21 can be formed at a good productivity.

Furthermore, when a clearance having a depth the same as a thickness of the lamination films 5, 5' to be molded is provided to an inside space of the cavity piece 21, a mechanical force of the core piece 20 and the cavity piece 21 can be more properly utilized at the pressing operation, thereby forming the bulge portion more similar to the shape of the die.

Figure 25:
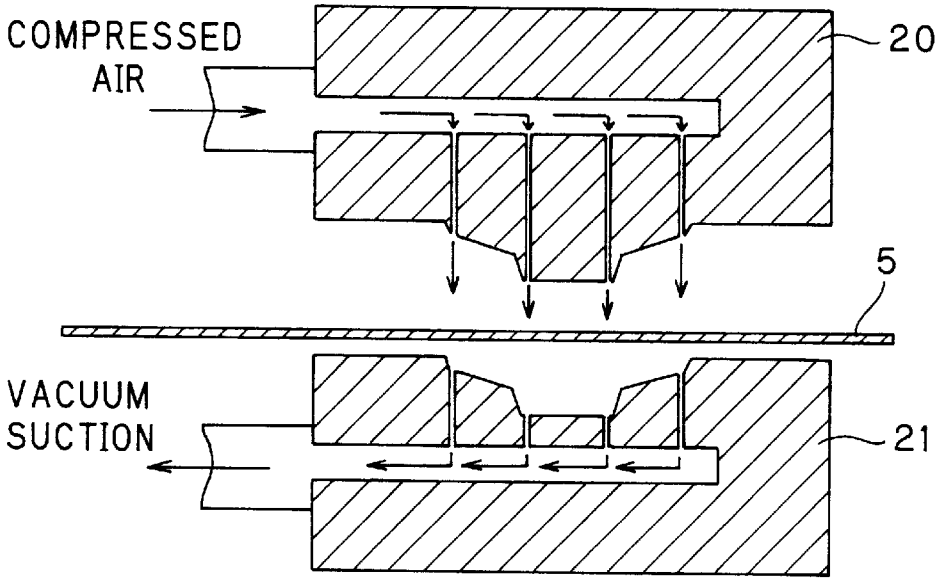
FIG. 25 is a schematic view illustrating one example of the molding operation.

FIG. 25 is a schematic view illustrating one example of the molding portion. In the molding portion shown in FIG. 25, the die comprises the core piece 20 and the cavity piece 21, and a protruding surface of the core piece and an inside surface of the cavity piece have a shape corresponding to that of the bulge portion to be provided for the film respectively. The compressed air vents are formed to the protruding surface of the core piece 20, and the vacuum vents are formed to the inside surface of the cavity piece 21. Each of the compressed air vents and the vacuum vents is formed at a proper position such as that corresponding vicinity of the corner portion of the bulge portion.

Since the die of FIG. 25 takes such a design, the compressed air operation can be carried out at the core piece 20, and the vacuum operation can be simultaneously carried out at the cavity piece 21 at the time of the press molding operation. In such a manner, since the compressed air operation and the vacuum suction are associated so as to be directed in the same direction indicating arrows in FIG. 25, the lamination film 5 can be brought into a strongly close contact with the inside surface of the cavity piece 21, thus forming the bulge portion very similar to the inside shape of the cavity piece 21.

Even the above described method of the present invention can not avoid somewhat of the sink in molding because of a low moldability of the lamination film itself, and for example, height of the bulge portion may a little reduce after the molding. However, since sinking rate of the molded film is steadied in this method, a bulge portion having a desired shape can be obtained by adjusting the inside shape of the die beforehand in consideration of the sinking rate.

Next, an easy open pouch according to a third invention will be explained hereinafter.

The easy open pouch of the present invention may be formed from a flexible film the same as usable for the pouch of the first invention. Though use of an uniaxial oriented film, an oriented direction of which is made in parallel with a tearing direction for the opening operation, does not provides so great benefit for the easy open pouch of the third invention because of a half-cut line positioned at an opening position, such an use is still advantageous to steadying of the tearing direction if the tearing operation is obstructed owing to conditions of the flexible film, such as thickness, layered structure or the like.

A trunk portion of the easy open pouch of the third invention may be formed into any style, such as three-side sealed form, four-side sealed form or the like, and preferably formed into a self-standing pouch. The pouch can be easily produced by using a pouch-producing machine conventionally known in consideration of the style of the aimed pouch.

The pouch-producing machine may be provided with various working mechanisms such as a trimming device, a punching device, a heat sealing device, a laser beam irradiating device and another device for additional working, and it can deal with plural work such as formation of the pouring portion, the cut off portion present at a side of the pouring portion, the opening aid including the notch and the half-cut line, the bulge portion to be extended on the wall portion of the pouch in a curved form, or the like. Individual mechanisms or functions required by the process, for example an embossing device, may be incorporated into an inline or separated as an off line.

In the third invention, half-cut line of the easy open pouch is partially changed in its depth and/or width so as to have a combination of a deep part and a shallow part and/or a combination of a wide part and a narrow part. For example, a deep part of the half-cut line may be formed in such manner that scanning for irradiation of the laser beam is temporarily stopped on the way of a course of the half-cut line, turned back in a little distance, and then restarted, and the same part of the course is irradiated with the laser beam at plural times by repeating a set of the former actions. A wide part of the half-cut line may be formed in such manner that scanning for irradiation of the laser beam is temporarily stopped on the way of a course of the half-cut line, turned back in a little distance, restarted, and then irradiation of the laser beam is carried out along a course a little shifting from the already scanned course so as to integrate a later formed half-cut line with an earlier formed one, and the same part of the course is irradiated with the laser beam at plural times by repeating a set of the former actions.

When depth and width is desired to be partially changed at the same part of the half-cut line or at different parts thereof per depth or width, the above described scanning operations for depth and width may be carried out in combination with each other.

Figure 26:
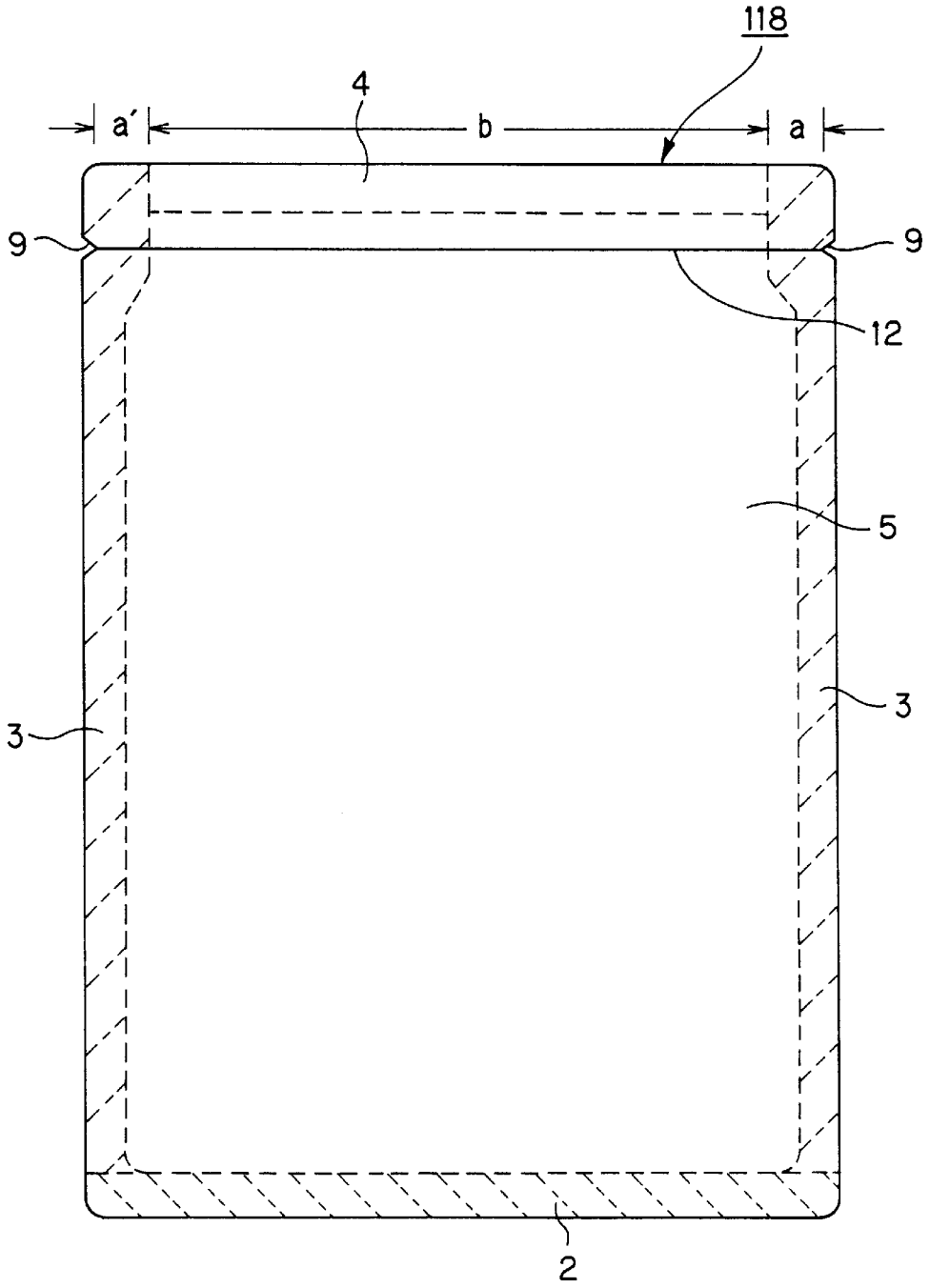
FIG. 26 is a plan view showing a pouch(118), which is one embodiment of the third invention.

FIG. 26 is a plan view showing an easy open pouch(118), which is one embodiment of the third invention. The portion of the pouch 118 is formed into a four-side sealed pouch in such manner that two films forming a front and a rear walls 5 are bonded together at their bottom portion and both sides by heat sealing to form a bottom heat seal portion 2, trunk heat seal portions 3 with an upper portion left non sealed, and a half-cut line 12 is formed at an opening position disposed a little below from the upper heat seal portion 4, and V-shaped notches 9 are formed at both ends of the half-cut line 12. The upper portion of the pouch is to be formed into an upper heat seal portion 4 after a content is filled into the pouch.

It is preferable that the half-cut line 12 is formed to the both films of the front and the rear walls so as to be aligned with each other in a symmetrical relationship. Though two notches 9 are formed at the both sides of the pouch 118, the notch may be formed at only one side.

The half-cut line 12 may be formed by irradiation of the laser beam. In the pouch 118 of FIG. 26, depth and/or width of the half-cut line 12 are made relatively deep and/or wide at parts (a, a') which is traversing the heat seal portions positioned on the both sides of the pouch, and on the other hand, those are made relatively shallow and/or narrow (in comparison with the parts (a, a')) at a part (b) which is traversing a non sealed portion defined as a middle part for storing of the content. That is, depth and/or width of the half-cut line 12 is made deep and/or wide at a seal portion from which opening is to be started in comparison with those made at the non seal portion.

The content can be easily filled into the pouch 118 via the upper opening, and thereafter the upper opening is heat sealed. Since the half-cut line 12 is made relatively shallow and/or narrow at the non sealed portion (b) as the middle part of the pouch 118 and strengthened to rupture at the same part, the sealed up pouch 118 can be prevented from being ruptured, thus improving safety. In addition, when the pouch 118 is opened, the tearing operation can be easily started from the right or left notch 9 and the upper heat seal portion 4 of the pouch 118 can be easily torn off along the half-cut line 12.

Figure 27:
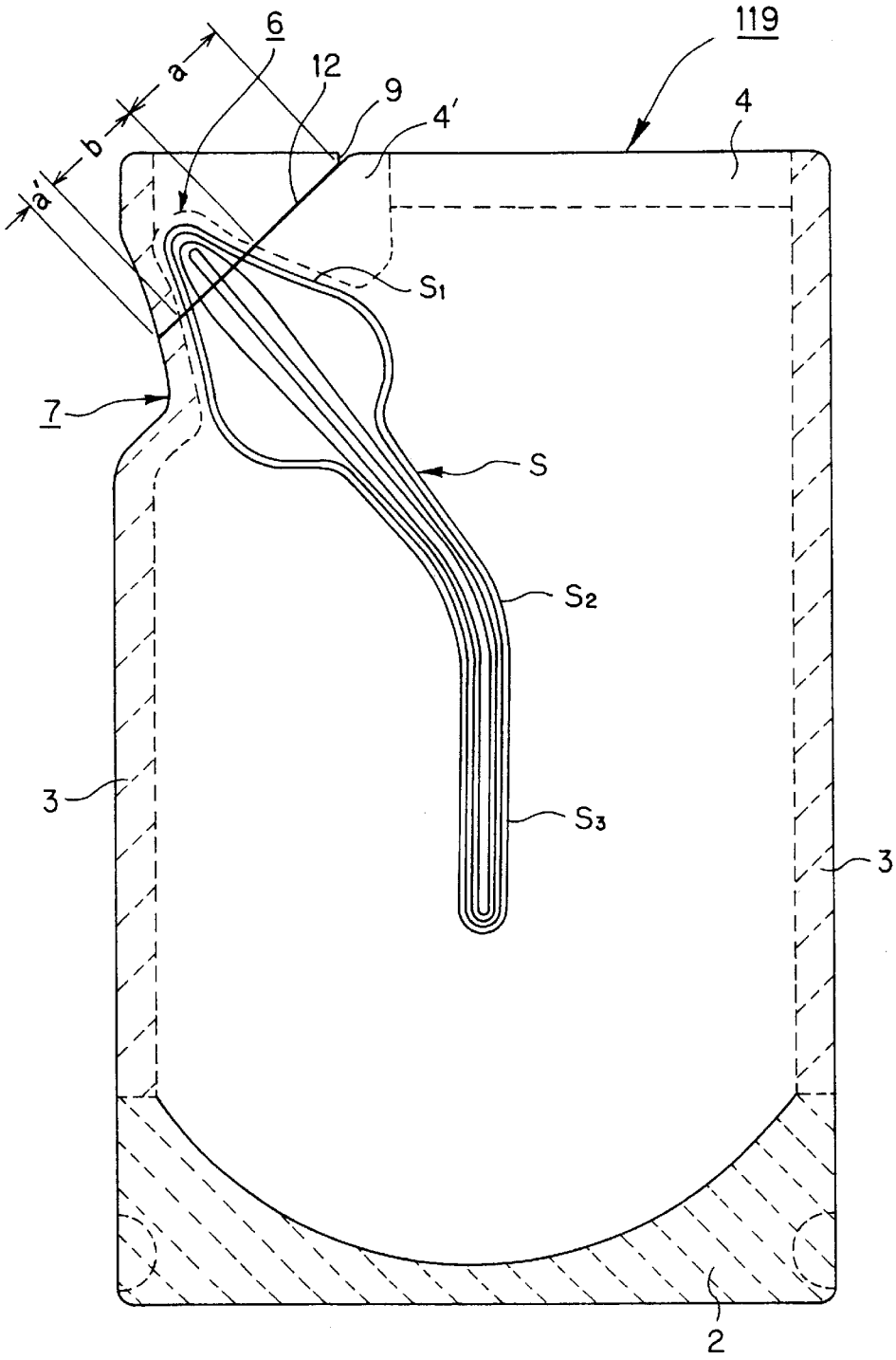
FIG. 27 is a plan view showing a pouch(119), which is another embodiment of the third invention.

FIG. 27 is a plan view showing an easy open pouch(119), which is another embodiment of the third invention.

Figure 28A:
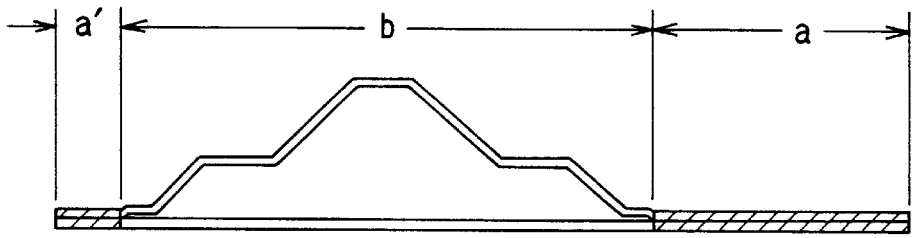
FIG. 28 includes 28A and 28B, and each of them is an enlarged sectional view showing one example of a cross section of the bulge portion of the pouch 119 in FIG. 27.
Figure 28B:
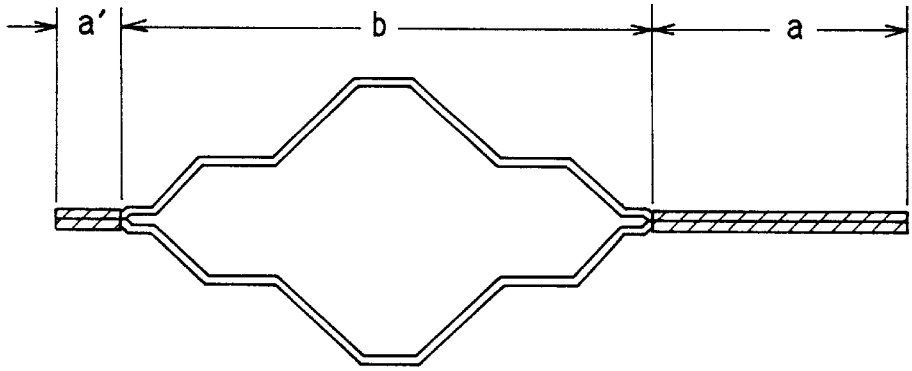

FIG. 28 includes 28A and 28B, and each of them is an enlarged sectional view showing one example of a cross section obtainable by cutting out the bulge portion S of the pouch 119 in FIG. 27 in parallel with its widthwise direction. More specifically, FIG. 27A is an enlarged sectional view of a cross section obtainable in a case where the bulge portion disposed only on the front wall portion is cut in parallel with the cut line (i.e, the half-cut line) at vicinity thereof, and FIG. 28B is an enlarged sectional view of a cross section obtainable in a case where the bulge portion disposed on both the wall portion in a symmetrical relationship is cut in parallel with the cut line (i.e, the half-cut line) at vicinity thereof.

A trunk portion of the pouch 119 is formed into a self-standing pouch. A bottom portion is formed in the ordinary manner, in which a film for the bottom portion is folded and positioned between two flat films so as to make gusset form protruding toward the inside of the pouch, and semicircular cut off portions are formed at vicinity of lower end on both sides of the film for the bottom portion, and the film for the bottom portion is heat sealed in a boat-like shape to form a bottom heat seal portion 2. The two flat films forming a front and a rear walls are in directly contact with each other at the semicircular cut off portion and bonded together at those positions by heat sealing. The trunk portion of the pouch 119 is formed by heat sealing two films constituting two flat portions, i.e., a front and a rear walls, at both side ends to form trunk heat seal portions 3.

A pouring portion 6 is formed at an upper corner of the pouch 119. The pouring portion 6 are defined by heat seal portion so as to form a narrow pouring channel passing through the pouring portion 6. At least one side of the pouring portion is formed into a cut off portion 7 by trimming. In the pouch 119 of FIG. 27, the cut off portion 7 is only at a side line of the pouch.

In the pouch 119 of FIG. 27, the bulge portion S extends on the wall portion. An upper part(S1) of the bulge portion develops in an obliquely downward direction from vicinity of the poring portion 6 to a center line with respect to a width direction of the pouch. Subsequently to the upper part(S1), a middle part(S2) of the bulge portion curves to a further downward direction. Thereafter, a lower part(S3) of the bulge portion develops in a vertically downward direction. Width and height of the bulge portion are set so as to be large at vicinity of the pouring portion 6, gradually reduce along the obliquely downward direction, and keep constant from the curved middle part(S2) to an end of the lower part(S3).

An out line of the bulge portion S can be defined by combination of flat faces, and, as shown in FIGS. 28A and 28B, the cross section obtained when the bulge portion S is cut out in parallel with its widthwise direction can be defined by combination of straight lines so as to have one or more steps different in height.

The bulge portion S may be formed to only one wall portion selected among the front and the rear walls, or both the wall portions so as to provide a symmetrical relationship between the two bulge portions.

The half-cut line 12 which extends across the pouring portion 6 at vicinity of the upper end thereof is formed to the film constituting the wall portion of the pouch 119 so as to traverse the upper part S1 of the bulge portion. A V-shaped notch 9 is formed at an upper end of the pouch 119 so as to connect with the half-cut line 12.

As to the upper heat seal portion (4, 4'), it is preferable that a part (4') of the upper heat seal portion which is adjacent to the pouring portion is sealed beforehand during a pouch-forming process, and filling of the content is carried out via a part (4) which is apart from the pouring portion 6.

Similarly to the pouch 118 of FIG. 26, depth and/or width of the half-cut line 12 of the pouch 119 are made relatively deep and/or wide at parts (a, a') which is traversing the heat seal portions positioned on the both sides of the pouring portion, and on the other hand, those are made relatively shallow and/or narrow (in comparison with the parts (a, a')) at a part (b) which is traversing a non sealed portion defined as a middle part for pouring of the content.

When the easy open pouch 119 as designed above is filled with the content, degassed and sealed at a position of the upper heat seal portion 4, the pouch 119 has a self-standing ability, easiness of handling and good appearance. When the content of the pouch 119 is poured into another container, the end part of the pouring portion 6 can be easily torn from the notch 9 along the half-cut line 12 by pinching the end part of the pouring portion 6 with fingers and pulling it in parallel with the half-cut line 12, thus opening the pouring portion 6.

In addition, since the half-cut line 12 of the pouch 119 is controlled so as to make the heat seal portions (a, a') as the both side portions differ from the non sealed portion (b) as the middle part in depth and/or width, the pouch 119 is prevented from being ruptured, thus improving in a safety of storing and a facilitation of the opening.

Since at least one of the wall portion of the pouch 119 is partially formed into the bulge portion S which extends from vicinity of the pouring portion 6 to the lower area of the pouch as described above, if the opened pouch 119 is stood somewhere, preferably on a plane face, the opening and the pouring channel of the opened pouch 119 can be made to spontaneously expand with its configuration well kept by the upper part S1 of the bulge portion.

In addition, the pouch 119 can be bent to an outward direction of the pouch along the lengthened bulge portion S(S1, S2, S3) by volume and weight of the content, thereby outward expanding an area lower than the pouring portion as well as the opening and the pouring channel.

Accordingly, the content of the pouch 119 can be smoothly flowed to the pouring portion 6 and smoothly poured out from the pouring portion 6.

Further, the lower part (S3) of the bulge portion provides rib effect because it takes roughly constant width and height and a vertical position, thereby improving in a self-standing ability and a configuration-keeping ability of the pouch.

Still further, since the out line of the bulge portion S of the pouch 119 is defined by combination of flat faces, and the cross section obtained when the bulge portion S is cut out in parallel with its widthwise direction can be defined by combination of straight lines so as to have one or more steps different in height, the bulge portion has a good resistance to a pushing load and a good restoration from collapse, thereby more improving an expanding ability of the opening, a configuration-keeping ability and a pouring performance.

The content of the pouch 119 can be poured into another container, such as bottle, in such manner that the trunk portion of the pouch 119 is supported by hand, the cut off portion 7 formed at a side of the pouring portion 6 is put to an edge of the opening of the container, and then the content is poured out from the opened pouring portion 6. According to this manner, steadiness of the pouring portion to the opening of another container is improved, and even if a viscous content is stored in the pouch, the content can be smoothly flowed to the pouring portion and the opening of the pouring portion is prevented from spontaneously closing, thus making it possible that the content is safely and easily poured into another container until pouring is completely finished.

As described above, according to the third invention, it is possible to produce the easy open pouch at a good productivity as well as a low cost through a process similar to that applicable to an ordinary pouch, and it is easy to fill the content into these pouches. When the pouch of the third invention is opened, an opening position of the pouch can be easily and exactly torn along the half-cut line 12. In addition, the pouch of the third invention is prevented from being ruptured, thus being excellent in safety of storage.

Because the pouch of the present invention often has the bulge portion of the wall portion or the gusset portion, when it is empty and folded flat, it is liable to vary its thickness depending on a part of the pouch, when such pouches are stacked in a pouch-feeder installed in a filling machine, a heap of the stacked pouches gets slant. Besides, when such pouches are. stacked in a corrugated box in order to store the empty pouch, the pouches are kept bent, thereby causing a bent warp, i.e., one kind of curling. Further, if the pouches occurring the bent warp are stuck to each other by static electricity, the two stuck pouches is liable to be fed together from the feeder into the filling machine, thereby causing troubles.

In order to reduce the slant occurring in a heap of the stacked pouches, if the pouch of the present invention has the bulge portion and/or the gusset portion, at least one wall portion of the pouch may be provided with a leveling bulge portion capable of compensating difference in thickness between a part holding the bulge portion or the gusset portion and the other part of the pouch.

Similarly to the bulge portion capable of improving the pouring performance, the leveling bulge portion may also be protrude to outward direction of the pouch, and shaped into a hollow configuration. Accordingly it may be formed to the flexible film by the same process as applicable for formation of the bulge portion.

Shape and position of the leveling bulge portion may be optionally changed. In order to secure some space between the stacked pouches by the leveling bulge portion, it is preferable to form the leveling bulge portion into circle, triangle, square, another polygon, or combination of the former shapes, and alternatively into any pattern such as a lattice pattern or a polka-dot pattern.

Shape of a cross section is also optional, and it may be take, for example, triangle, reversed U-shape, square, trapezoid or pentagon.

When the cross section of the leveling bulge portion takes a trapezoidal form or a shape having steps form in which plural trapezoids are stacked so as to position a smaller trapezoid on a larger trapezoid, each of linear corners which are corresponding to a corners of the trapezoid can provide rib effect. Accordingly, the leveling bulge portion can be improved in a resistance to a pushing load and a configuration-keeping ability, thereby more securing a beneficial effect of the leveling bulge portion.

When the leveling bulge portion is formed to a wall portion of a pouch having a bottom gusset so as to continuously or intermittently extend across an entire or relatively major area upper than a position of the bottom gusset, it is preferable to adjust height of the leveling bulge portion within 0.1 to 5.0 mm.

Figure 29:
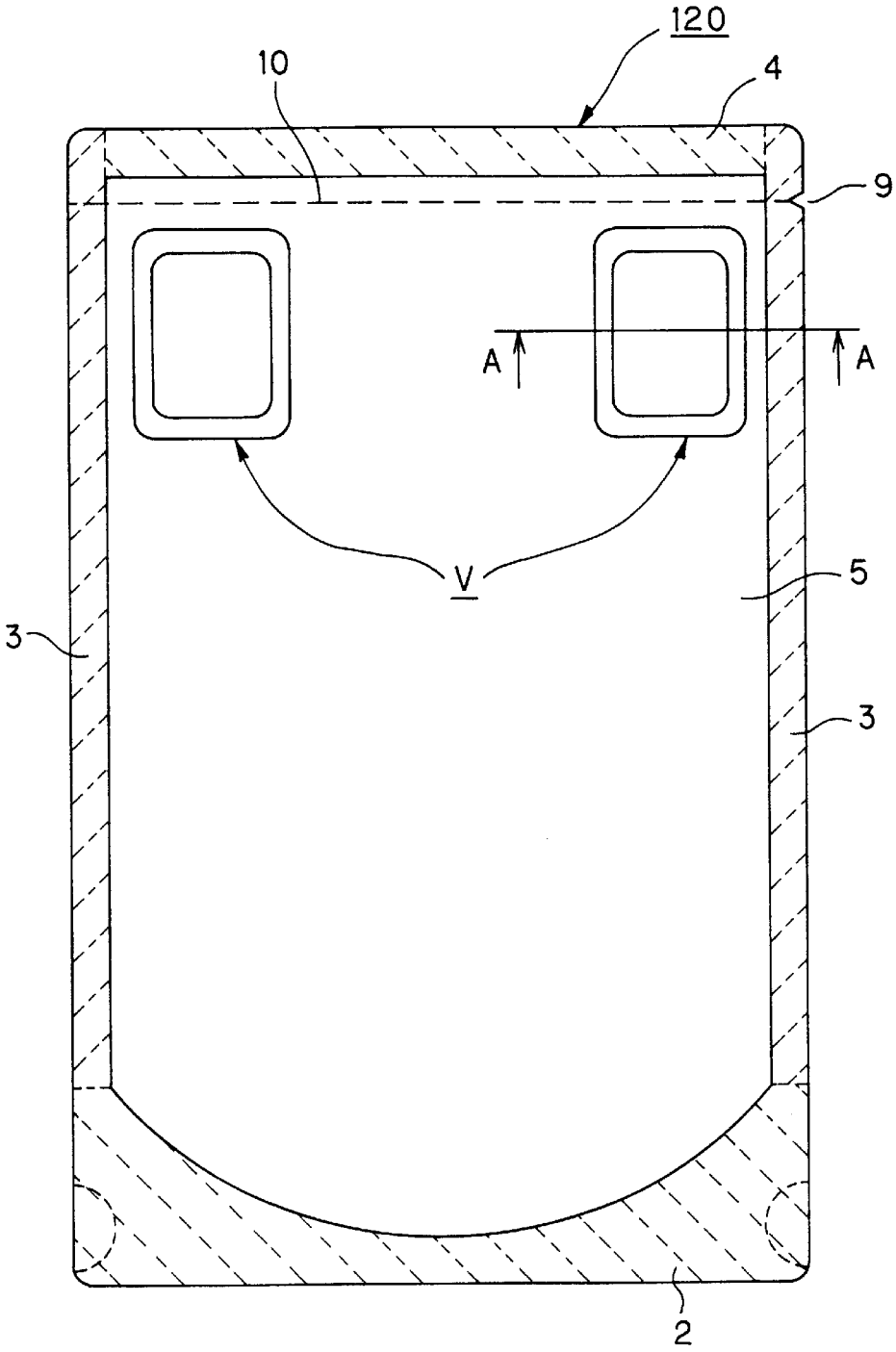
FIG. 29 is a plan view showing a pouch(120), which is one embodiment concerned with the pouch having the leveling bulge portion.

FIG. 29 is a plan view showing a pouch(120), which is one embodiment concerned with the pouch having the leveling bulge portion.

FIG. 30 includes 30A and 30B, and each of them is an enlarged sectional view showing one example of a cross section obtainable by cutting out the leveling bulge portion of the pouch 120 in FIG. 29 in parallel with its widthwise direction.

In FIG. 29, a trunk portion of the pouch 120 is formed into a self-standing pouch. A bottom portion 1 is formed in the ordinary manner, in which a film for the bottom portion is folded and positioned between two flat films so as to make gusset form protruding toward the inside of the pouch, and semicircular cut off portions are formed at vicinity of lower end on both sides of the film for the bottom portion, and the film for the bottom portion is heat sealed in a boat-like shape to form a bottom heat seal portion 2. The two flat films forming a front and a rear walls are in directly contact with each other at the semicircular cut off portion and bonded together at those positions by heat sealing. The trunk portion of the pouch 120 is formed by heat sealing two films constituting two flat portions 5, i.e., a front and a rear walls, at both side ends to form trunk heat seal portions 3.

Figure 30A:
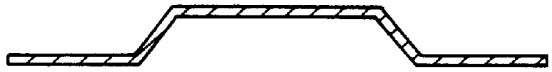
FIG. 30 includes 30A and 30B, and each of them is an enlarged sectional view showing one example of a cross section of the leveling bulge portion of the pouch 120 in FIG. 29.
Figure 30B:
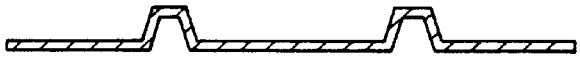

Before heat sealing of the films, the two leveling bulge portion V are formed to at least one flat film for the front or rear wall of the pouch 120 by, for example, a thermally embossing process so as to be arranged at both sides of an upper area of the flat film. In the pouch 120 of FIG.29, the leveling bulge portion V is shaped into rectangle. A cross section of the leveling bulge portion V may take such a shape as shown in FIG. 30A or FIG. 30B.

Since the leveling bulge portions V of the pouch 120 are disposed only at the upper area of the wall portion, if the leveling bulge portions V are formed only to the front wall (or the rear wall), it is preferable to set height of the leveling bulge portions to two times value of a thickness of the film for bottom portion in order to balance the leveling bulge portion with a thickness of the gusset portion. In such a situation as in the pouch 120, height of the leveling bulge portion is usually adjust within about 0.1 to 0.26 mm.

An upper end portion of the pouch 120 is sealed up by an upper heat seal portion 4, and a cut line 10 is set just below the upper heat seal portion 4 so as to extends across from one side to the other side of the pouch, and a notch 9 connecting with the cut line 10 is also formed at one side end of the pouch.

In the pouch 120 as designed above, since difference in thickness between the upper part and the bottom part of the pouch is reduced, a heap of the stacked pouches can be prevented from slanting. Accordingly, a large number of the pouches 120 can be stacked in a pouch-feeder of a filling machine or a storing case such as a corrugated box, thus being easy in handling. Besides, since the leveling bulge portion can secure a space between the stacked pouches 120, the pouches are prevented from sticking with each other. Accordingly, the pouch 120 can be exactly and smoothly fed out from the feeder per one piece, and a filling and sealing operation which is subsequent to the feeding operation can also be continued with no trouble.

Further, when the pouch 120 is filled with the content and sealed at a position of the upper heat seal portion 4, the pouch 120 has a self-standing ability, easiness of handling and good appearance. When the content of the pouch 120 is poured out, the end portion of the pouch can be easily torn from the notch 9 along the cut line 10, thus opening the pouch.

EXAMPLE

Hereinafter, the method to produce the film having the bulge portion is described in more detail by reference to the Examples.

Example 1

The molding process according to the second invention which can form the bulge portion was adapted to the formation of the pouch for refill to form the pouch 117 shown in FIG. 21, in which the bulge portion having such a trapezoidal A—A section as shown in FIG. 22A was formed to each of the front and the rear walls 5, 5' so as to be symmetrically arranged, an overall dimension was set to 110 mm of width and 200 mm of length, and a volume capacity was 250 mm.

Each of the lamination films 5, 5' for the pouch was prepared by taking an oriented nylon(ON) film with a thickness of 25 $\mu$m as a substrate film, printing on an inside surface of the ON film with a prescribed design, bonding a L-LDPE film with a thickness of 130 $\mu$m as a sealant layer to the printed surface by the dry lamination method.

An apparatus to produce the pouch was constructed in such manner that a molding device comprising two sets of the preheating portion and the molding portion was incorporated with a known machine capable of producing the self-standing pouch to construct an in-line processing, the molding device was interposed between a feeder portion and a heat sealing devise for sealing the bottom portion and trunk portion, and the two sets of the preheating portion and the molding portion was arranged in an upper and a lower rows as shown in FIG. 24.

The lamination films were fed into the producing apparatus, and treated therein in such manner that the bulge portions S having the shape shown in FIG. 21 and FIG. 22A were formed at prescribed positions of the both lamination films 5, 5', the films 5, 5' discharged from the upper row and the lower row were aligned with each other and then carried to a section for forming the pouch, and thereafter the ordinary process was carried out, that is, the bottom portion, the trunk portion and the pouring portion were formed by heat sealing, the both sides of the pouring portion were cut off by trimming, the continuous lamination film including a large number of pouches was cut out to form an individual pouch, thereby obtaining the pouch provided with the bulge portion S.

As to height of the bulge portion S, a wide part thereof which is positioned at vicinity of the pouring portion was set to a height of 2.0 mm, and a narrow portion thereof which tails from the lower position of the wide part was set so as to gradually reduce to a height of 1.0 mm along a downward direction.

Besides, as to conditions for the molding of the bulge portion, the preheating portion was controlled in such manner that a temperature of the heating plate was set within a range of 100 to 110° C., and a period for which the lamination film was in contact with the heating plate was set to 0.6 second. On the other hand, the molding portion was controlled in such manner that a depth of clearance provided to the inside space of the cavity e was set to 158$\mu$m so as to coincide with a thickness of the lamination the compressed air operation and the vacuum operation were carried in combination, the core and the cavity pieces were cooled to within 30 to 40° C., and a period of pressing for the press molding was set to 0.6 second.

As a result, an out line of the formed bulge portion was similar to the de shape of the cavity piece, and the bulge portion was shaped into a trapezoidal form having a sharp corner. Further, the configuration of the bulge portion was steadied to elapse.

What is claimed is:

1. A pouch formed of a flexible film and comprising wall portions constituting a front wall and a rear wall; and a pouring portion, wherein both sides of the pouring portion are defined by seal portions so as to form a pouring channel, and wherein at least one wall portion is partially protruded by a press molding in an outward direction from the pouch to form a bulge portion having a hollow structure near a vicinity of the pouring portion.

2. A pouch as claimed in claim 1, wherein at least one side of the pouring portion is provided with a cut off portion partially narrowing width of the pouring portion.

3. A pouch as claimed in claim 1, wherein the bulge portion is formed at the same position of each wall portion so as to superpose the bulge portions.

4. A pouch as claimed in claim 1, wherein the bulge portion has a general view defined by combination of flat faces, and a cross section defined by combination of straight lines when the bulge portion is cut out in parallel with its protrusive direction.

5. A pouch as claimed in claim 4, wherein at least a part of the bulge portion closer to the pouring portion is formed in a shape having plural steps different in height.

6. A pouch as claimed in claim 1, wherein the pouch is a self-standing pouch, and the bulge portion extends on the wall portion so as to develop an upper part of the bulge portion in an obliquely downward direction from vicinity of the poring portion to a center line with respect to a width direction of the pouch, curve a middle part of the bulge portion to a further downward direction, and develop a lower part of the bulge portion in a vertically downward direction, and width and height of the bulge portion are set so as to have a predetermined size at vicinity of the pouring portion, gradually reduce along the obliquely downward direction, and keep constant from the curved middle part of the bulge portion to a further lower position.

7. A pouch as claimed in claim 6, wherein the bulge portion has a general view defined by combination of flat faces, and a cross section defined by combination of straight lines when the bulge portion is cut out in parallel with its protrusive direction.

8. A pouch as claimed in claim 7, wherein at least a part of the bulge portion closer to the pouring portion is formed in a shape having plural steps different in height.

9. A pouch as claimed in claim 1, wherein the pouch is a self-standing pouch, and the pouring portion is disposed at an upper corner of the pouch so as to extend in an obliquely upward direction, and the bulge portion extends on the wall portion so as to develop in a curved form from vicinity of the pouring portion toward a diagonally lower corner of the pouch, and width of the bulge portion are set so as to have a predetermined size at vicinity of the pouring portion, gradually reduce along the obliquely downward direction, and form a linear rib at a lower part.

10. A pouch as claimed in claim 9, wherein a slant of the bulge portion becomes gradually steep according as closer to the diagonally lower corner.

11. A pouch as claimed in claim 9, wherein the bulge portion has a general view defined by combination of flat faces, and a cross section defined by combination of straight lines when the bulge portion is cut out in parallel with its protrusive direction.

12. A pouch as claimed in claim 11, wherein at least a part of the bulge portion closer to the pouring portion is formed in a shape having plural steps different in height.

13. A pouch as claimed in claim 1, wherein the pouch is a self-standing pouch, and the pouring portion is disposed at an upper corner of the pouch so as to extend in an obliquely upward direction, and the bulge portion extends on the wall portion so as to develop in a curved form from vicinity of the pouring portion toward a diagonally lower corner of the pouch, and width and height of the bulge portion are set so as to have a predetermined size at vicinity of the pouring portion, gradually reduce along the obliquely downward direction, and keep almost constant at a lower part.

14. A pouch as claimed in claim 13, wherein the bulge portion has a general view defined by combination of flat faces, and a cross section defined by combination of straight lines when the bulge portion is cut out in parallel with its protrusive direction.

15. A pouch as claimed in claim 14, wherein at least a part of the bulge portion closer to the pouring portion is formed in a shape having plural steps different in height.

16. A pouch as claimed in claim 1, wherein the pouch is a self-standing pouch, and the pouring portion is disposed at an upper corner of the pouch so as to extend in an obliquely upward direction, and the bulge portion extends on the wall portion so as to develop in an obliquely downward direction from vicinity of the pouring portion to vicinity of a center of the pouch or develop in a V-turned form from vicinity of the pouring portion to vicinity of an opposite upper corner of the pouch via vicinity of the center of the pouch, and width and height of the bulge portion are set so as to have a predetermined size at vicinity of the pouring portion, and become small at a further tailing part.

17. A pouch as claimed in claim 16, wherein the bulge portion has a general view defined by combination of flat faces, and a cross section defined by combination of straight lines when the bulge portion is cut out in parallel with its protrusive direction.

18. A pouch as claimed in claim 17, wherein at least a part of the bulge portion closer to the pouring portion is formed in a shape having plural steps different in height.

19. A pouch as claimed in claim 1, wherein the pouring portion is provided with an opening aid capable of facilitating opening of the pouring portion.

20. A pouch as claimed in claim 19, wherein the opening aid is a combination of a notch and a half-cut line.

21. A pouch as claimed in claim 19, wherein the pouring portion is further provided with a pinch portion at an end of the pouring portion.

22. A pouch as claimed in claim 19, wherein the pouring portion is provided with a halfcut line as the opening aid, and the half-cut line extends on the pouring portion so as to start-from the seal portion of one side, traverse a non seal portion as a middle portion and reach the other seal portion of the opposite side, and depth and/or width of the half-cut line is made deep and/or wide at the seal portion from which opening is to be started in comparison with those made at the non seal portion.

23. A pouch as claimed in claim 22, wherein the bulge portion has a general view defined by combination of flat faces, and a cross section defined by combination of straight lines when the bulge portion is cut out in parallel with its protrusive direction, and at least a part of the bulge portion closer to the pouring portion is formed in a shape having plural steps different in height.

24. A pouch as claimed in claim 1, wherein both sides of the pouring portion is defined by the seal portions so as to form a neck portion, a shoulder portion starting from a lower end of the neck portion, and the poring channel passing through the neck and the shoulder portions, and two inside lines defining the both sides of the pouring channel are formed so as to taper off the pouring channel to its upper end with two-stage changing of slant, the inside line of the shoulder portion having a gentle slant in comparison with that of the neck portion.

25. A pouch as claimed in claim 1, wherein both sides of the pouring portion is defined by the seal portions so as to form a neck portion, a shoulder portion starting from a lower end of the neck portion, and the poring channel passing through the neck and the shoulder portions, and the pouring portion is provided with a cut line indicating a course for opening of the pouring portion, the cut line crossing perpendicularly to an axis of the pouring channel and passing over a vertex of a vertical angle of an assumed right triangle or a position closer to a center of the pouch than the vertex when the assumed right triangle is drawn by taking a straight line defined by two connection points connecting an inside line of the seal portion of the neck portion and that of the shoulder portion as its base, facing its vertical angle toward an upper end of the pouring portion, and setting its vertex of the vertical angle on the axis of the pouring channel.

26. A pouch as claimed in claim 1, wherein the pouch further comprises a gusset portion, and at least one wall portion is partially protruded to an outward direction of the pouch to be provided with a leveling bulge portion having a hollow structure, the leveling bulge portion being capable of reducing a slant of stacked pouches.

* * * * *

UNITED STATES PATENT AND TRADEMARK OFFICE

CERTIFICATE OF CORRECTION

PATENT NO. : 6,667,081 B1
APPLICATION NO. : 09/334912
DATED : December 23, 2003
INVENTOR(S) : Yukitaka Aoki et al.

It is certified that error appears in the above-identified patent and that said Letters Patent is hereby corrected as shown below:

Column 47, line 6, in Claim 1, before the period, insert the following:

--, wherein the bulge portion has a width and a height which is larger at the pouring portion and gradually reduces in width and height as the bulge portion extends away from the pouring portion--

Signed and Sealed this

Sixth Day of April, 2010

David J. Kappos

David J. Kappos
*Director of the United States Patent and Trademark Office*